US010048616B2

(12) United States Patent
Shimizu et al.

(10) Patent No.: US 10,048,616 B2
(45) **Date of Patent: *Aug. 14, 2018**

(54) DETECTION GEAR PROVIDED WITH PROTRUSION, AND DEVELOPING CARTRIDGE PROVIDED WITH THE SAME

(71) Applicant: BROTHER KOGYO KABUSHIKI KAISHA, Nagoya-shi, Aichi-ken (JP)

(72) Inventors: Keita Shimizu, Nagoya (JP); Takashi Shimizu, Nagoya (JP); Hideshi Nishiyama, Owariasahi (JP); Naoya Kamimura, Ichinomiya (JP); Tomonori Watanabe, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/407,961

(22) Filed: Jan. 17, 2017

(65) Prior Publication Data

US 2017/0123347 A1 May 4, 2017

Related U.S. Application Data

(63) Continuation of application No. PCT/JP2015/080813, filed on Oct. 30, 2015.

(51) Int. Cl.
*G03G 15/08* (2006.01)
*G03G 21/16* (2006.01)

(52) U.S. Cl.
CPC ..... *G03G 15/0865* (2013.01); *G03G 15/0863* (2013.01); *G03G 15/0896* (2013.01); *G03G 21/1647* (2013.01); *G03G 2221/1657* (2013.01)

(58) Field of Classification Search
CPC ..... G03G 15/0865; G03G 15/0867; G03G 15/0872; G03G 15/0886; G03G 15/0877
USPC ..... 399/262
See application file for complete search history.

(56) References Cited

U.S. PATENT DOCUMENTS

2006/0193646 A1 8/2006 Suzuki et al.
2012/0243882 A1* 9/2012 Carot ..... G03G 15/0863 399/12

(Continued)

FOREIGN PATENT DOCUMENTS

JP 54-22230 A 2/1979
JP 4348632 B2 10/2009

(Continued)

OTHER PUBLICATIONS

Extended European Search Report issued in European Patent Application No. 15899117.4, dated Jun. 30, 2017.

(Continued)

*Primary Examiner* — Walter L Lindsay, Jr.
*Assistant Examiner* — Frederick Wenderoth
(74) *Attorney, Agent, or Firm* — Merchant & Gould P.C.

(57) ABSTRACT

A developing cartridge may include: a casing; a first gear; and a second gear. The first gear may include: a small-diameter gear portion and a large-diameter gear portion. The second gear may include: a first columnar portion; a second columnar portion; a first engaging portion; a second engaging portion; and a protrusion. The first engaging portion may be provided at the first columnar portion and may be engageable with the small-diameter gear portion. The second engaging portion may be provided at the second columnar portion and positioned closer than the first engaging portion to the casing in the axials direction. The second engaging portion may be engageable with the large-diameter gear portion. The protrusion may be rotatable together with (Continued)

the first and second engaging portions. The second engaging portion may be engageable with the large-diameter gear portion after the first engaging portion has engaged with the small-diameter gear portion.

120 Claims, 27 Drawing Sheets

(56) References Cited

U.S. PATENT DOCUMENTS

| | | | | |
|---|---|---|---|---|
| 2013/0051814 | A1 | 2/2013 | Itabashi et al. | |
| 2013/0170845 | A1* | 7/2013 | Itabashi | G03G 15/757 399/12 |
| 2014/0186058 | A1 | 7/2014 | Shimizu | |
| 2015/0212475 | A1 | 7/2015 | Ueno | |
| 2017/0123346 | A1 | 5/2017 | Shimizu | |

FOREIGN PATENT DOCUMENTS

| | | | |
|---|---|---|---|
| JP | 2012-194318 | A | 10/2012 |
| JP | 2014-106442 | A | 6/2014 |
| JP | 2014-130183 | A | 7/2014 |

OTHER PUBLICATIONS

Related U.S. Appl. No. 15/407,857, filed Jan. 17, 2017.
International Search Report and Written Opinion issued in international application PCT/JP2015/080813, dated Dec. 15, 2015.
International Search Report and Written Opinion issued in International Patent Application No. PCT/JP2015/080812, dated Dec. 22, 2015.
International Search Report and Written Opinion issued in international application PCT/JP2015/080813, dated Oct. 30, 2015.
Extended European Search Report issued in European Patent Application No. 15899116.6, dated Jul. 31, 2017.
U.S. Office Action (Notice of Allowance) mailed in related U.S. Appl. No. 15/407,857, dated Nov. 29, 2017.
Extended European Search Report issued in related EP application No. 17191064.9, dated Feb. 5, 2018.
International Preliminary Report on Patentability issued in related International Patent Application No. PCT/JP2015/080812, dated Apr. 12, 2018.
International Preliminary Report on Patentability issued in corresponding International Patent Application No. PCT/JP2015/080813, dated May 11, 2018.

* cited by examiner

DETECTION GEAR PROVIDED WITH PROTRUSION, AND DEVELOPING CARTRIDGE PROVIDED WITH THE SAME

CROSS REFERENCE TO RELATED APPLICATION

This application is a continuation of International Application No. PCT/JP2015/080813 filed Oct. 30, 2015 in Japan Patent Office as a Receiving Office. The entire content of the international application is incorporated herein by reference.

TECHNICAL FIELD

The present disclosure relates to a detection gear and a developing cartridge provided with the detection gear.

BACKGROUND

A developing cartridge known in the art is provided with a detection gear including a protrusion. There is also known an image forming apparatus provided with an actuator.

Specifically, when the developing cartridge receives a drive force from the image forming apparatus after the developing cartridge is attached to the image forming apparatus, the detection gear in the developing cartridge rotates. The rotation of the detection gear shifts the protrusion between a contact state in which the protrusion is in contact with the actuator, and a non-contact state in which the protrusion is not in contact with the actuator. These shifts between the contact state and the non-contact state of the protrusion, or the number of protrusions, indicate specifications of the developing cartridge.

SUMMARY

A new detection gear has been devised.

It is an object of the disclosure to provide a detection gear having a new configuration, or a developing cartridge provided with a detection gear having a new configuration.

In order to attain the above and other objects, according to one aspect, the disclosure provides a developing cartridge that may include: a casing; a first gear; and a second gear. The casing may be configured to accommodate a developer therein. The first gear may be rotatable about a first axis extending in an axial direction. The first gear may include: a small-diameter gear portion; and a large-diameter gear portion having a diameter greater than a diameter of the small-diameter gear portion. The second gear may be rotatable about a second axis extending in the axial direction. The second gear may include: a first columnar portion; a second columnar portion; a first engaging portion; a second engaging portion; and a protrusion. The first columnar portion may extend in the axial direction and be centered on the second axis. The second columnar portion may be centered on the second axis and extend in the axial direction. The second columnar portion has a diameter smaller than a diameter of the first columnar portion. The first engaging portion may be provided along a portion of a circumferential surface of the first columnar portion. The first engaging portion may be engageable with the small-diameter gear portion. The second engaging portion may be provided along a portion of a circumferential surface of the second columnar portion. The second engaging portion may be positioned closer to the casing in the axial direction than the first engaging portion to the casing in the axial direction. The second engaging portion may be engageable with the large-diameter gear portion. The protrusion may protrude in the axial direction and be rotatable together with the first engaging portion and the second engaging portion. The second engaging portion may be engageable with the large-diameter gear portion after the first engaging portion has engaged with the small-diameter gear portion.

According to another aspect, the disclosure provides a developing cartridge that may include: a casing; a first gear; and a second gear. The casing may be configured to accommodate a developer therein. The first gear may be rotatable about a first axis extending in an axial direction. The first gear may include: a small-diameter gear portion; and a large-diameter gear portion having a diameter greater than a diameter of the small-diameter gear portion. The second gear may be rotatable about a second axis extending in the axial direction. The second gear may include: a first engaging portion; a second engaging portion; and a protrusion. The first engaging portion may be provided along a first portion of a circumferential surface of the second gear. The first engaging portion may be engageable with the small-diameter gear portion. The second engaging portion may be positioned closer to the casing than the first engaging portion to the casing in the axial direction. The second engaging portion may be provided along a second portion of the circumferential surface of the second gear. The second engaging portion may be provided at a position different from the first engaging portion in a rotating direction of the second gear. The second engaging portion may be engageable with the large-diameter gear portion after the first engaging portion has engaged with the small-diameter gear portion. The protrusion may protrude in the axial direction and be rotatable together with the first engaging portion and the second engaging portion. A locus defined by rotation of the second engaging portion may be smaller than a locus defined by rotation of the first engaging portion.

According to still another aspect, the disclosure provides a detection gear that may be rotatable about an axis extending in an axial direction. The detection gear may include: a protrusion; a first engaging portion; and a second engaging portion. The protrusion may extend in the axial direction and have an outer surface extending along a portion of a circumference of the detection gear. The first engaging portion may extend along a first portion of the circumference of the detection gear. The first engaging portion may be positioned closer to the axis than the outer surface to the axis in a radial direction of the detection gear. The second engaging portion may extend along a second portion of the circumference of the detection gear. The second portion may be different from the first portion. The second engaging portion may be positioned closer to the axis than the first engaging portion to the axis in the radial direction.

According to still another aspect, the disclosure provides a developing cartridge that may include a detection gear rotatable about a first axis extending in an axial direction. The detection gear may include: a protrusion; a first engaging portion; and a second engaging portion. The protrusion may extend in the axial direction and may have an outer surface extending along a portion of a circumference of the detection gear. The first engaging portion may extend along a first portion of the circumference of the detection gear. The first engaging portion may be positioned closer to the first axis than the outer surface to the first axis in a radial direction of the detection gear. The second engaging portion may extend along a second portion of the circumference of the detection gear. The second portion may be different from the first portion. The second engaging portion may be positioned closer to the first axis than the first engaging portion to the axis in the radial direction.

BRIEF DESCRIPTION OF THE DRAWINGS

The particular features and advantages of the embodiment(s) as well as other objects will become apparent from the following description taken in connection with the accompanying drawings, in which:

FIGS. 14A through 14C are explanatory diagrams for the standard-type detection gear 300S, in which:

FIG. 14A is an explanatory diagram illustrating a state of an actuator 22 in relation to the cross section of the developing cartridge 8 taken along the line AA in FIG. 1 when the standard-type detection gear 300S is at the initial position;

FIG. 14B is an explanatory diagram illustrating a state of the transmission gear 400 and the standard-type detection gear 300S in relation to a cross section of the developing cartridge 8 taken along a line CC in FIG. 1 when the standard-type detection gear 300S is at the initial position; and FIG. 14C is an explanatory diagram illustrating a state of the transmission gear 400 and the standard-type detection gear 300S in relation to a cross section of the developing cartridge 8 taken along a line EE in FIG. 1 when the standard-type detection gear 300S is at the initial position;

FIGS. 15A through 15C are explanatory diagrams for the standard-type detection gear 300S, in which:

FIG. 15A is an explanatory diagram illustrating a state of the actuator 22 in relation to the cross section of the developing cartridge 8 taken along the line AA in FIG. 1 when a first gear portion 332S of the standard-type detection gear 300S is meshed with a small-diameter gear portion 450;

FIG. 15B is an explanatory diagram illustrating a state of the transmission gear 400 and the standard-type detection gear 300S in relation to the cross section of the developing cartridge 8 taken along the line CC in FIG. 1 when the first gear portion 332S is meshed with the small-diameter gear portion 450; and FIG. 15C is an explanatory diagram illustrating a state of the transmission gear 400 and the standard-type detection gear 300S in relation to the cross section of the developing cartridge 8 taken along the line EE in FIG. 1 when the first gear portion 332S is meshed with the small-diameter gear portion 450;

FIGS. 16A through 16C are explanatory diagrams for the standard-type detection gear 300S, in which:

FIG. 16A is an explanatory diagram illustrating a state of the actuator 22 in relation to the cross section of the developing cartridge 8 taken along the line AA in FIG. 1 when a protrusion 301S of the standard-type detection gear 300S is separated from the actuator 22;

FIG. 16B is an explanatory diagram illustrating a state of the transmission gear 400 and the standard-type detection gear 300S in relation to the cross section of the developing cartridge 8 taken along the line CC in FIG. 1 when the protrusion 301S is separated from the actuator 22; and FIG. 16C is an explanatory diagram illustrating a state of the transmission gear 400 and the standard-type detection gear 300S in relation to the cross section of the developing cartridge 8 taken along the line EE in FIG. 1 when the protrusion 301S is separated from the actuator 22;

FIGS. 17A through 17C are explanatory diagrams for the standard-type detection gear 300S, in which:

FIG. 17A is an explanatory diagram illustrating a state of the actuator 22 in relation to the cross section of the developing cartridge 8 taken along the line AA in FIG. 1 when the first gear portion 332S and the small-diameter gear portion 450 become unmeshed;

FIG. 17B is an explanatory diagram illustrating a state of the transmission gear 400 and the standard-type detection gear 300S in relation to the cross section of the developing cartridge 8 taken along the line CC in FIG. 1 when the first gear portion 332S and the small-diameter gear portion 450 become unmeshed; and FIG. 17C is an explanatory diagram illustrating a state of the transmission gear 400 and the standard-type detection gear 300S in relation to the cross section of the developing cartridge 8 taken along the line EE in FIG. 1 when the first gear portion 332S and the small-diameter gear portion 450 become unmeshed;

FIGS. 18A through 18C are explanatory diagrams for the standard-type detection gear 300S, in which:

FIG. 18A is an explanatory diagram illustrating a state of the actuator 22 in relation to the cross section of the developing cartridge 8 taken along the line AA in FIG. 1 when a second gear portion 352 of the standard-type detection gear 300S is meshed with a large-diameter gear portion 440;

FIG. 18B is an explanatory diagram illustrating a state of the transmission gear 400 and the standard-type detection gear 300S in relation to the cross section of the developing cartridge 8 taken along the line CC in FIG. 1 when the second gear portion 352 is meshed with the large-diameter gear portion 440; and FIG. 18C is an explanatory diagram illustrating a state of the transmission gear 400 and the standard-type detection gear 300S in relation to the cross section of the developing cartridge 8 taken along the line EE in FIG. 1 when the second gear portion 352 is meshed with the large-diameter gear portion 440;

FIGS. 19A through 19C are explanatory diagrams for the standard-type detection gear 300S, in which:

FIG. 19A is an explanatory diagram illustrating a state of the actuator 22 in relation to the cross section of the developing cartridge 8 taken along the line AA in FIG. 1 when the standard-type detection gear 300S is at a final position;

FIG. 19B is an explanatory diagram illustrating a state of the transmission gear 400 and the standard-type detection gear 300S in relation to the cross section of the developing cartridge 8 taken along the line CC in FIG. 1 when the standard-type detection gear 300S is at the final position; and FIG. 19C is an explanatory diagram illustrating a state of the transmission gear 400 and the standard-type detection gear 300S in relation to the cross section of the developing cartridge 8 taken along the line EE in FIG. 1 when the standard-type detection gear 300S is at the final position;

FIGS. 20A through 20C are explanatory diagrams for the high-capacity-type detection gear 300H, in which:

FIG. 20A is an explanatory diagram illustrating a state of the actuator 22 in relation to the cross section of the developing cartridge 8 taken along the line AA in FIG. 1 when the high-capacity-type detection gear 300H is at the initial position;

FIG. 20B is an explanatory diagram illustrating a state of the transmission gear 400 and the high-capacity-type detection gear 300H in relation to the cross section of the developing cartridge 8 taken along the line CC in FIG. 1 when the high-capacity-type detection gear 300H is at the initial position; and FIG. 20C is an explanatory diagram illustrating a state of the transmission gear 400 and the high-capacity-type detection gear 300H in relation to the cross section of the developing cartridge 8 taken along the line EE in FIG. 1 when the high-capacity-type detection gear 300H is at the initial position;

FIGS. 21A through 21C are explanatory diagrams for the high-capacity-type detection gear 300H, in which:

FIG. 21A is an explanatory diagram illustrating a state of the actuator 22 in relation to the cross section of the developing cartridge 8 taken along the line AA in FIG. 1 when a first gear portion 332H of the high-capacity-type detection gear 300H is meshed with the small-diameter gear portion 450;

FIG. 21B is an explanatory diagram illustrating a state of the transmission gear 400 and the high-capacity-type detection gear 300H in relation to the cross section of the developing cartridge 8 taken along the line CC in FIG. 1 when the first gear portion 332H is meshed with the small-diameter gear portion 450; and FIG. 21C is an explanatory diagram illustrating a state of the transmission gear 400 and the high-capacity-type detection gear 300H in relation to the cross section of the developing cartridge 8 taken along the line EE in FIG. 1 when the first gear portion 332H is meshed with the small-diameter gear portion 450;

FIGS. 22A through 22C are explanatory diagrams for the high-capacity-type detection gear 300H, in which:

FIG. 22A is an explanatory diagram illustrating a state of the actuator 22 in relation to the cross section of the developing cartridge 8 taken along the line AA in FIG. 1 when a protrusion 301H of the high-capacity-type detection gear 300H is separated from the actuator 22;

FIG. 22B is an explanatory diagram illustrating a state of the transmission gear 400 and the high-capacity-type detection gear 300H in relation to the cross section of the developing cartridge 8 taken along the line CC in FIG. 1 when the protrusion 301H is separated from the actuator 22; and FIG. 22C is an explanatory diagram illustrating a state of the transmission gear 400 and the high-capacity-type detection gear 300H in relation to the cross section of the developing cartridge 8 taken along the line EE in FIG. 1 when the protrusion 301H is separated from the actuator 22;

FIGS. 23A through 23C are explanatory diagrams for the high-capacity-type detection gear 300H, in which:

FIG. 23A is an explanatory diagram illustrating a state of the actuator 22 in relation to the cross section of the developing cartridge 8 taken along the line AA in FIG. 1 when the first gear portion 332H and the small-diameter gear portion 450 become unmeshed;

FIG. 23B is an explanatory diagram illustrating a state of the transmission gear 400 and the high-capacity-type detection gear 300H in relation to the cross section of the developing cartridge 8 taken along the line CC in FIG. 1 when the first gear portion 332H and the small-diameter gear portion 450 become unmeshed; and FIG. 23C is an explanatory diagram illustrating a state of the transmission gear 400 and the high-capacity-type detection gear 300H in relation to the cross section of the developing cartridge 8 taken along the line EE in FIG. 1 when the first gear portion 332H and the small-diameter gear portion 450 become unmeshed;

FIGS. 24A through 24C are explanatory diagrams for the high-capacity-type detection gear 300H, in which:

FIG. 24A is an explanatory diagram illustrating a state of the actuator 22 in relation to the cross section of the developing cartridge 8 taken along the line AA in FIG. 1 when a second gear portion 352 of the high-capacity-type detection gear 300H is meshed with the large-diameter gear portion 440;

FIG. 24B is an explanatory diagram illustrating a state of the transmission gear 400 and the high-capacity-type detection gear 300H in relation to the cross section of the developing cartridge 8 taken along the line CC in FIG. 1 when the second gear portion 352 is meshed with the large-diameter gear portion 440; and FIG. 24C is an explanatory diagram illustrating a state of the transmission gear 400 and the high-capacity-type detection gear 300H in relation to the cross section of the developing cartridge 8 taken along the line EE in FIG. 1 when the second gear portion 352 is meshed with the large-diameter gear portion 440;

FIGS. 25A through 25C are explanatory diagrams for the high-capacity-type detection gear 300H, in which:

FIG. 25A is an explanatory diagram illustrating a state of the actuator 22 in relation to the cross section of the developing cartridge 8 taken along the line AA in FIG. 1 when the high-capacity-type detection gear 300H is at the final position;

FIG. 25B is an explanatory diagram illustrating a state of the transmission gear 400 and the high-capacity-type detection gear 300H in relation to the cross section of the developing cartridge 8 taken along the line CC in FIG. 1 when the high-capacity-type detection gear 300H is at the final position; and FIG. 25C is an explanatory diagram illustrating a state of the transmission gear 400 and the high-capacity-type detection gear 300H in relation to the cross section of the developing cartridge 8 taken along the line EE in FIG. 1 when the high-capacity-type detection gear 300H is at the final position;

DETAILED DESCRIPTION

Figure 1:
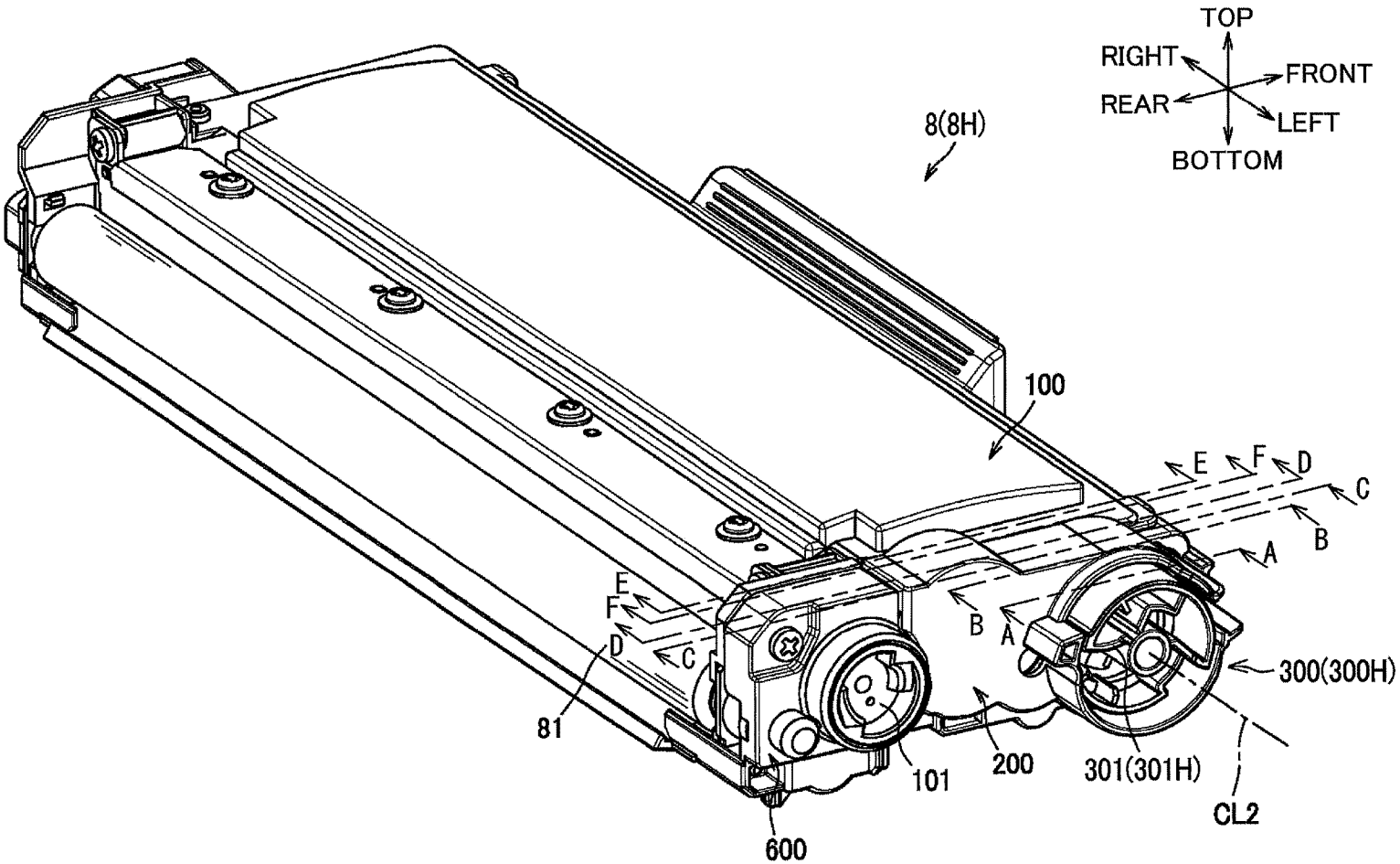
FIG. 1 is a perspective view of a developing cartridge 8 according to one embodiment.

A developing cartridge 8 according to one embodiment will be described with reference to the accompanying drawings, wherein like parts and components are designated by the same reference numerals to avoid duplicating description. Directions referred to in the following description are based on directions indicated in the drawings.

[Structure of Developing Cartridge]

An overview of the developing cartridge 8 will be described with reference to FIGS. 1 and 2.

Figure 2:
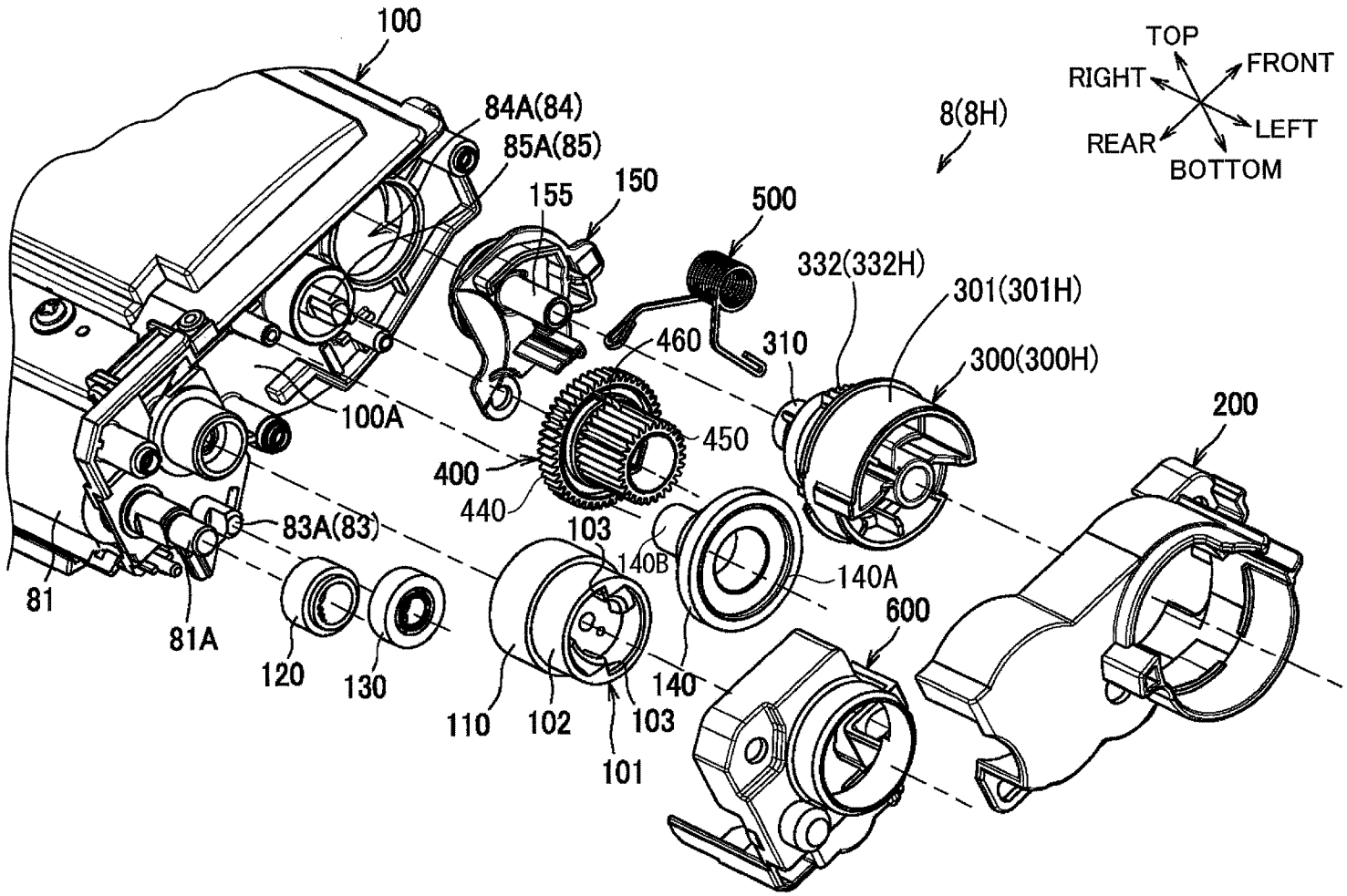
FIG. 2 is an exploded perspective view of parts and components of the developing cartridge 8.

As illustrated in FIGS. 1 and 2, the developing cartridge 8 includes a developing roller 81, a supply roller 83, an agitator 85, a casing 100, a first gear cover 200, and a second gear cover 600. The developing cartridge 8 further includes an input gear 110, a developing roller gear 120, a supply roller gear 130, an idle gear 140, a detection gear 300, and a transmission gear 400.

Note that the developing cartridge 8 illustrated in FIGS. 1 and 2 is a high-capacity-type developing cartridge 8H. Therefore, the detection gear 300 illustrated in FIGS. 1 and 2 is a high-capacity-type detection gear 300H.

Note also that the first gear cover 200 and the second gear cover 600 may be integrally formed as a single gear cover.

As illustrated in FIGS. 1 and 2, the detection gear 300 includes a protrusion 301.

The protrusion 301 is rotatable about a second axis CL2 together with the detection gear 300. The protrusion 301 extends in an axial direction in which the second axis CL2 extends. The protrusion 301 is exposed outside through the first gear cover 200. The detection gear 300 also includes a rotational shaft portion 310. The rotational shaft portion 310 is rotatable about a boss 155 (described later) that extends along the second axis CL2. The rotational shaft portion 310 extends in the axial direction. The rotational shaft portion 310 includes one end portion (i.e. left end portion), and the other end portion (i.e. right end portion) that is separated from the one end portion in the axial direction. The protrusion 301 is positioned at the one end portion of the rotational shaft portion 310 in the axial direction. The protrusion 301 is positioned outside the rotational shaft portion 310 in a radial direction of the rotational shaft portion 310. The protrusion 301 is separated from the second axis CL2 in a radial direction of the detection gear 300. The structure of the protrusion 301 will be described later in detail. The developing roller 81 extends in the axial direction. The detection gear 300 is rotatable about the second axis CL2 that extends in the axial direction. The rotational shaft portion 310 is one example of a second columnar portion. The rotational shaft portion 310 is also one example of a second cylindrical portion.

As illustrated in FIG. 2, the rotational shaft portion 310 extends in the axial direction. Further, the rotational shaft portion 310 has a cylindrical shape that is centered on the second axis CL2. The rotational shaft portion 310 has a through-hole that extends in the axial direction. The through-hole of the rotational shaft portion 310 has a circular shape when viewed in the axial direction. An inner diameter of the through-hole formed in the rotational shaft portion 310 is smaller than an outer diameter of a cylindrical portion 380 described later. As illustrated in FIG. 2, the boss 155 extending in the axial direction is inserted through the through-hole formed in the rotational shaft portion 310. Accordingly, the detection gear 300 is rotatably supported on the boss 155. The rotational shaft portion 310 is rotatable about the second axis CL2.

As illustrated in FIG. 2, the boss 155 is provided at a cap 150. The cap 150 is a separate member from the casing 100. The casing 100 has a fill hole 84A. Specifically, the fill hole 84A is formed in a first outer surface 100A of the casing 100. The fill hole 84A is a hole provided for filling a toner-accommodating portion 84 (described later) with toner. The cap 150 is a cover for closing the fill hole 84A. The first outer surface 100A is one example of an outer surface.

In the present embodiment, the boss 155 is provided at the cap 150. However, the fill hole 84A need not be formed in the first outer surface 100A, and the cap 150 need not be positioned at the first outer surface 100A. In this case, the boss 155 may extend in the axial direction from the first outer surface 100A.

As illustrated in FIG. 2, the casing 100 includes the first outer surface 100A. A gear train including the detection gear 300 is positioned at the first outer surface 100A. The casing 100 also includes a second outer surface that is separated from the first outer surface 100A in the axial direction. The input gear 110, the developing roller gear 120, the supply roller gear 130, the idle gear 140, the detection gear 300, and the transmission gear 400 are positioned at the first outer surface 100A. The input gear 110, the developing roller gear 120, the supply roller gear 130, the idle gear 140, the detection gear 300, and the transmission gear 400 are rotatably positioned at the first outer surface 100A. The transmission gear 400 is one example of a first gear. The detection gear 300 is one example of a second gear.

As illustrated in FIGS. 1 and 2, the input gear 110 has a coupling 101. The input gear 110 is rotatable together with the coupling 101. The coupling 101 is integrated with the input gear 110. The input gear 110 includes a plurality of gear teeth. The plurality of gear teeth of the input gear 110 are provided along a circumferential surface of the input gear 110. The coupling 101 is rotatable together with the input gear 110 when receiving a drive force from a motor (not illustrated) provided in an image forming apparatus (not illustrated). The coupling 101 includes a cylindrical portion 102, and a pair of protrusions 103. The cylindrical portion 102 has a cylindrical shape that extends in the axial direction. The pair of protrusions 103 protrudes inward from an inner circumferential surface of the cylindrical portion 102 in a radial direction of the cylindrical portion 102. The pair of protrusions 103 can engage with an apparatus-side coupling (not illustrated) provided in the image forming apparatus.

The developing roller 81 includes a shaft 81A. The developing roller gear 120 is supported by the shaft 81A of the developing roller 81. The developing roller gear 120 is rotatable together with the shaft 81A. The developing roller gear 120 includes a plurality of gear teeth. The plurality of gear teeth of the developing roller gear 120 are provided along a circumferential surface of the developing roller gear 120. At least one of the gear teeth provided at the developing roller gear 120 meshes with at least one of the gear teeth provided at the input gear 110. Therefore, the developing roller gear 120 is rotatable in accordance with rotation of the input gear 110.

The supply roller 83 includes a shaft 83A. The supply roller gear 130 is supported by the shaft 83A of the supply roller 83. The supply roller gear 130 is rotatable together with the shaft 83A. The supply roller gear 130 includes a plurality of gear teeth. The plurality of gear teeth of the supply roller gear 130 are provided along a circumferential surface of the supply roller gear 130. At least one of the gear teeth provided at the supply roller gear 130 meshes with at least one of the gear teeth provided at the input gear 110. Therefore, the supply roller gear 130 is rotatable in accordance with rotation of the input gear 110.

The idle gear 140 includes a large-diameter gear portion 140A, and a small-diameter gear portion 140B. The large-diameter gear portion 140A is positioned separated farther than the small-diameter gear portion 140B from the first outer surface 100A in the axial direction. The small-diameter gear portion 140B includes a plurality of gear teeth. The plurality of gear teeth of the small-diameter gear portion 140B are provided along a circumferential surface of the small-diameter gear portion 140B. The large-diameter gear portion 140A includes a plurality of gear teeth. The plurality of gear teeth of the large-diameter gear portion 140A are provided along a circumferential surface of the large-diameter gear portion 140A. At least one of the gear teeth provided at the large-diameter gear portion 140A meshes with at least one of the gear teeth provided at the input gear 110. Therefore, the idle gear 140 is rotatable in accordance with rotation of the input gear 110. An addendum circle of the large-diameter gear portion 140A has a diameter greater than that of an addendum circle of the small-diameter gear portion 140B.

The transmission gear 400 includes a large-diameter gear portion 440, and a small-diameter gear portion 450. The large-diameter gear portion 440 is one example of a large-diameter gear. The small-diameter gear portion 450 is one example of a small-diameter gear. The small-diameter gear portion 450 is positioned separated farther than the large-diameter gear portion 440 from the first outer surface 100A in the axial direction. The small-diameter gear portion 450 includes a plurality of gear teeth. The plurality of gear teeth of the small-diameter gear portion 450 are provided along a circumferential surface of the small-diameter gear portion 450. The large-diameter gear portion 440 includes a plurality of gear teeth. The plurality of gear teeth of the large-diameter gear portion 440 are provided along a circumferential surface of the large-diameter gear portion 440. At least one of the gear teeth provided at the large-diameter gear portion 440 meshes with at least one of the gear teeth provided at the small-diameter gear portion 140B. Therefore, the transmission gear 400 is rotatable in accordance with rotation of the idle gear 140. As illustrated in FIG. 2, the transmission gear 400 is mounted to a shaft 85A of the agitator 85. The transmission gear 400 is rotatable together with the agitator 85. A distance in the axial direction between the first outer surface 100A and the small-diameter gear portion 450 is greater than a distance in the axial direction between the first outer surface 100A and the large-diameter gear portion 440. An addendum circle of the large-diameter gear portion 440 has a diameter greater than that of an addendum circle of the small-diameter gear portion 450.

Figure 6A:
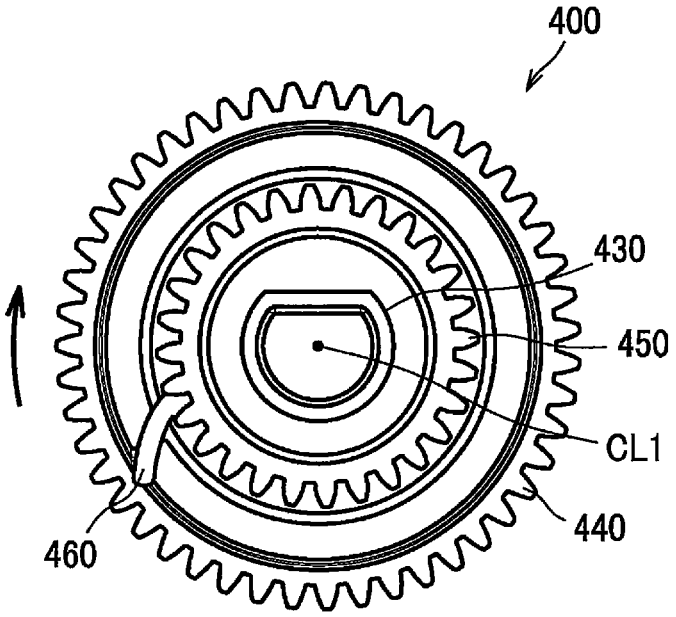
FIG. 6A is a left side view of a transmission gear 400.
Figure 6B:
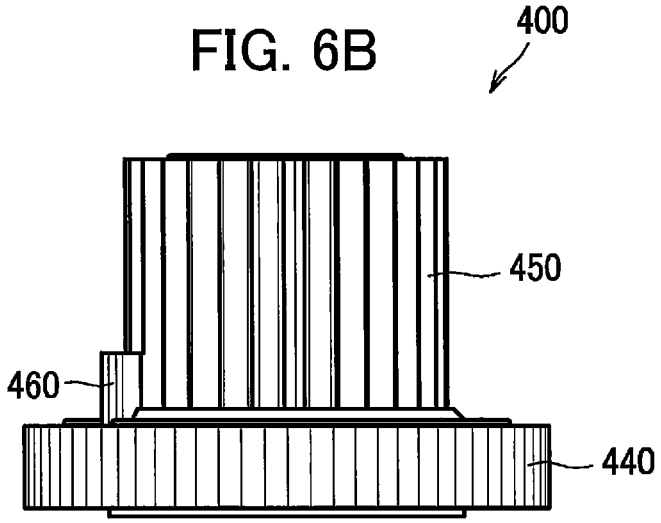
FIG. 6B is a top plan view of the transmission gear 400.

Next, the structure of the transmission gear 400 will be described with reference to FIGS. 3B, 6A, and 6B. The large-diameter gear portion 440 is rotatable about a first axis CL1 illustrated in FIG. 3B together with the small-diameter gear portion 450. As illustrated in FIGS. 6A and 6B, the transmission gear 400 also includes a rotational shaft portion 430 and a first rib 460 in addition to the large-diameter gear portion 440 and the small-diameter gear portion 450. The rotational shaft portion 430, the large-diameter gear portion 440, the small-diameter gear portion 450, and the first rib 460 are an integrated component. The rotational shaft portion 430 has a cylindrical shape that is centered on the first axis CL1. In other words, the rotational shaft portion 430 has a cylindrical shape that extends in the axial direction. Note that the rotational shaft portion 430 may have a columnar shape that extends in the axial direction.

The first rib 460 extends outward from the small-diameter gear portion 450 in a radial direction of the small-diameter gear portion 450. Specifically, the first rib 460 extends outward from the small-diameter gear portion 450 in the radial direction of the small-diameter gear portion 450 at a position between one prescribed gear tooth on the small-diameter gear portion 450 and a gear tooth neighboring the prescribed gear tooth. The first rib 460 has a plate shape. A distal end of the first rib 460 is separated from the addendum circle of the small-diameter gear portion 450 in the radial direction of the small-diameter gear portion 450. The distal end of the first rib 460 is positioned between the addendum circle of the small-diameter gear portion 450 and the addendum circle of the large-diameter gear portion 440 in the radial direction of the small-diameter gear portion 450.

Figure 14A:
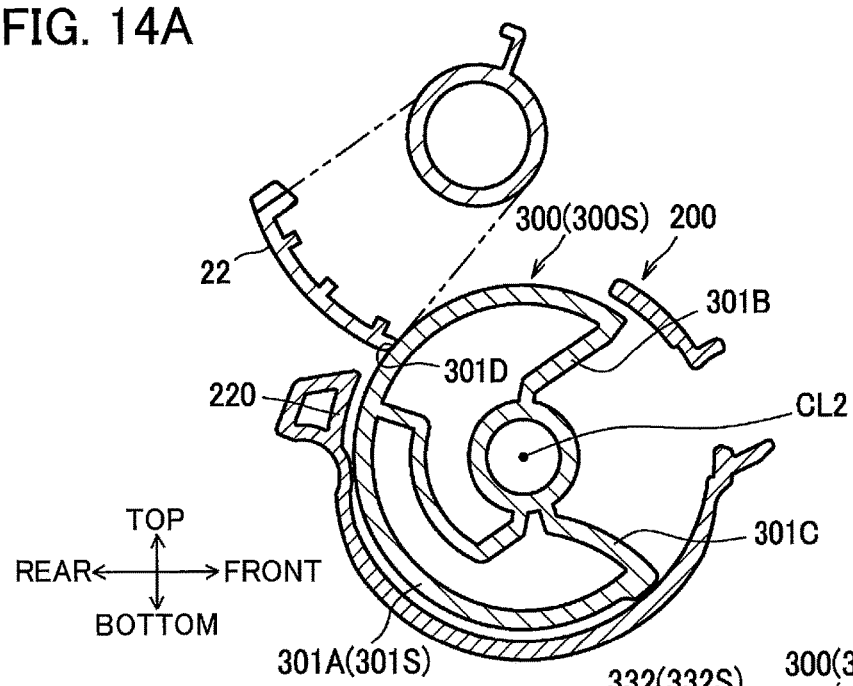
Figure 14B:
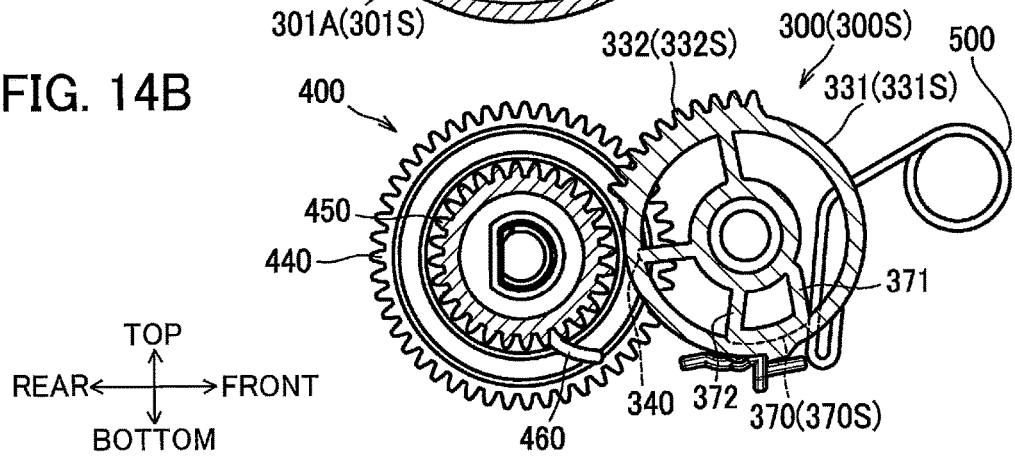
Figure 14C:
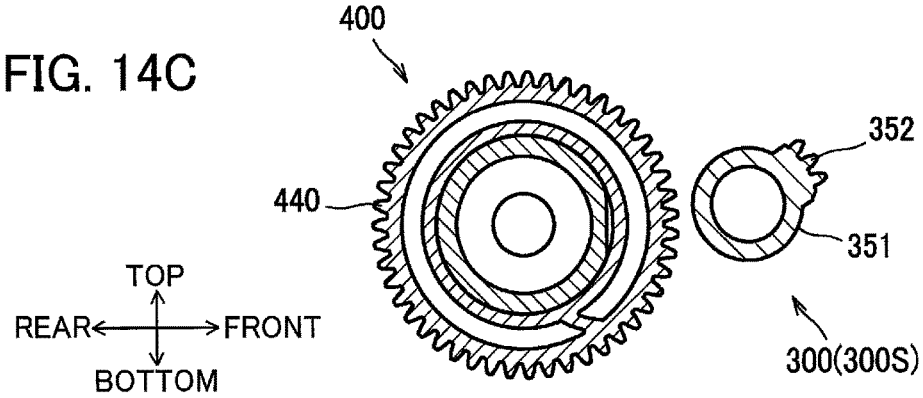
Figure 20A:
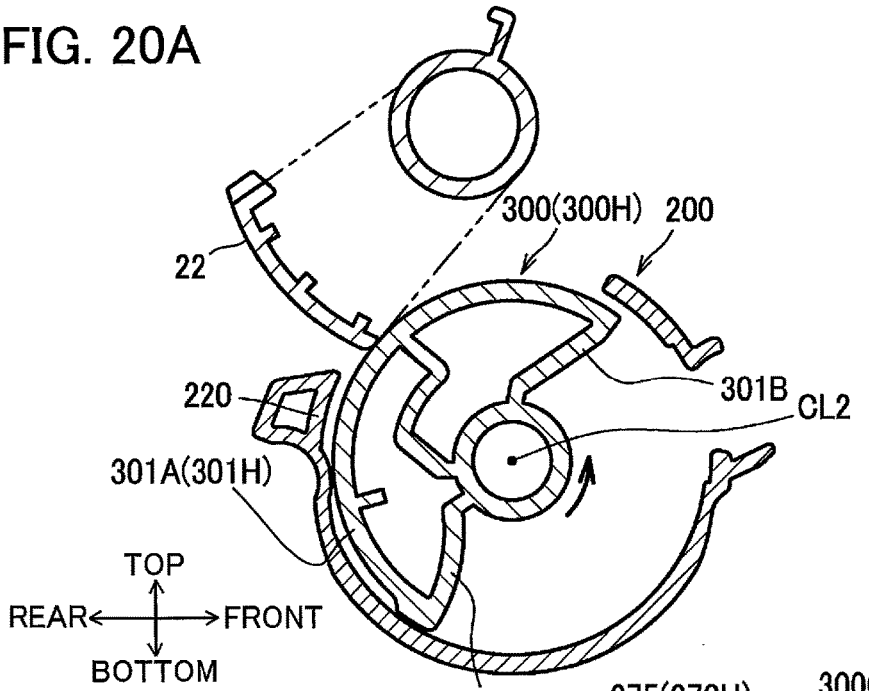
Figure 20B:
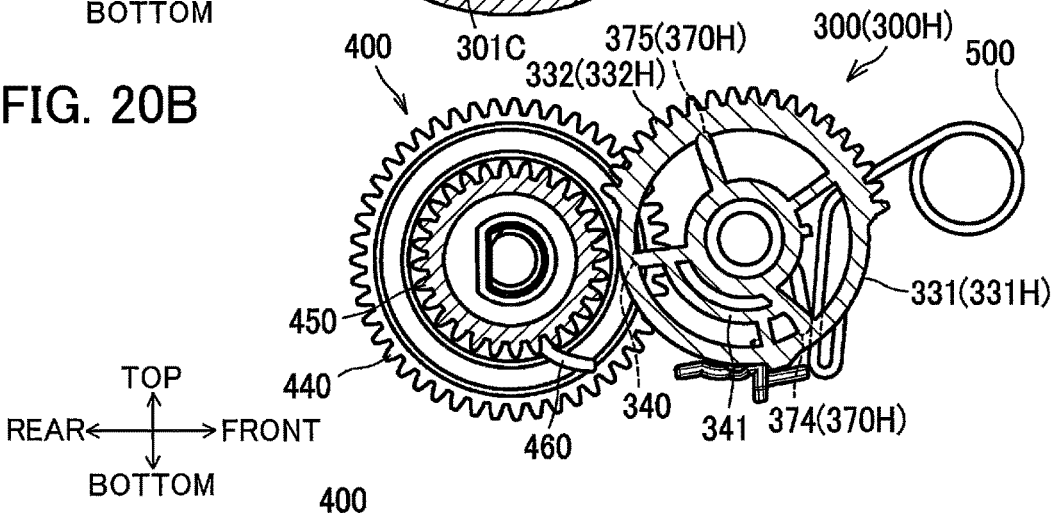
Figure 20C:
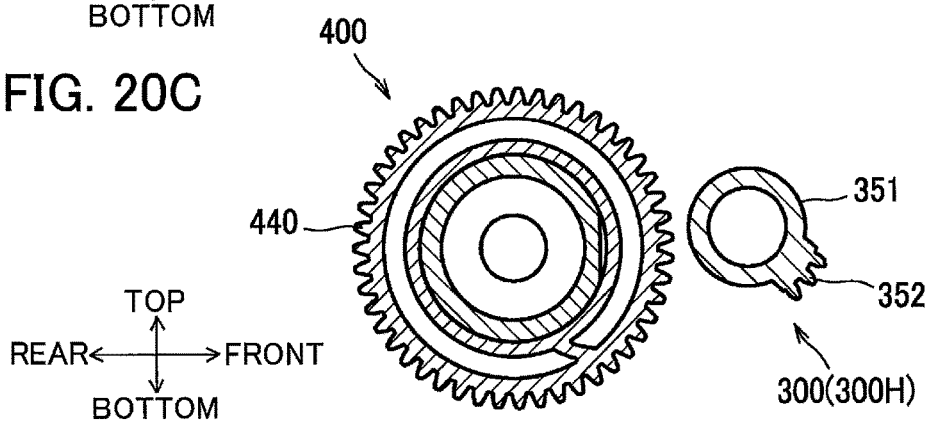

As will be described later in detail, the first rib 460 is in contact with a second rib 340 of the detection gear 300 and rotates the detection gear 300, after which a first gear portion 332 engages with the small-diameter gear portion 450, as illustrated in FIGS. 14B, 15B, 20B, and 21B. Specifically, after the first rib 460 is in contact with the second rib 340 of the detection gear 300 and rotates the detection gear 300, the first gear portion 332 becomes meshed with the small-diameter gear portion 450. Thus, when the detection gear 300 is at an initial position illustrated in FIG. 14B, the second rib 340 is positioned within a locus defined by the first rib 460 rotating about the first axis CL1. Specifically, in the initial position illustrated in FIGS. 14B and 20B, the first rib 460 is positioned separated downstream in a rotational direction of the transmission gear 400 from the second rib 340. Further, as illustrated in FIGS. 14B and 20B, the small-diameter gear portion 450 is not engaged with the first gear portion 332 in the initial position. Specifically, the small-diameter gear portion 450 does not mesh with the first gear portion 332 in the initial position. As illustrated in FIGS. 14C and 20C, the large-diameter gear portion 440 is also not engaged with a second gear portion 352 in the initial position. Specifically, the large-diameter gear portion 440 does not mesh with the second gear portion 352 in the initial position.

After the first rib 460 is in contact with the second rib 340 of the detection gear 300 and rotates the detection gear 300, the first gear portion 332 becomes engaged with the small-diameter gear portion 450, and the detection gear 300 rotates. Specifically, after the first rib 460 is in contact with the second rib 340 of the detection gear 300 and rotates the detection gear 300, the first gear portion 332 and the small-diameter gear portion 450 become meshed with each other, rotating the detection gear 300.

Once the detection gear 300 has rotated a prescribed angle, the first gear portion 332 disengages from the small-diameter gear portion 450. After the first gear portion 332 becomes disengaged from the small-diameter gear portion 450, the large-diameter gear portion 440 becomes engaged with the second gear portion 352, further rotating the detection gear 300. Once the detection gear 300 has rotated a prescribed angle, the large-diameter gear portion 440 becomes disengaged from the second gear portion 352, and rotation of the detection gear 300 stops.

More specifically, the first gear portion 332 becomes unmeshed from the small-diameter gear portion 450 after the detection gear 300 has rotated the prescribed angle. Once the first gear portion 332 has become unmeshed from the small-diameter gear portion 450, the large-diameter gear portion 440 becomes meshed with the second gear portion 352, and the detection gear 300 rotates further. Once the detection gear 300 has rotated a prescribed angle, the large-diameter gear portion 440 becomes unmeshed from the second gear portion 352, and rotation of the detection gear 300 stops, leaving the detection gear 300 in its final position.

Note that the toner-accommodating portion 84, the agitator 85, and the supply roller 83 are provided inside the casing 100. The toner-accommodating portion 84 is configured to accommodate developer. The developer is toner, for example. The agitator 85 is configured to agitate developer in the toner-accommodating portion 84. The supply roller 83 is a roller that can supply developer to the developing roller 81.

[Detailed Structure of Standard-Type Detection Gear 300S]

Next, the detailed structure of a standard-type detection gear 300S will be described with reference to FIGS. 3A, 3B, 4A, 4B, 4C, and 26A. Note that the gears 110, 120, 130, 140, 300 and 400 have been illustrated in a simplified manner in FIG. 3B. As described above, the standard-type detection gear 300S is provided at a standard-type developing cartridge. A standard-type developing cartridge is a cartridge that has a smaller capacity for accommodating toner than a high-capacity-type developing cartridge.

Figure 3A:
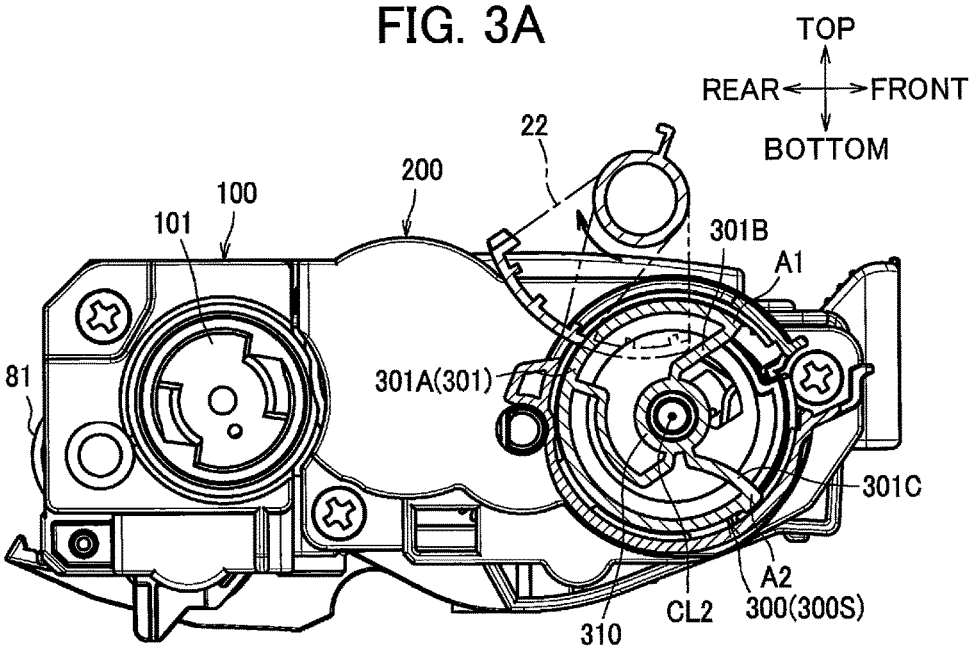
FIG. 3A is an explanatory diagram for a cross-sectional view of the developing cartridge 8 taken along a line AA in FIG. 1.
Figure 3B:
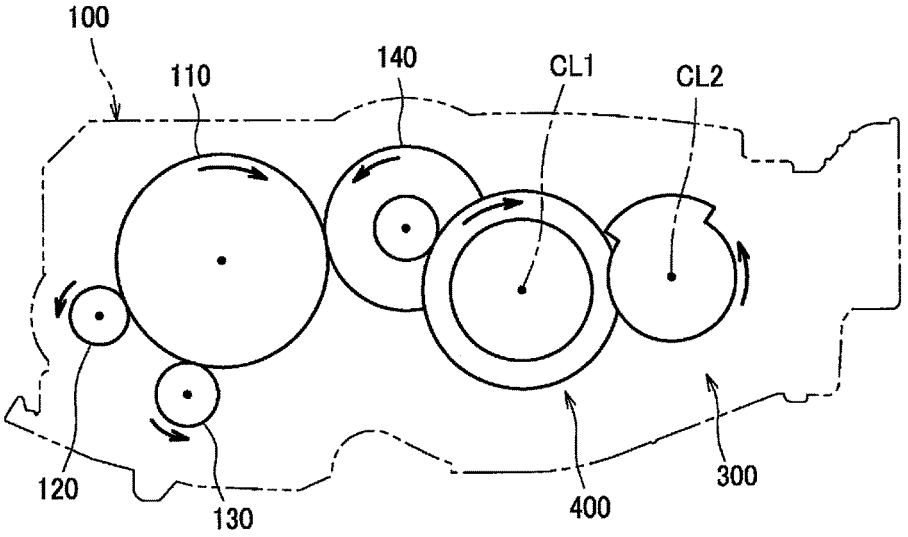
FIG. 3B is an explanatory diagram of a gear mechanism provided in the developing cartridge 8.

More specifically, a protrusion 301S of the standard-type detection gear 300S includes an outer circumferential surface 301A, as illustrated in FIG. 3A. The outer circumferential surface 301A extends along a portion of a circumference of the standard-type detection gear 300S. In other words, the outer circumferential surface 301A has an arcuate shape centered on the second axis CL2. The outer circumferential surface 301A is positioned separated from the rotational shaft portion 310 in a radial direction of the standard-type detection gear 300S.

Further, the protrusion 301S includes a first extension wall 301B, and a second extension wall 301C, as illustrated in FIG. 3A. The outer circumferential surface 301A includes a first end portion A1, and a second end portion A2. The first end portion A1 is one end portion of the outer circumferential surface 301A in a rotating direction of the standard-type detection gear 300S. The second end portion A2 is the other end portion of the outer circumferential surface 301A separated from the first end portion A1 in the rotating direction of the standard-type detection gear 300S. The first extension wall 301B extends inward from the first end portion A1 in the radial direction of the standard-type detection gear 300S. Moreover, the first extension wall 301B extends from the first end portion A1 toward the rotational shaft portion 310 and is connected to the rotational shaft portion 310. The second extension wall 301C extends inward from the second end portion A2 in the radial direction of the standard-type detection gear 300S. Moreover, the second extension wall 301C extends from the second end portion A2 toward the rotational shaft portion 310 and is connected to the rotational shaft portion 310.

The second extension wall 301C curves in a direction away from the outer circumferential surface 301A while extending from the second end portion A2 toward the rotational shaft portion 310. The second extension wall 301C is one example of an extension portion.

As illustrated in FIGS. 4A through 4C and FIG. 26A, the standard-type detection gear 300S further includes a flange portion 320, the first gear portion 332, the second gear portion 352, and the cylindrical portion 380.

The second gear portion 352 is positioned at the other end portion (i.e. right end portion) of the rotational shaft portion 310. More specifically, the second gear portion 352 includes a plurality of gear teeth. The second gear portion 352 is provided along a portion of a circumferential surface of the rotational shaft portion 310 in the rotating direction of the standard-type detection gear 300S. The plurality of gear teeth of the second engaging portion 352 are thus provided along the portion of the circumferential surface of the second columnar portion 310 in the rotating direction of the standard-type detection gear 300S. Each of the plurality of gear teeth provided at the second gear portion 352 protrudes outward from the circumferential surface of the rotational shaft portion 310 in the radial direction of the rotational shaft portion 310. The circumferential surface of the rotational shaft portion 310 excluding the second gear portion 352 in the rotating direction of the standard-type detection gear 300S is a second toothless portion 351. The second toothless portion 351 is a region in which no gear teeth are provided. The second gear portion 352 is one example of a second engaging portion. The second gear portion 352 illustrated in FIGS. 4A through 4C includes three gear teeth.

A first gear portion 332S is positioned between the protrusion 301S and the second gear portion 352 in the axial direction. More specifically, the standard-type detection gear 300S further includes the cylindrical portion 380. The cylindrical portion 380 has a cylindrical shape that extends in the axial direction. The cylindrical portion 380 is positioned between the protrusion 301S and the second gear portion 352 in the axial direction. The cylindrical portion 380 has a cylindrical shape that is centered on the second axis CL2. An outer diameter of the cylindrical portion 380 is greater than an outer diameter of the rotational shaft portion 310. The first gear portion 332S is provided at a circumferential surface of the cylindrical portion 380. More specifically, the first gear portion 332S includes a plurality of gear teeth. The plurality of gear teeth of the first gear portion 332S are provided along a portion of the circumferential surface of the cylindrical portion 380. Each of the plurality of gear teeth provided at the first gear portion 332S protrudes outward from the circumferential surface of the cylindrical portion 380 in a radial direction of the cylindrical portion 380. Further, the circumferential surface of the cylindrical portion 380 excluding the first gear portion 332S in the rotating direction of the standard-type detection gear 300S is a first toothless portion 331. A first toothless portion 331S is a region in which no gear teeth are provided. The outer diameter of the cylindrical portion 380 is greater than the outer diameter of the rotational shaft portion 310. The first gear portion 332S is provided at a different position from the second gear portion 352 in the rotating direction of the standard-type detection gear 300S. More specifically, the second gear portion 352 is separated a prescribed distance from the first gear portion 332S in the rotating direction of the standard-type detection gear 300S, as illustrated in FIGS. 4B and 4C. That is, the second gear portion 352 is spaced apart from the first gear portion 332S. Note that an addendum circle of the first gear portion 332S has a diameter greater than that of an addendum circle of the second gear portion 352. In the present embodiment, a distance from the second axis CL2 to tips of the gear teeth provided at the first gear portion 332S is 11.5 mm, while a distance from the second axis CL2 to tips of the gear teeth provided at the second gear portion 352 is 6.7 mm. Further, the first gear portion 332S is separated farther than the second gear portion 352 from the second axis CL2 in the radial direction of the standard-type detection gear 300S. The first gear portion 332S is engageable with the small-diameter gear portion 450 of the transmission gear 400 described later. The cylindrical portion 380 is only required to have a columnar shape that extends in the axial direction. The first gear portion 332 is one example of a first engaging portion. The cylindrical portion 380 is one example of a first columnar portion. The cylindrical portion 380 is also one example of s first cylindrical portion.

As illustrated in FIG. 4C, the first gear portion 332S includes a third end 332A, and a fourth end 332B that is separated from the third end 332A in the rotating direction of the standard-type detection gear 300S. The third end 332A is one end of the first gear portion 332S in a rotating direction of the first gear portion 332S, and the fourth end 332B is the other end of the first gear portion 332S that is separated from the third end 332A in the rotating direction of the first gear portion 332S. The number of the plurality of gear teeth provided at the first gear portion 332 differs between the high-capacity-type developing cartridge 8H and a standard-type developing cartridge 8S. In the standard-type detection gear 300S illustrated in FIGS. 4A through 4C, the first gear portion 332S includes ten gear teeth. In the standard-type detection gear 300S, an angle θ4 between a line segment L4 connecting the fourth end 332B and the second axis CL2 and a line segment L5 connecting the third end 332A and the second axis CL2 may be in the range from 73° to 78°. In other words, the angle θ4 may be not smaller than 73° and not greater than 78°. In the present embodiment, the angle θ4 is 74°. In the present embodiment, the number of the plurality of gear teeth provided at the first gear portion 332S is greater than the number of the plurality of gear teeth provided at the second gear portion 352.

A locus defined by the rotating tips of the gear teeth of the second gear portion 352 is smaller than a locus defined by the rotating tips of the gear teeth of the first gear portion 332S. In other words, an addendum circle of the gear teeth of the second gear portion 352 has a diameter smaller than a diameter of an addendum circle of the gear teeth of the first gear portion 332S. As illustrated in FIG. 2, the second gear portion 352 is positioned closer than the first gear portion 332S to the first outer surface 100A in the axial direction, and is engageable with the large-diameter gear portion 440 of the transmission gear 400. The second gear portion 352 is engageable with the large-diameter gear portion 440 after the first gear portion 332S has engaged with the small-diameter gear portion 450. More specifically, the first gear portion 332S engages with the small-diameter gear portion 450, and subsequently, the first gear portion 332S disengages from the small-diameter gear portion 450. After the first gear portion 332S has disengaged from the small-diameter gear portion 450, the second gear portion 352 engages with the large-diameter gear portion 440.

As illustrated in FIG. 4C, the second gear portion 352 includes a fifth end 352A, and a sixth end 352B that is separated from the fifth end 352A in the rotating direction of the standard-type detection gear 300S. The fifth end 352A is one end of the second gear portion 352 in a rotating direction of the second gear portion 352, and the sixth end 352B is the other end of the second gear portion 352 that is separated from the fifth end 352A in the rotating direction of the second gear portion 352. The fifth end 352A is positioned closer than the sixth end 352B to the fourth end 332B in the rotating direction.

The structure of the second gear portion 352 and the positional relationship between the second gear portion 352 and the first gear portion 332 is identical for both the standard-type detection gear 300S and the high-capacity-type detection gear 300H. Thus, the high-capacity-type detection gear 300H illustrated in FIG. 5C will be described in the following description. Specifically, as illustrated in FIG. 5C, an angle θ3 between the line segment L4 connecting the fourth end 332B and the second axis CL2 and a line segment L3 connecting the fifth end 352A and the second axis CL2 may be in the range from 35° to 41°. In other words, the angle θ3 may be not smaller than 35° and not greater than 41°. Further, an angle θ6 between the line segment L3 connecting the fifth end 352A and the second axis CL2 and a line segment L6 connecting the sixth end 352B and the second axis CL2 may be in the range from 28° to 32°. In other words, the angle θ6 may be not smaller than 28° and not greater than 32°. In the present embodiment, θ3 is 38° and θ6 is 29°.

Figure 4A:
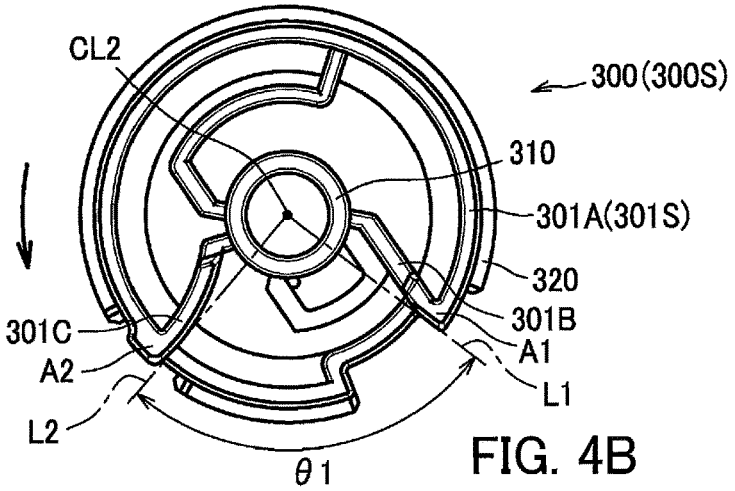
FIG. 4A is a left side view of a standard-type detection gear 300S.
Figure 4B:
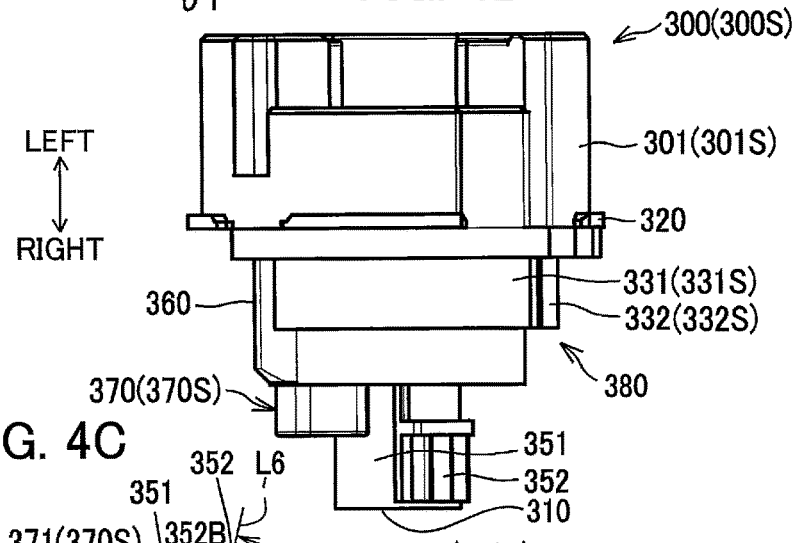
FIG. 4B is a top plan view of the standard-type detection gear 300S.
Figure 4C:
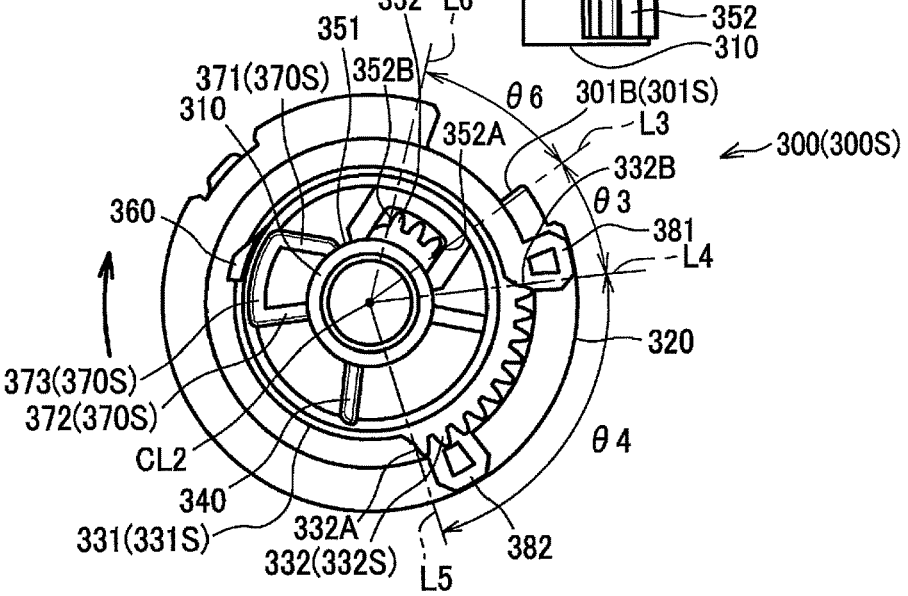
FIG. 4C is a right side view of the standard-type detection gear 300S.

As illustrated in FIGS. 4A through 4C, the flange portion 320 has a disc shape. The flange portion 320 extends outward in the radial direction of the standard-type detection gear 300S. The flange portion 320 is rotatable about the second axis CL2. The flange portion 320 is positioned separated farther than the first gear portion 332S from the first outer surface 100A in the axial direction. The flange portion 320 is also positioned separated farther than the second gear portion 352 from the first outer surface 100A in the axial direction. In other words, a distance in the axial direction between the first outer surface 100A and the first gear portion 332S is greater than a distance in the axial direction between the first outer surface 100A and the second gear portion 352. Further, a distance in the axial direction between the first outer surface 100A and the flange portion 320 is greater than the distance in the axial direction between the first outer surface 100A and the first gear portion 332S.

The flange portion 320 includes a first surface facing the first outer surface 100A, and a second surface opposite to the first surface in the axial direction. The protrusion 301S is positioned at the second surface of the flange portion 320. The protrusion 301S protrudes from the second surface of the flange portion 320. Specifically, the protrusion 301S protrudes in the axial direction and in a direction away from the first outer surface 100A. Note that the protrusion 301S is rotatable together with the first gear portion 332S and the second gear portion 352. The cylindrical portion 380 extends toward the first outer surface 100A from the first surface of the flange portion 320. A portion of the rotational shaft portion 310 in the axial direction is positioned inside the cylindrical portion 380. In other words, the cylindrical portion 380 is provided along an outer circumferential surface of a portion of the rotational shaft portion 310 and surrounds the outer circumferential surface of the part of the rotational shaft portion 310. The boss 155 is inserted into the other end portion of the rotational shaft portion 310 not surrounded by the cylindrical portion 380. Hence, the other end portion of the rotational shaft portion 310 into which the boss 155 is inserted is positioned on the opposite side of the cylindrical portion 380 from the protrusion 301S in the axial direction. Thus, the other end portion of the rotational shaft portion 310 is positioned on the opposite side of the cylindrical portion 380 in the axial direction from the outer circumferential surface 301A of the protrusion 301S. The flange portion 320 is one example of a flange.

As illustrated in FIG. 4C, the standard-type detection gear 300S further includes a first protrusion 381 and a second protrusion 382. The first protrusion 381 and the second protrusion 382 are positioned between the first gear portion 332S and the flange portion 320 in the axial direction. The first protrusion 381 protrudes farther outward in the radial direction of the cylindrical portion 380 than the tips of the plurality of gear teeth of the first gear portion 332S. The second protrusion 382 also protrudes farther outward in the radial direction of the cylindrical portion 380 than the tips of the plurality of gear teeth of the first gear portion 332S. Note that the high-capacity-type detection gear 300H for the high-capacity-type developing cartridge 8H includes only the first protrusion 381, as illustrated in FIG. 5C.

Figure 26A:
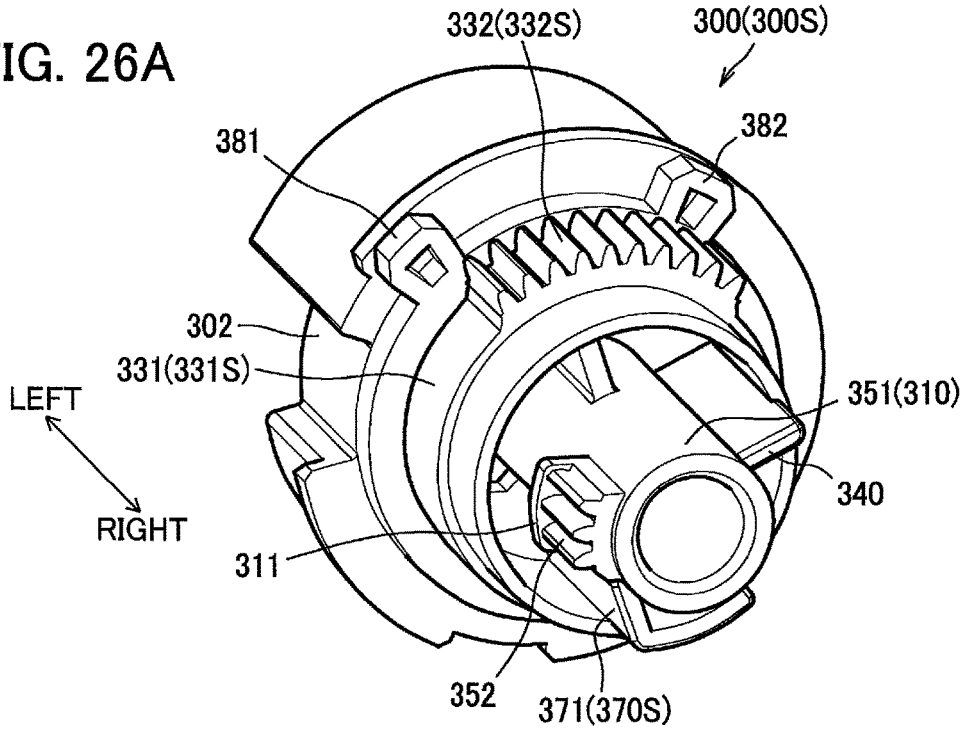
FIG. 26A is a perspective view illustrating the standard-type detection gear 300S.

As illustrated in FIG. 26A, the rotational shaft portion 310 of the standard-type detection gear 300S includes a rib 311. The rib 311 protrudes from the circumferential surface of the rotational shaft portion 310. Each of the plurality of gear teeth provided at the second gear portion 352 extends from the rib 311 in the axial direction.

As illustrated in FIGS. 4A through 4C and FIG. 26A, the standard-type detection gear 300S further includes the second rib 340, a first restriction portion 360, and a spring-engaging portion 370.

Figure 7A:
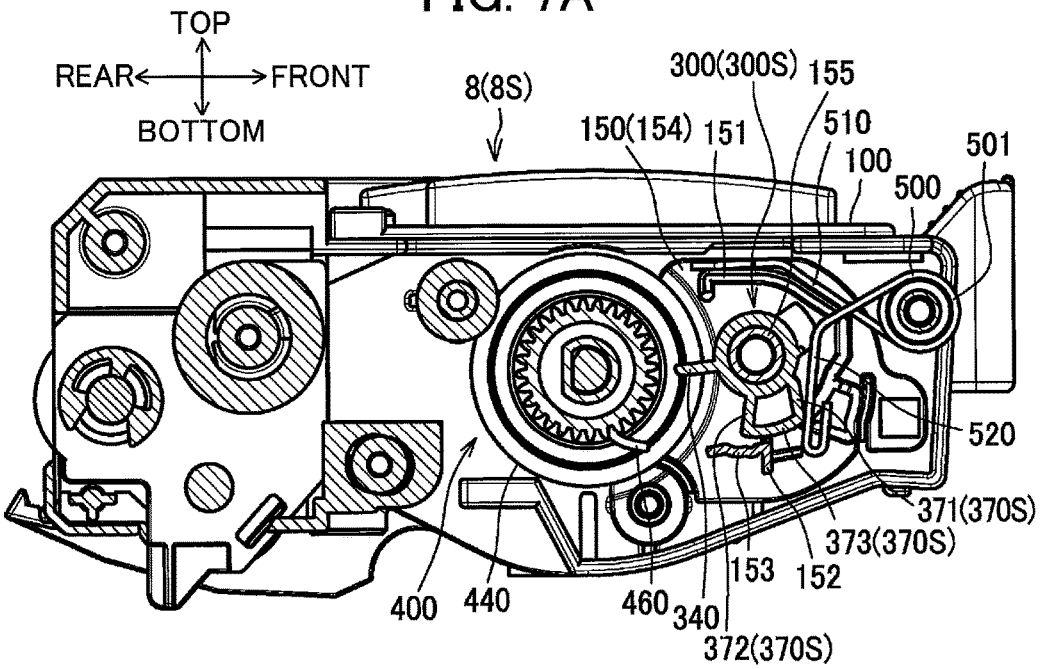
FIG. 7A is an explanatory diagram for a spring-engaging portion 370S of the standard-type detection gear 300S and a torsion spring 500 in relation to a cross section of the developing cartridge 8 taken along a line FF in FIG. 1.
Figure 7B:
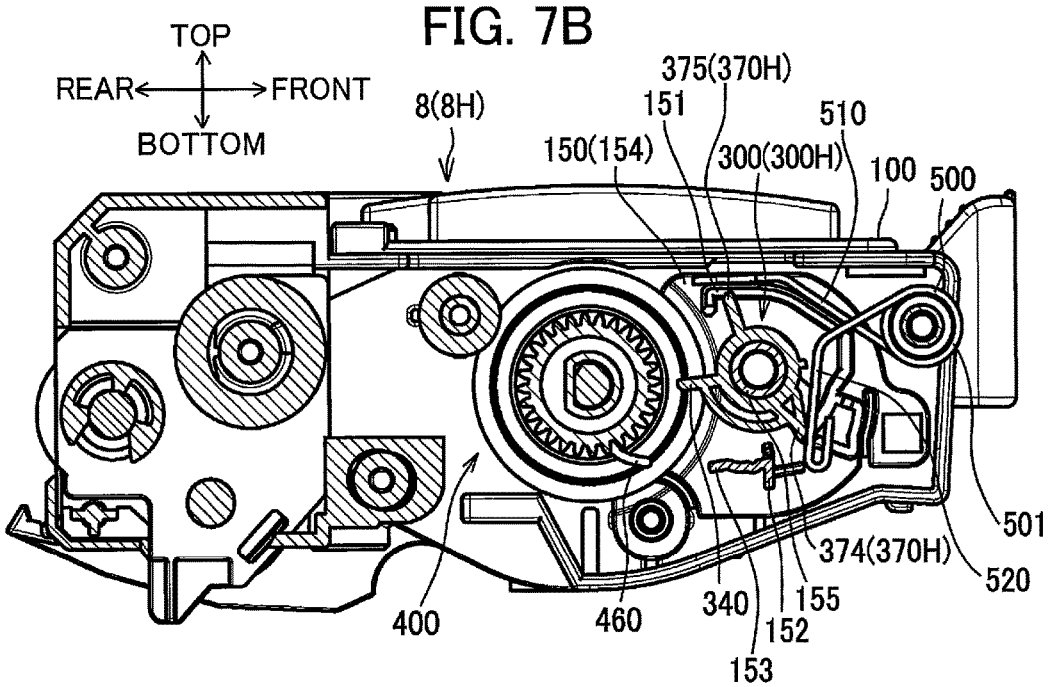
FIG. 7B is an explanatory diagram for a spring-engaging portion 370H of the high-capacity-type detection gear 300H and the torsion spring 500 in relation to the cross section of the developing cartridge 8 taken along the line FF in FIG. 1.

A spring-engaging portion 370S illustrated in FIG. 4B can be in contact with a torsion spring 500 illustrated in FIG. 7A. The spring-engaging portion 370S is positioned between the first gear portion 332S and the second gear portion 352 in the axial direction. As illustrated in FIG. 4C, the spring-engaging portion 370S is a protrusion that protrudes outward from the rotational shaft portion 310 in the radial direction of the rotational shaft portion 310. A length of the protrusion (i.e. length of the spring-engaging portion 370S) in the rotating direction of the standard-type detection gear 300S is greater than a length of the second gear portion 352 in the rotating direction of the standard-type detection gear 300S. Further, the length of the protrusion (i.e. length of the spring-engaging portion 370S) in the rotating direction of the standard-type detection gear 300S is greater than a length of the second rib 340 in the rotating direction of the standard-type detection gear 300S. The spring-engaging portion 370S is positioned at the opposite side of the first gear portion 332S from the second axis CL2 and is positioned between the second gear portion 352 and the second rib 340 in the rotating direction of the standard-type detection gear 300S.

More specifically, the spring-engaging portion 370S includes a third rib 371, a fourth rib 372, and a connecting rib 373. The third rib 371 protrudes outward from the outer circumferential surface of the rotational shaft portion 310 in the radial direction of the rotational shaft portion 310. The fourth rib 372 protrudes outward from the outer circumferential surface of the rotational shaft portion 310 in the radial direction of the rotational shaft portion 310. The fourth rib 372 is provided at a different position from the third rib 371 in the rotating direction of the standard-type detection gear 300S. The connecting rib 373 connects a distal end of the third rib 371 in the radial direction of the rotational shaft portion 310 to a distal end of the fourth rib 372 in the radial direction of the rotational shaft portion 310. The connecting rib 373 has an arcuate shape centered on the second axis CL2.

The second rib 340 is positioned between the first gear portion 332S and the second gear portion 352 in the axial direction. The second rib 340 is positioned at the opposite side of the second axis CL2 from the second gear portion 352. The second rib 340 is positioned at the outer circumferential surface of the rotational shaft portion 310. The second rib 340 extends outward from the outer circumferential surface of the rotational shaft portion 310 in the radial direction of the rotational shaft portion 310. Specifically, the second rib 340 has a plate shape that extends outward from the rotational shaft portion 310 in the radial direction of the rotational shaft portion 310. A distal end of the second rib 340 is positioned between a circumferential surface of the first toothless portion 331S and the second gear portion 352 in the radial direction of the rotational shaft portion 310. Specifically, a distance between the distal end of the second rib 340 in the radial direction of the rotational shaft portion 310 and the second axis CL2 is approximately equal to a distance between the outer circumferential surface of the spring-engaging portion 370S and the second axis CL2.

As illustrated in FIG. 4B, the first restriction portion 360 is a protrusion that protrudes from the circumferential surface of the cylindrical portion 380. A distal end of the first restriction portion 360 in the axial direction is positioned between the spring-engaging portion 370S and the flange portion 320. As illustrated in FIG. 4C, the first restriction portion 360 is positioned at the opposite side of the second axis CL2 from the first gear portion 332S and is also positioned between the second gear portion 352 and the second rib 340 in the rotating direction of the standard-type detection gear 300S. The first restriction portion 360 includes one end portion, and the other end portion that is separated from the one end portion in the rotating direction of the standard-type detection gear 300S. The one end portion of the first restriction portion 360 is positioned closer than the other end portion of the first restriction portion 360 to the second gear part 352 in the rotating direction of the standard-type detection gear 300S. A surface of the other end portion of the first restriction portion 360 is in a plane perpendicular to the rotating direction of the standard-type detection gear 300S, while a surface of the one end portion of the first restriction portion 360 is a sloped surface that slopes inward in the radial direction of the standard-type detection gear 300S.

The protrusion 301, the rotational shaft portion 310, the flange portion 320, the first gear portion 332S (the first gear portion 332), the second rib 340, the second gear portion 352, the first restriction portion 360, the spring-engaging part 370S (the spring-engaging portion 370), and the cylindrical portion 380 described above are configured as an integrated component.

[Method of Assembling Standard-Type Detection Gear 300S]

As illustrated in FIG. 7A, the standard-type developing cartridge 8S includes the torsion spring 500 and the cap 150. The torsion spring 500 is positioned at the first outer surface 100A. The cap 150 is positioned at the first outer surface 100A. The torsion spring 500 engages with the spring-engaging portion 370S. Note that gear teeth provided at the large-diameter gear portion 440 have been omitted in FIG. 7A and other drawings for the sake of convenience.

The torsion spring 500 is a torsion coil spring. As illustrated in FIG. 7A, the torsion spring 500 includes a coil portion 501, a first arm 510, and a second arm 520. As illustrated in FIG. 7A, a boss extending in the axial direction from the first outer surface 100A is inserted into the coil portion 501. In other words, the coil portion 501 is wound around the boss extending in the axial direction from the first outer surface 100A. The first arm 510 extends from the coil portion 501. A distal end portion of the first arm 510 is in contact with a spring support portion 151 of the cap 150 described later. The second arm 520 extends toward the rotational shaft portion 310 from the coil portion 501. A distal end portion of the second arm 520 contacts the spring-engaging portion 370S. The first arm 510 and the second arm 520 extend so as to cross each other.

In the initial position illustrated in FIG. 7A, the second arm 520 is in contact with the spring-engaging portion 370S. Accordingly, the torsion spring 500 urges the detection gear 300 toward the boss 155. That is, at the initial position illustrated in FIG. 7A, the torsion spring 500 urges the third rib 371 of the spring-engaging portion 370S in a direction opposite to the rotating direction of the standard-type detection gear 300S.

Figure 10A:
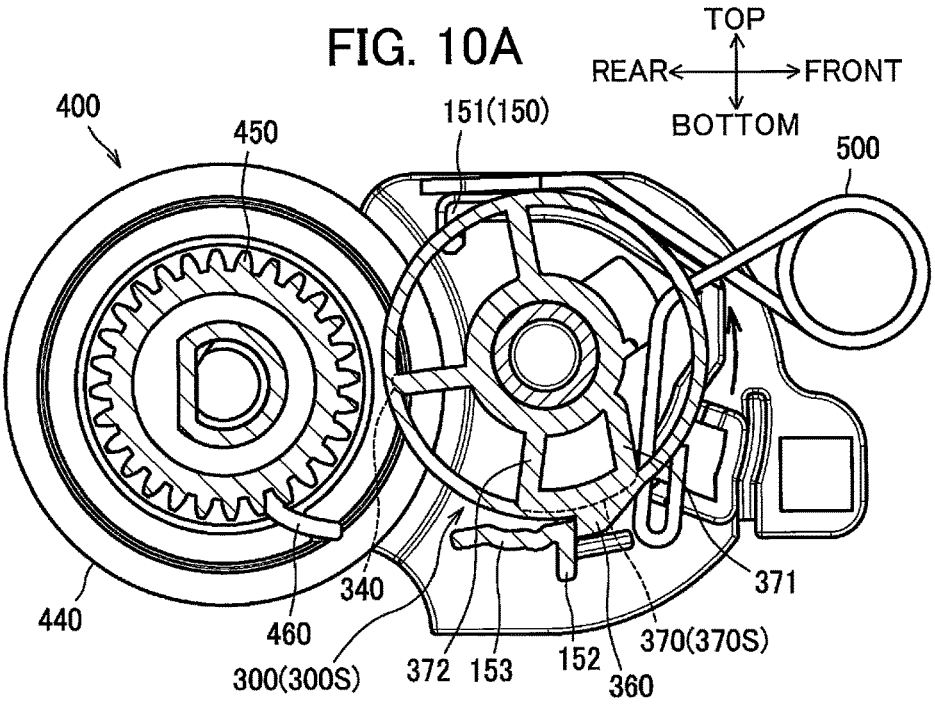
FIG. 10A is an explanatory diagram illustrating an initial position of the standard-type detection gear 300S in relation to the cross section of the developing cartridge 8 taken along the line DD in FIG. 1.

As illustrated in FIG. 7A, the cap 150 includes the spring support portion 151, a restricting portion 152, a holding portion 153, and a base 154. The spring support portion 151 supports the first arm 510. The restricting portion 152 restricts rotation of the standard-type detection gear 300S in a clockwise direction when the standard-type detection gear 300S is at the initial position. When inspecting the standard-type detection gear 300S, the holding portion 153 holds the standard-type detection gear 300S at a prescribed inspection position. The base 154 is plate shaped. As illustrated in FIG. 10A, the restricting portion 152 is in contact with the first restriction portion 360 of the standard-type detection gear 300S when the standard-type detection gear 300S is at the initial position. Specifically, with the second arm 520 urging the third rib 371 in the clockwise direction (a direction opposite to the rotating direction of the standard-type detection gear 300S), the first restriction portion 360 is urged toward the restricting portion 152. Accordingly, the restricting portion 152 restricts clockwise rotation of the standard-type detection gear 300S, thereby properly placing the standard-type detection gear 300S at the initial position.

The base 154 is positioned at the first outer surface 100A. The spring support portion 151 is a rib that protrudes in the axial direction from the base 154. The spring support portion 151 extends so as to conform to the shape of the first arm 510. The spring support portion 151 includes a first surface facing the rotational shaft portion 310, and a second surface on the side opposite to the first surface. The second surface of the spring support portion 151 is in contact with the first arm 510. The restricting portion 152 extends in the axial direction from the base 154. The holding portion 153 protrudes in the axial direction from the base 154. The holding portion 153 is a rib that extends in the axial direction. The holding portion 153 is arranged so as to face a circumferential surface of the standard-type detection gear 300S. At its center portion, the holding portion 153 bends in a direction away from the standard-type detection gear 300S. The restricting portion 152 and the holding portion 153 are positioned at the opposite side of the rotational shaft portion 310 from the spring support portion 151. The cap 150 also includes the boss 155. The boss 155 protrudes in the axial direction from the base 154. The boss 155 rotatably supports the rotational shaft portion 310 of the standard-type detection gear 300S. Specifically, the boss 155 is inserted into a through-hole formed in the rotational shaft portion 310. The boss 155 is thus positioned inside the rotational shaft portion 310 of the standard-type detection gear 300S.

Next, with reference to FIGS. 8A and 8B, a position of the standard-type detection gear 300S when the standard-type detection gear 300S is mounted to the boss 155 will be described. Further, with reference to FIGS. 9A and 9B, a position of the standard-type detection gear 300S when inspecting the standard-type developing cartridge 8S having the standard-type detection gear 300S will be described. Further, with reference to FIGS. 10A and 10B, a position of the standard-type detection gear 300S when the standard-type developing cartridge 8S is shipped, i.e., when the standard-type developing cartridge 8S is new, that is, unused, will be described.

Figure 8A:
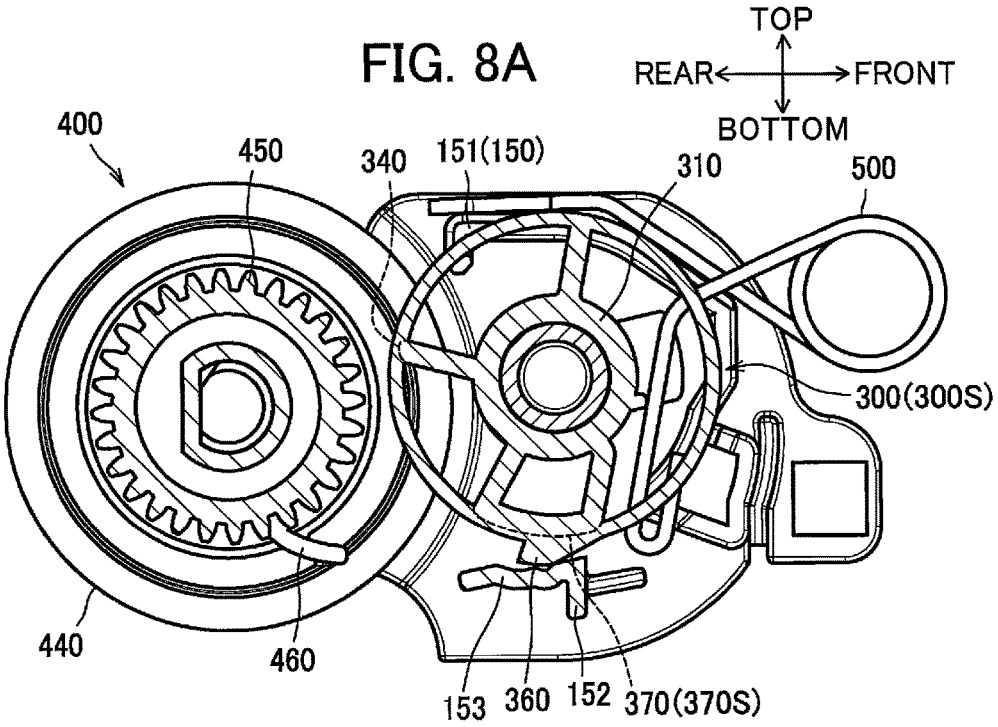
FIG. 8A is an explanatory diagram illustrating a mounting position of the standard-type detection gear 300S in relation to a cross section of the developing cartridge 8 taken along a line DD in FIG. 1.
Figure 8B:
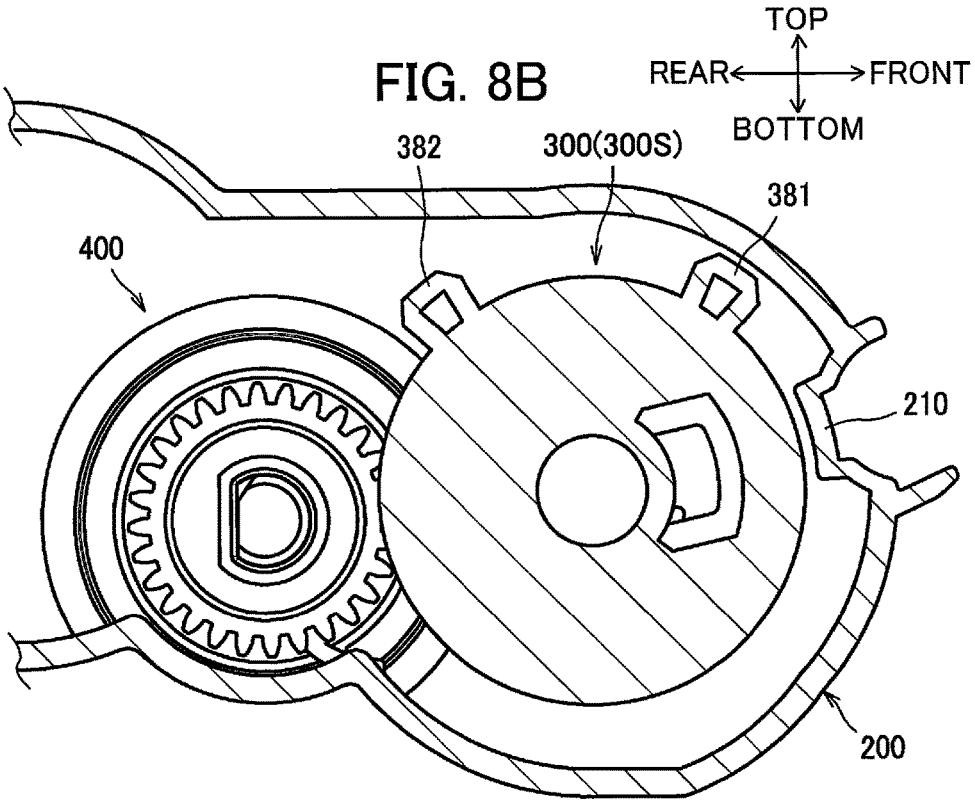
FIG. 8B is an explanatory diagram illustrating the mounting position of the standard-type detection gear 300S in relation to a cross section of the developing cartridge 8 taken along a line BB in FIG. 1.

As illustrated in FIGS. 8A and 8B, the standard-type detection gear 300S is moved to a mounting position in which the first restriction portion 360 is contacted by the holding portion 153 when the standard-type detection gear 300S is mounted to the boss 155. When the first restriction portion 360 is in contact with the holding portion 153, the restricting portion 152 and the holding portion 153 are deformed to hold the standard-type detection gear 300S. Further, when the first restriction portion 360 is in contact with the holding portion 153, the torsion spring 500 is in contact with the rotational shaft portion 310 and not in contact with the spring-engaging portion 370S.

Next, the first gear cover 200 is mounted over the first outer surface 100A so as to cover at least a portion of the transmission gear 400. By setting the standard-type detection gear 300S at the mounting position when attaching the first gear cover 200 to the first outer surface 100A, a movement restricting portion 210 (FIG. 8B) of the first gear cover 200 passes through a groove 302 formed in the standard-type detection gear 300S as illustrated in FIG. 26A, allowing the first gear cover 200 to be mounted to the first outer surface 100A.

Figure 9A:
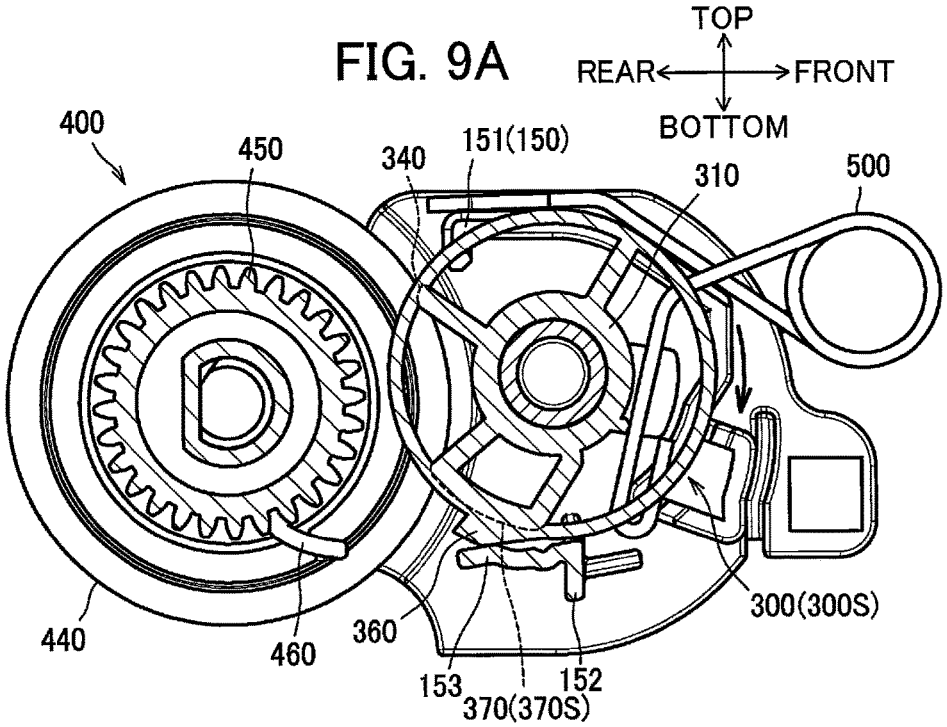
FIG. 9A is an explanatory diagram illustrating an inspection position of the standard-type detection gear 300S in relation to the cross section of the developing cartridge 8 taken along the line DD in FIG. 1.
Figure 9B:
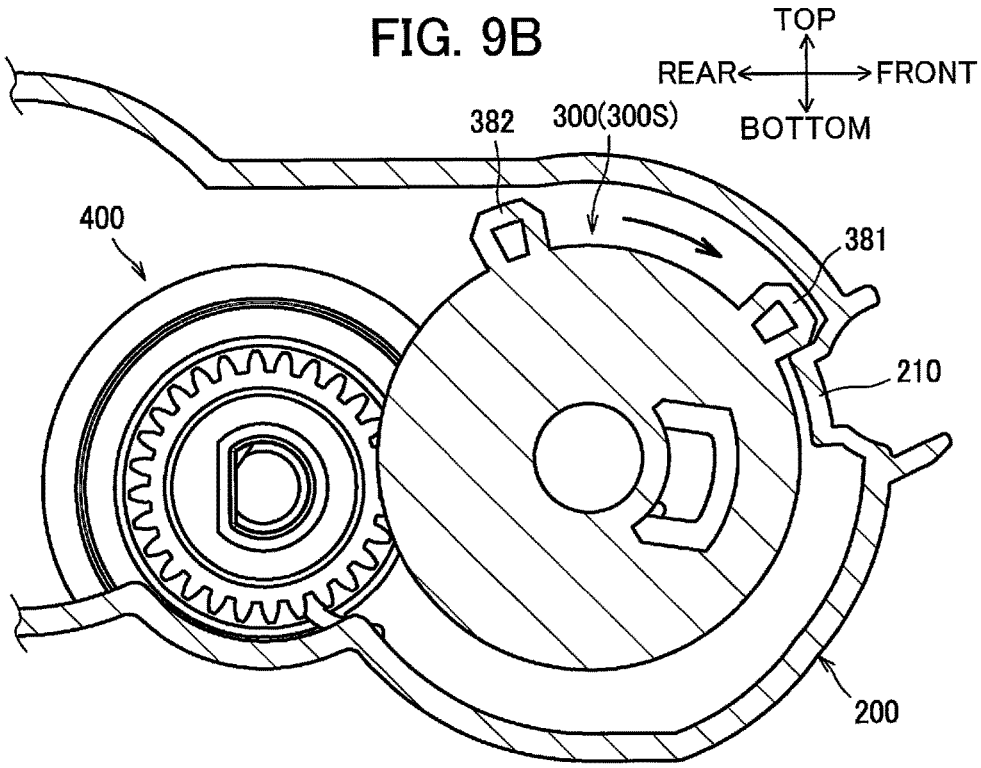
FIG. 9B is an explanatory diagram illustrating the inspection position of the standard-type detection gear 300S in relation to the cross section of the developing cartridge 8 taken along the line BB in FIG. 1.

After the first gear cover 200 has been attached to the first outer surface 100A, an operator rotates the standard-type detection gear 300S clockwise, as illustrated in FIG. 9A. When the standard-type detection gear 300S is rotated, the first protrusion 381 of the standard-type detection gear 300S is in contact with the movement restricting portion 210 of the first gear cover 200, as illustrated in FIG. 9B. This contact halts the standard-type detection gear 300S at the inspection position. When the standard-type detection gear 300S is at the inspection position, the first restriction portion 360 is in contact with the holding portion 153 and is thus held by the holding portion 153.

When the standard-type detection gear 300S is held at the inspection position in this way, the second rib 340 is positioned outside the locus of the first rib 460. Hence, when the standard-type detection gear 300S is at the inspection position, the first rib 460 does not engage with the second rib 340, even if a drive force were applied to the standard-type developing cartridge 8S. As a result, the standard-type detection gear 300S does not rotate.

Figure 10B:
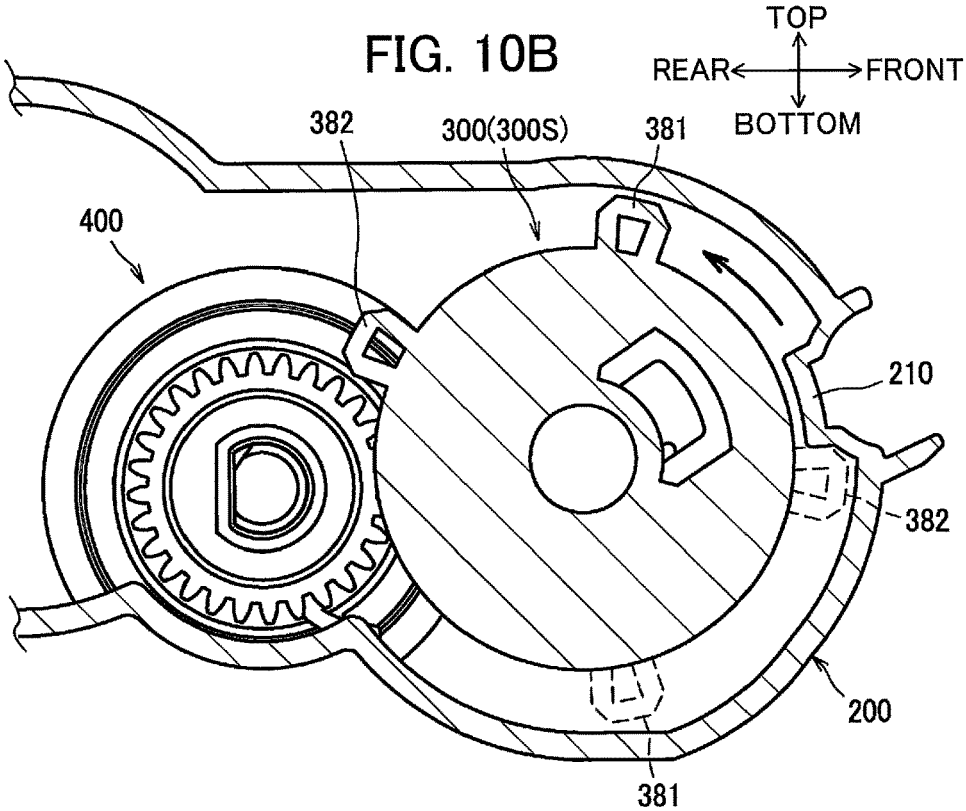
FIG. 10B is an explanatory diagram illustrating the initial position of the standard-type detection gear 300S in relation to the cross section of the developing cartridge 8 taken along the line BB in FIG. 1.

After inspecting the standard-type developing cartridge 8S, the operator rotates the standard-type detection gear 300S counterclockwise until the first restriction portion 360 is moved to the restricting portion 152, as illustrated in FIGS. 10A and 10B. Hence, the standard-type detection gear 300S is moved to its initial position in which the first restriction portion 360 is in contact with the restricting portion 152.

Note that when the standard-type detection gear 300S is rotated to its final position, the second protrusion 382 indicated by dashed lines in FIG. 10B is in contact with the movement restricting portion 210. This contact holds the standard-type detection gear 300S at the final position.

[Operations of Standard-Type Detection Gear 300S]

Next, operations of the transmission gear 400 and the standard-type detection gear 300S will be described.

When the standard-type developing cartridge 8S is a new cartridge (i.e. a cartridge that has never been used), the standard-type detection gear 300S is at the initial position illustrated in FIGS. 14A through 14C. When the standard-type detection gear 300S is at the initial position, the small-diameter gear portion 450 is separated from the first gear portion 332S. Hence, the small-diameter gear portion 450 is not engaged with the first gear portion 332S. Specifically, the small-diameter gear portion 450 is not meshed with the first gear portion 332S. Further, the large-diameter gear portion 440 is separated from the second gear portion 352. In other words, the large-diameter gear portion 440 is not engaged with the second gear portion 352. Specifically, the large-diameter gear portion 440 is not meshed with the second gear portion 352. The torsion spring 500 urges the third rib 371 of the standard-type detection gear 300S so that the standard-type detection gear 300S is at the initial position. The initial position is one example of a first position. When the standard-type detection gear 300S is at the initial position, the second rib 340 is positioned within the locus of the first rib 460. Further, when the standard-type detection gear 300S is at the initial position, the first gear portion 332S is positioned outside the locus of the small-diameter gear portion 450. As illustrated in FIG. 14A, the first gear cover 200 includes an arcuate wall 220.

Figure 15A:
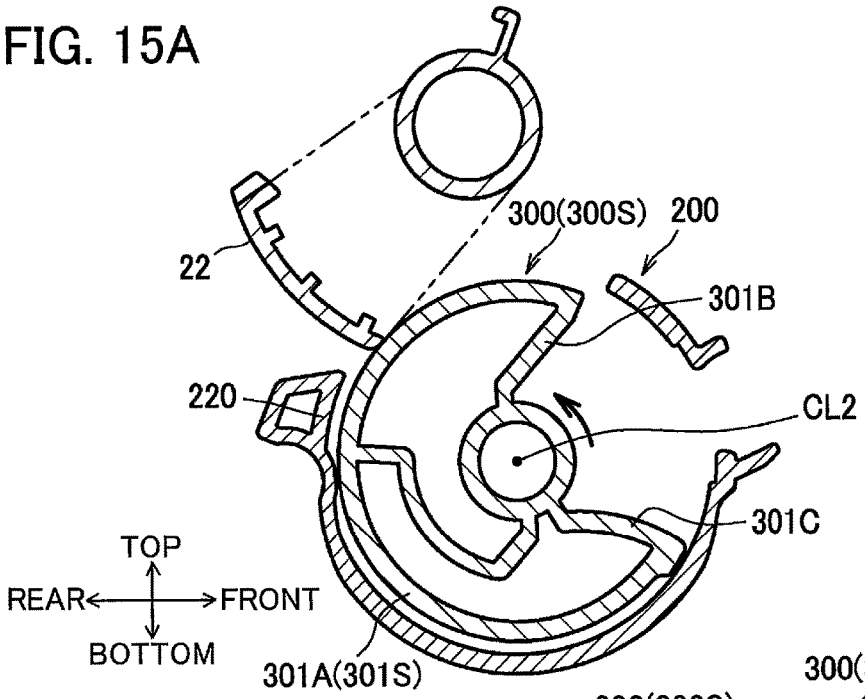
Figure 15B:
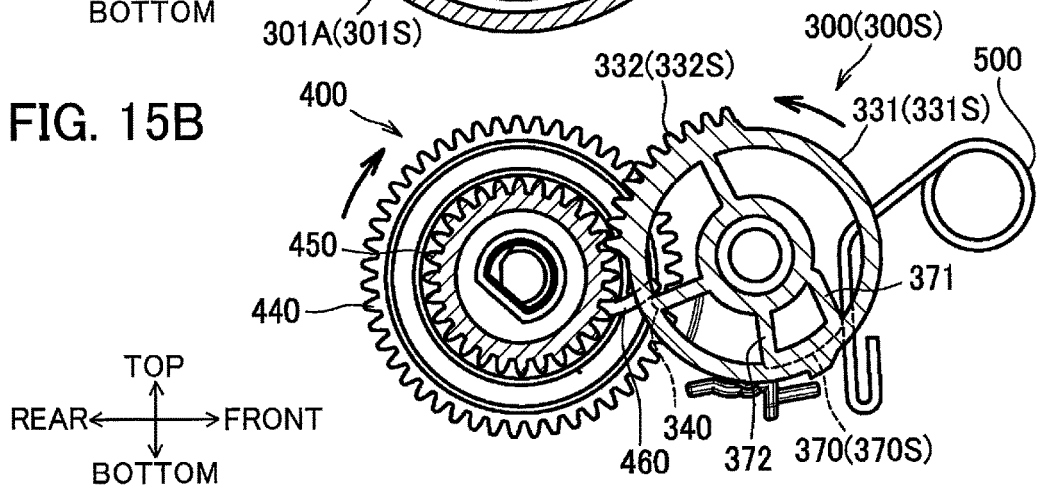
Figure 15C:
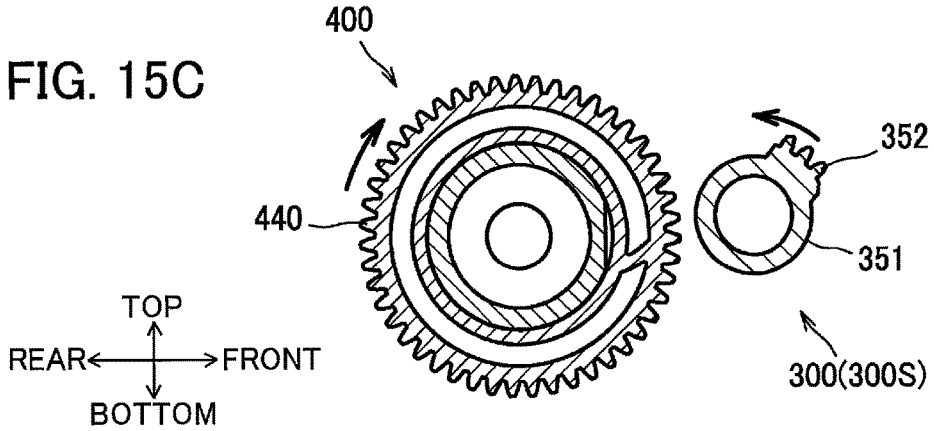
Figure 16A:
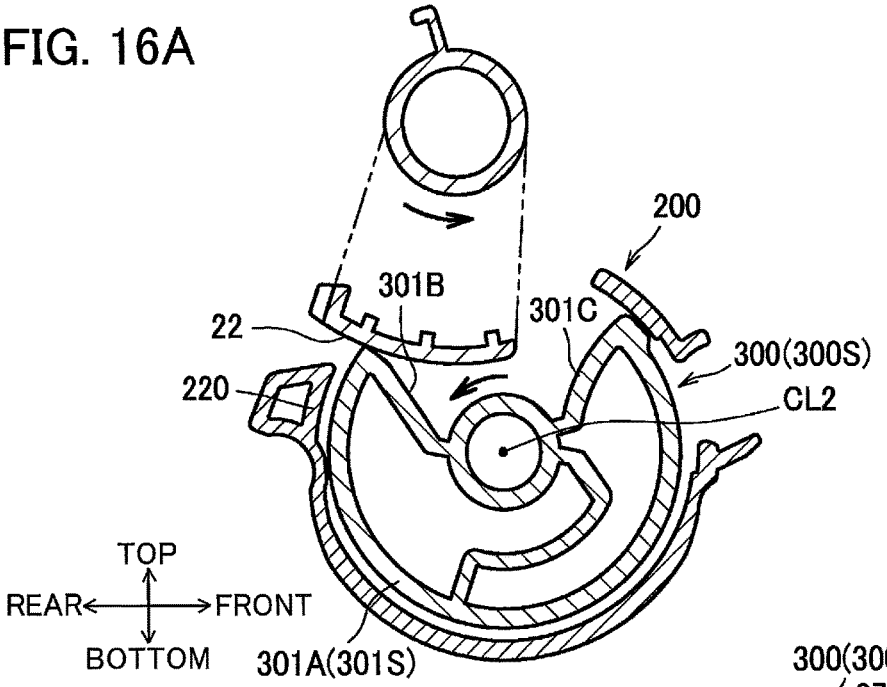
Figure 16B:
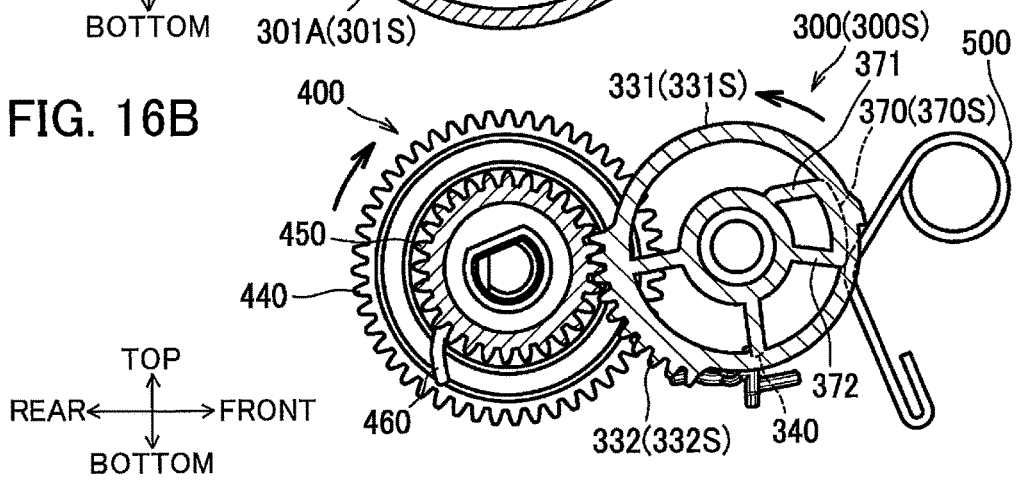
Figure 16C:
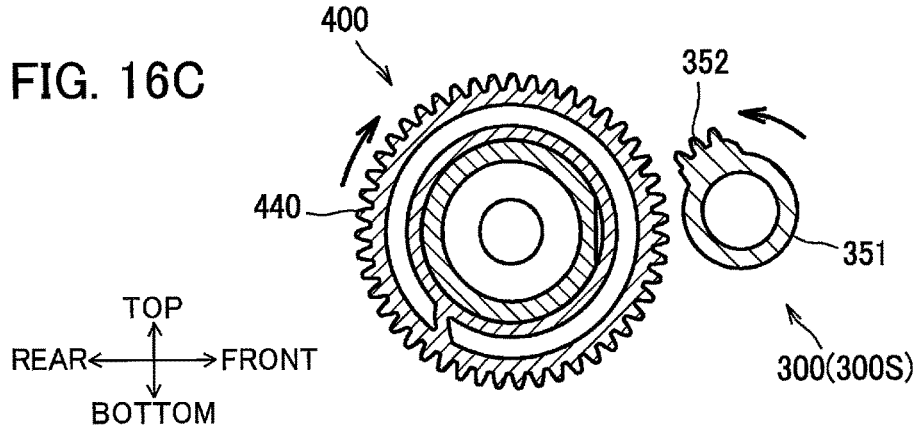

When the standard-type developing cartridge 8S receives a drive force, the transmission gear 400 rotates and the first rib 460 rotates together with the transmission gear 400. While rotating, the first rib 460 is in contact with the second rib 340, as illustrated in FIGS. 15A through 15C, and rotates the second rib 340 against the urging force of the torsion spring 500. At this time, the standard-type detection gear 300S rotates together with the second rib 340. When the standard-type detection gear 300S has rotated a prescribed amount, the first gear portion 332S becomes engaged with the small-diameter gear portion 450. Specifically, when the standard-type detection gear 300S has rotated the prescribed amount, the first gear portion 332S becomes meshed with the small-diameter gear portion 450. Thereafter, the first gear portion 332S rotates in accordance with the rotation of the small-diameter gear portion 450. The standard-type detection gear 300S further rotates a prescribed amount together with the first gear portion 332S, as illustrated in FIGS. 16A through 16C. Since the urging force of the torsion spring 500 presses the first gear portion 332S toward the small-diameter gear portion 450 at this time, the first gear portion 332S remains stably meshed with the small-diameter gear portion 450. Note that the position of the standard-type detection gear 300S illustrated in FIGS. 15B and 16B is one example of a second position.

Figure 17A:
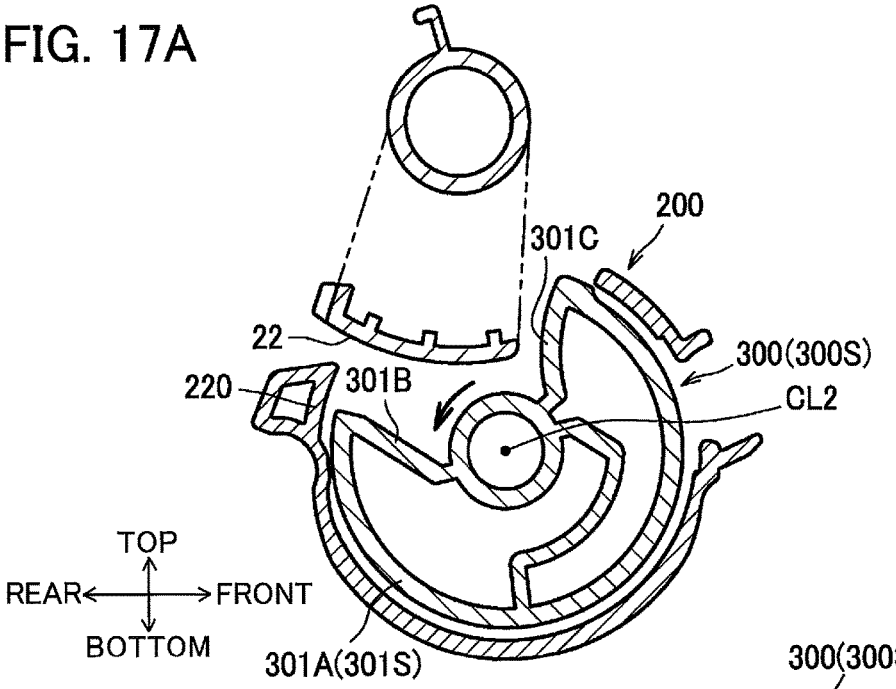
Figure 17B:
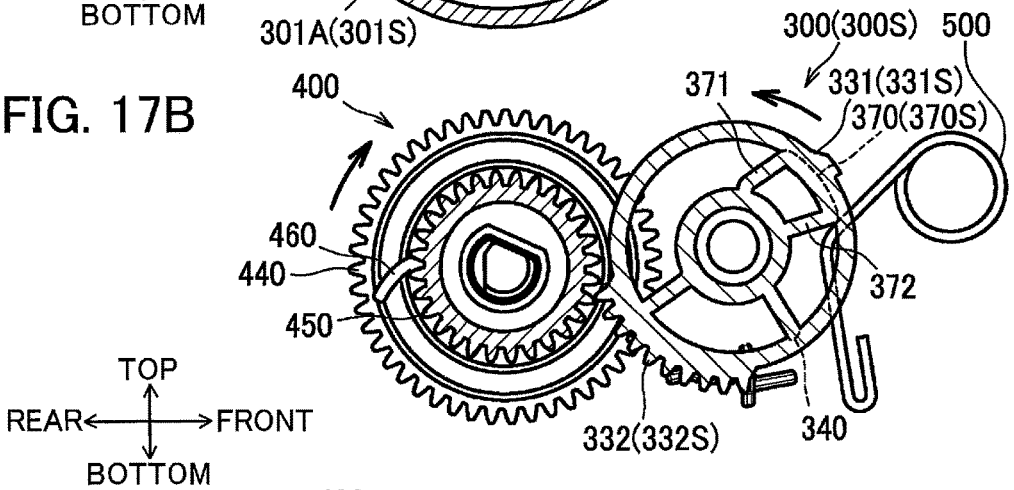
Figure 17C:
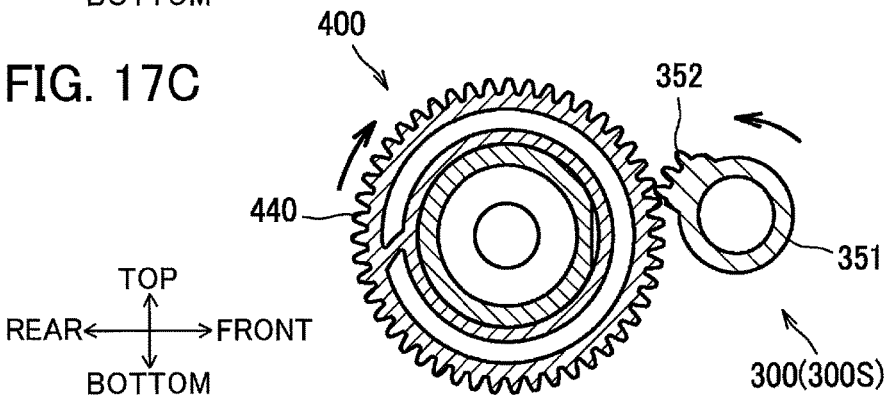

Subsequently, the small-diameter gear portion 450 becomes disengaged from the first gear portion 332S, as illustrated in FIGS. 17A through 17C. Specifically, the small-diameter gear portion 450 becomes unmeshed from the first gear portion 332S. After the small-diameter gear portion 450 and the first gear portion 332S become unmeshed, the large-diameter gear portion 440 engages with the second gear portion 352. Specifically, after the small-diameter gear portion 450 and the first gear portion 332S become unmeshed, the large-diameter gear portion 440 becomes meshed with the second gear portion 352. Thereafter, the second gear portion 352 rotates in accordance with the rotation of the large-diameter gear portion 440. The standard-type detection gear 300S further rotates a prescribed amount together with the second gear portion 352. Note that the position of the standard-type detection gear 300S illustrated in FIGS. 17B and 18B is one example of a third position. When the standard-type detection gear 300S moves from the position illustrated in FIG. 15B to the position illustrated in FIG. 17B, the torsion spring 500 is in contact with the fourth rib 372 of the spring-engaging portion 370S and urges the fourth rib 372 in the rotating direction of the standard-type detection gear 300S. In this way, after the first gear portion 332S and the small-diameter gear portion 450 become unmeshed, the urging force of the torsion spring 500 presses the second gear portion 352 toward the large-diameter gear portion 440. Accordingly, the second gear portion 352 can be reliably meshed with the large-diameter gear portion 440. Further, since the large-diameter gear portion 440 becomes meshed with the second gear portion 352 after the small-diameter gear portion 450 and the first gear portion 332S become unmeshed, reverse rotation of the standard-type detection gear 300S can be suppressed.

More specifically, the spring-engaging portion 370S presses the torsion spring 500 outward in the radial direction of the rotational shaft portion 310 while the standard-type detection gear 300S rotates from the position illustrated in FIG. 15B to the position illustrated in FIG. 16B. When the standard-type detection gear 300S reaches the position illustrated in FIG. 16B, the torsion spring 500 presses the spring-engaging portion 370S toward the transmission gear 400. Consequently, the torsion spring 500 urges the standard-type detection gear 300S to rotate counterclockwise in FIG. 16B.

Figure 18A:
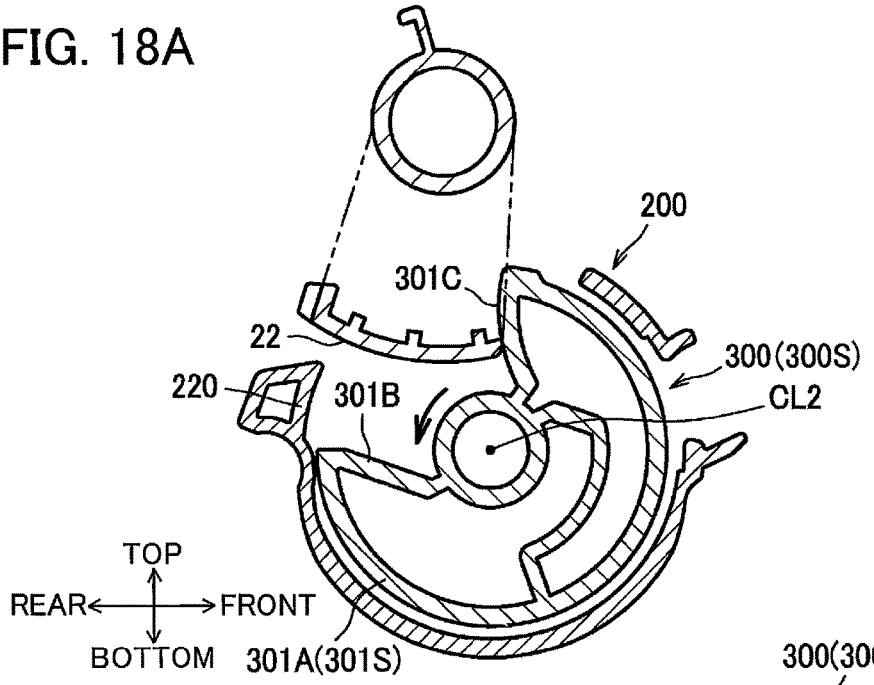
Figure 18B:
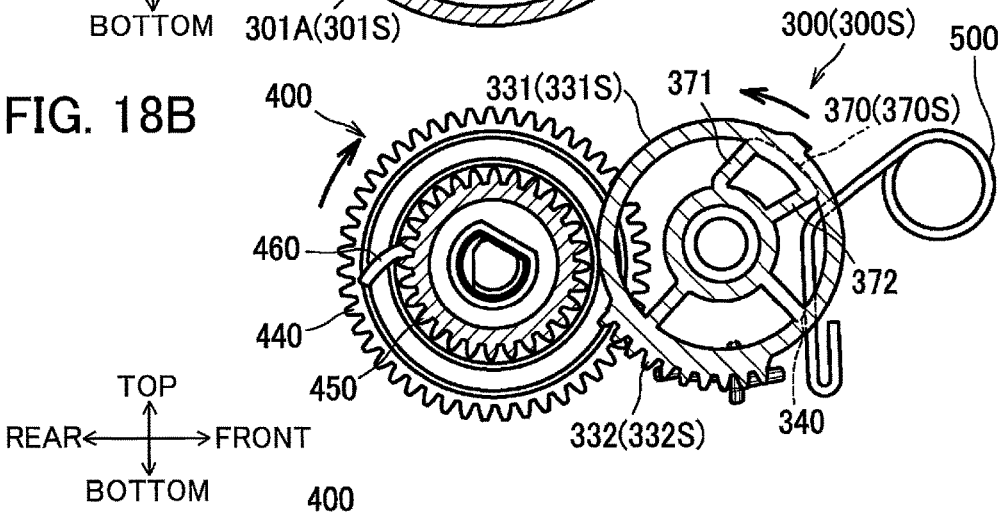
Figure 18C:
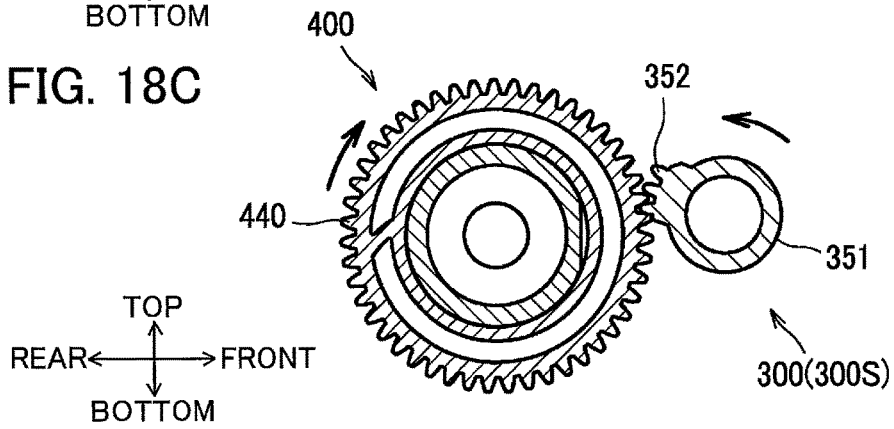
Figure 19A:
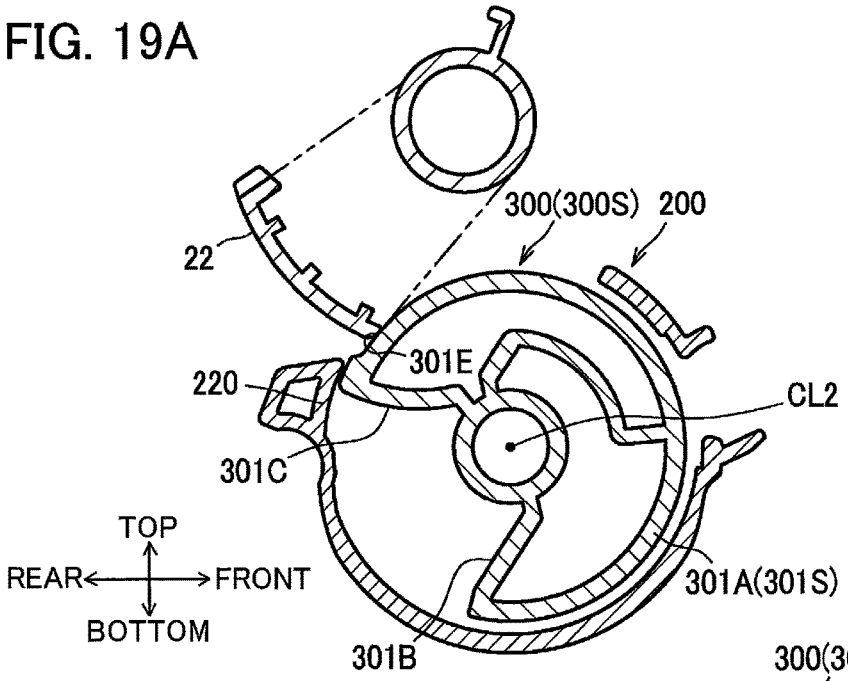
Figure 19B:
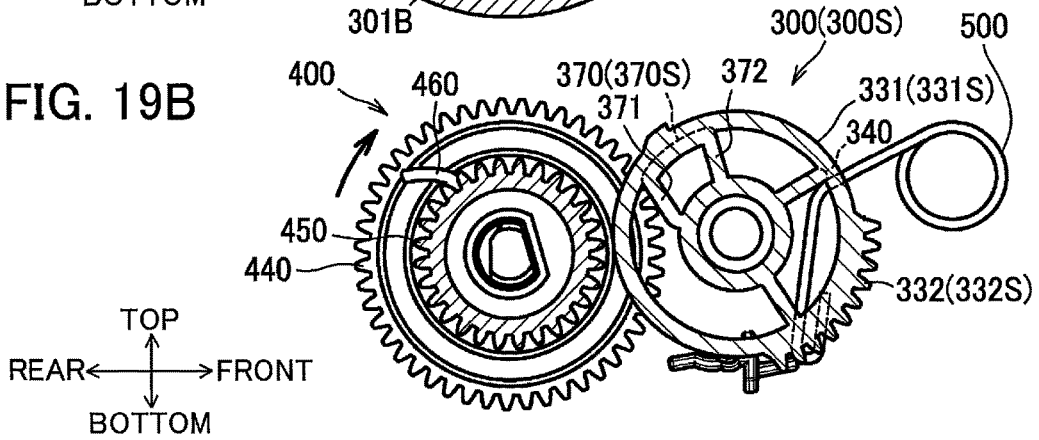
Figure 19C:
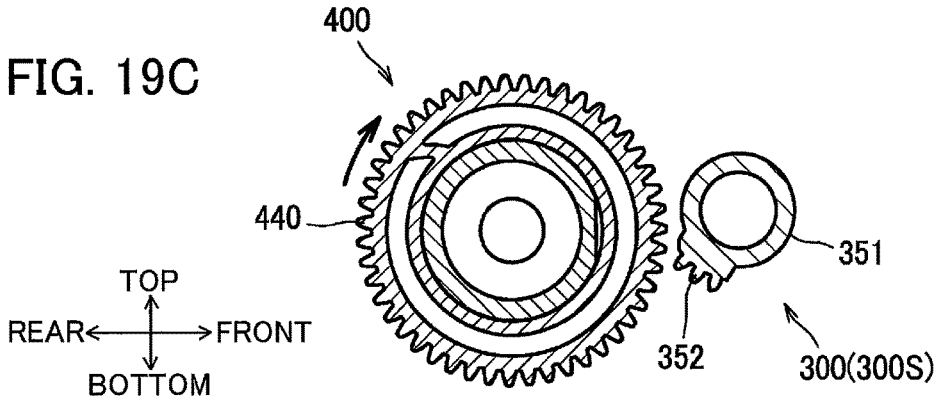

Next, the second gear portion 352 engages with the large-diameter gear portion 440, as illustrated in FIGS. 18A through 18C. Specifically, the second gear portion 352 meshes with the large-diameter gear portion 440. Accordingly, the second gear portion 352 rotates in accordance with the rotation of the large-diameter gear portion 440. The standard-type detection gear 300S rotates together with the second gear portion 352 while the second gear portion 352 is meshed with the large-diameter gear portion 440. Since the urging force of the torsion spring 500 presses the second gear portion 352 toward the large-diameter gear portion 440 at this time, the second gear portion 352 is stably meshed with the large-diameter gear portion 440. When the second gear portion 352 becomes unmeshed from the large-diameter gear portion 440, as illustrated in FIGS. 19A through 19C, the standard-type detection gear 300S halts in the final position. When the standard-type detection gear 300S is at its final position, the torsion spring 500 contacts the second rib 340 and urges the standard-type detection gear 300S to rotate counterclockwise in FIG. 19B. As a result, the second protrusion 382 is pressed toward the movement restricting portion 210, as illustrated by the dashed lines in FIG. 10B. Thus, the standard-type detection gear 300S is maintained at the final position since the second protrusion 382 is in contact with the movement restricting portion 210. Note that the final position is one example of a fourth position. When the standard-type detection gear 300S is at the final position, the second gear portion 352 is positioned outside the locus of the large-diameter gear portion 440.

Further, the second gear portion 352 becomes meshed with the large-diameter gear portion 440 before the protrusion 301S contacts an actuator 22, as illustrated in FIGS. 17A through 17C.

[Structure of High-Capacity-Type Detection Gear 300H]

Next, the high-capacity-type detection gear 300H will be described with reference to FIGS. 5A through 5C, 7B, and 26B. The following description covers the points of difference between the high-capacity-type detection gear 300H and the standard-type detection gear 300S, in which like parts and components are designated by the same reference numerals to avoid duplicating description.

Further, a first gear portion 332H has a similar configuration to the first gear portion 332S. However, a length of the first gear portion 332H of the high-capacity-type detection gear 300H in the rotating direction of the high-capacity-type detection gear 300H is greater than a length of the first gear portion 332S of the standard-type detection gear 300S in the rotating direction of the standard-type detection gear 300S. In other words, the first gear portion 332H of the high-capacity-type detection gear 300H includes a plurality of gear teeth whose number is greater than that of a plurality of gear teeth of the first gear portion 332S of the standard-type detection gear 300S. Specifically, as illustrated in FIG. 5C, an angle θ5 between the line segment L4 connecting the fourth end 332B and the second axis CL2 and the line segment L5 connecting the third end 332A and the second axis CL2 may be in the range from 146° to 150°. In other words, the angle θ5 may be not smaller than 146° and not greater than 150°. In the high-capacity-type detection gear 300H illustrated in FIGS. 5A through 5C, θ5 is 147°.

Further, while the standard-type detection gear 300S includes the first protrusion 381 and the second protrusion 382, the high-capacity-type detection gear 300H includes only the first protrusion 381. That is, in the high-capacity-type detection gear 300H, the second protrusion 382 is dispensed with.

A spring-engaging portion 370H includes a third rib 374 and a fourth rib 375. The fourth rib 375 is positioned at the opposite side of the second rib 340 from the third rib 374 in the rotating direction of the high-capacity-type detection gear 300H. Further, the third rib 374 of the spring-engaging portion 370H is positioned at the upstream side of the second gear portion 352 in the rotating direction of the high-capacity-type detection gear 300H. Further, the fourth rib 375 is positioned at the opposite side of the second axis CL2 from the third rib 374.

[Method of Assembling High-Capacity-Type Detection Gear 300H]

Next, a position of the high-capacity-type detection gear 300H when the high-capacity-type detection gear 300H is mounted to the boss 155 will be described with reference to FIGS. 11A and 11B. Further, a position of the high-capacity-type detection gear 300H when inspecting the developing cartridge 8 (i.e. high-capacity type developing cartridge 8H) including the high-capacity-type detection gear 300H will be described with reference to FIGS. 12A and 12B. Further, a position of the high-capacity-type detection gear 300 when the high-capacity type developing cartridge 8H is shipped, i.e., when the high-capacity type developing cartridge 8H is new, that is, unused, will be described with reference to FIGS. 13A and 13B.

Figure 11A:
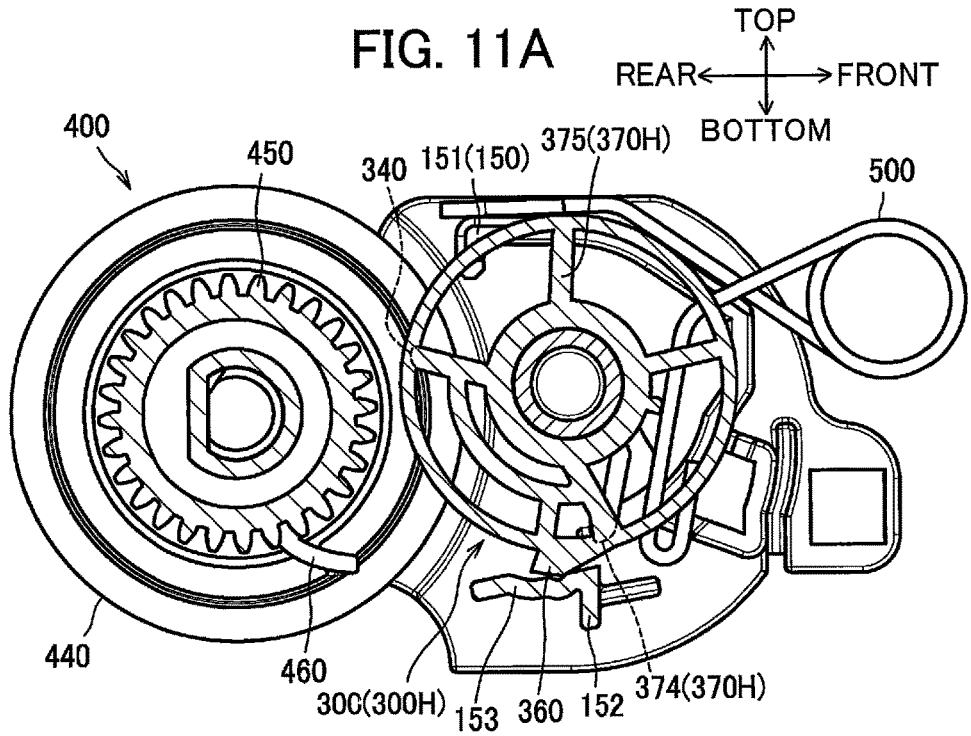
FIG. 11A is an explanatory diagram illustrating a mounting position of the high-capacity-type detection gear 300H in relation to the cross section of the developing cartridge 8 taken along the line DD in FIG. 1.
Figure 11B:
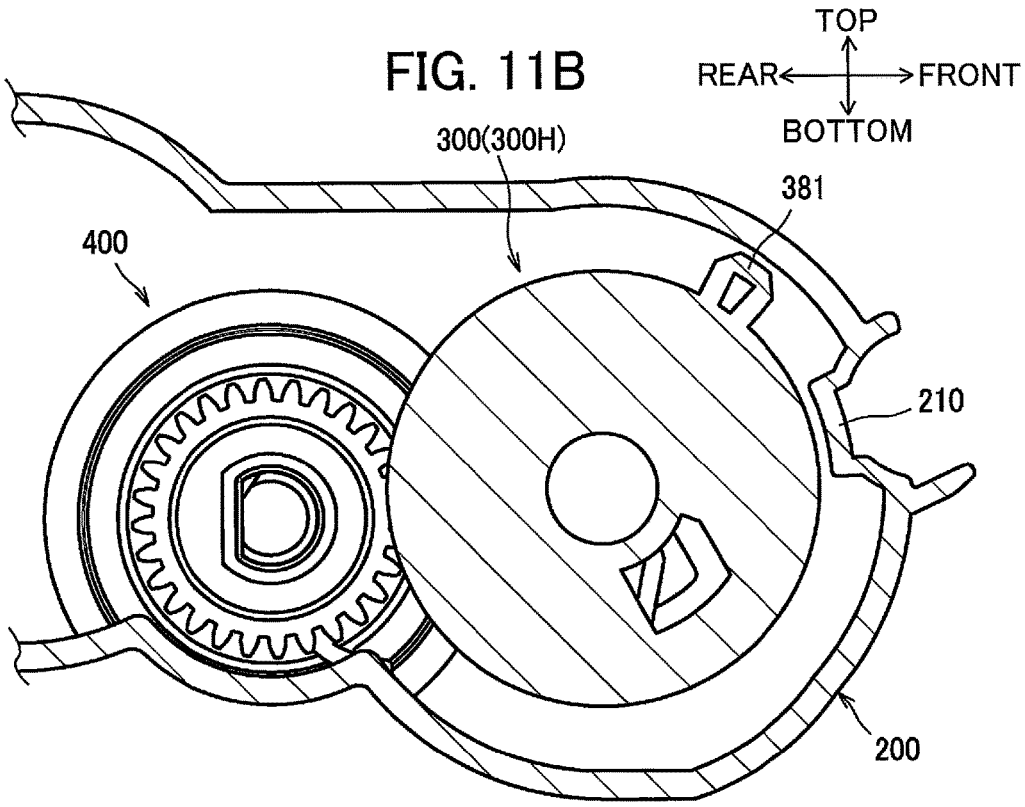
FIG. 11B is an explanatory diagram illustrating the mounting position of the high-capacity-type detection gear 300H in relation to the cross section of the developing cartridge 8 taken along the line BB in FIG. 1.

As illustrated in FIGS. 11A and 11B, the high-capacity-type detection gear 300H is moved to a mounting position in which the first restriction portion 360 is contacted by the holding portion 153 when the high-capacity-type detection gear 300H is mounted to the boss 155. When the first restriction portion 360 is in contact with the holding portion 153, the restricting portion 152 and the holding portion 153 are deformed to hold the high-capacity-type detection gear 300H. Further, when the first restriction portion 360 is in contact with the holding portion 153, the torsion spring 500 is in contact with the rotational shaft portion 310 and not in contact with the spring-engaging portion 370H.

Figure 26B:
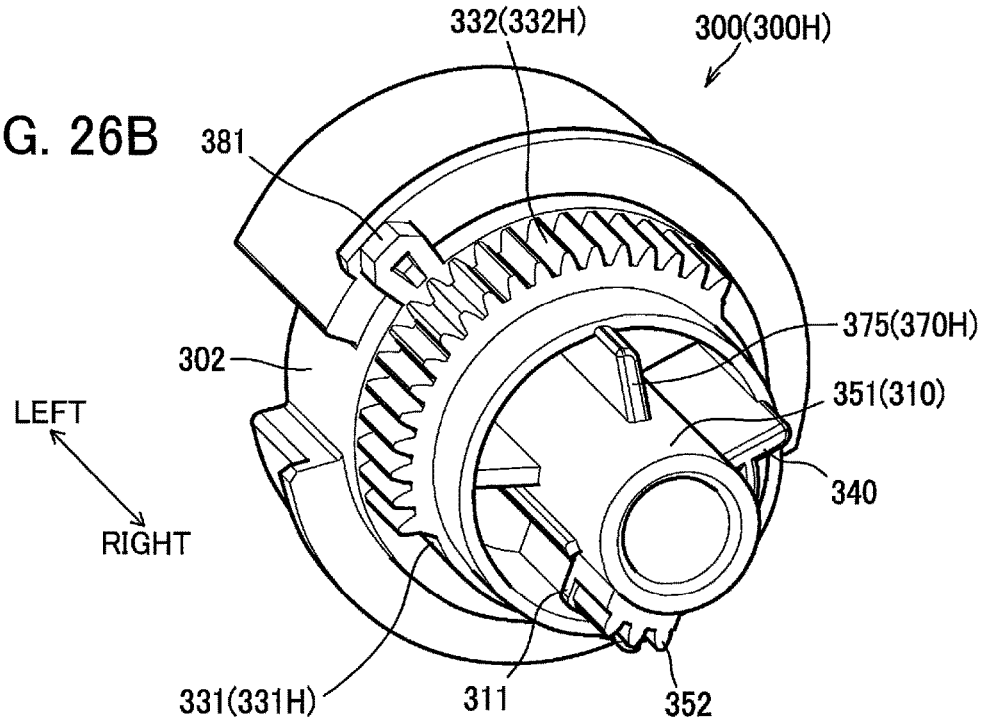
FIG. 26B is a perspective view illustrating the high-capacity-type detection gear 300H.

Next, the first gear cover 200 is mounted over the first outer surface 100A so as to cover at least a portion of the transmission gear 400. By setting the high-capacity-type detection gear 300H at the mounting position when attaching the first gear cover 200 to the first outer surface 100A, the movement restricting portion 210 on the first gear cover 200 passes through the groove 302 formed in the high-capacity-type detection gear 300H as illustrated in FIG. 26B, allowing the first gear cover 200 to be attached to the first outer surface 100A.

Figure 12A:
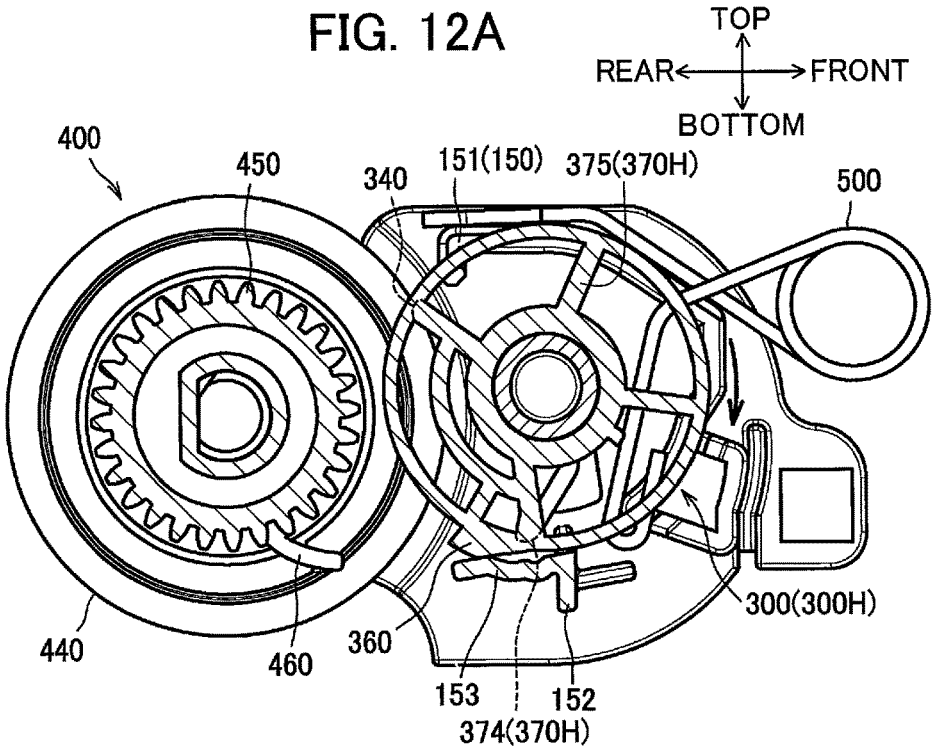
FIG. 12A is an explanatory diagram illustrating an inspection position of the high-capacity-type detection gear 300H in relation to the cross section of the developing cartridge 8 taken along the line DD in FIG. 1.
Figure 12B:
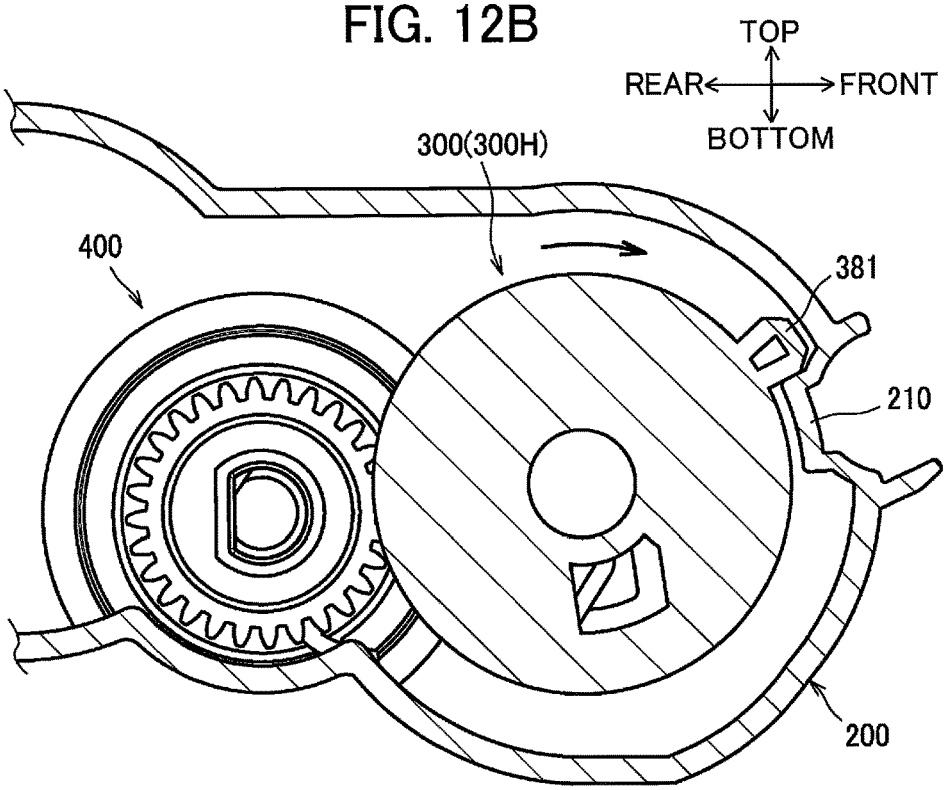
FIG. 12B is an explanatory diagram illustrating the inspection position of the high-capacity-type detection gear 300H in relation to the cross section of the developing cartridge 8 taken along the line BB in FIG. 1.

After the first gear cover 200 has been attached to the first outer surface 100A, an operator rotates the high-capacity-type detection gear 300H clockwise, as illustrated in FIG. 12A. When the high-capacity-type detection gear 300H is rotated, the first protrusion 381 of the high-capacity-type detection gear 300H is in contact with the movement restricting portion 210 of the first gear cover 200, as illustrated in FIG. 12B. This contact halts the high-capacity-type detection gear 300H at the inspection position. When the high-capacity-type detection gear 300H is at the inspection position, the first restriction portion 360 is in contact with the holding portion 153 and is thus held by the holding portion 153.

When the high-capacity-type detection gear 300H is held at the inspection position in this way, the second rib 340 is positioned outside the locus of the first rib 460. Hence, when the high-capacity-type detection gear 300H is at the inspection position, the first rib 460 does not engage with the second rib 340, even if a drive force were applied to the high-capacity type developing cartridge 8H. As a result, the high-capacity-type detection gear 300H does not rotate.

Figure 13A:
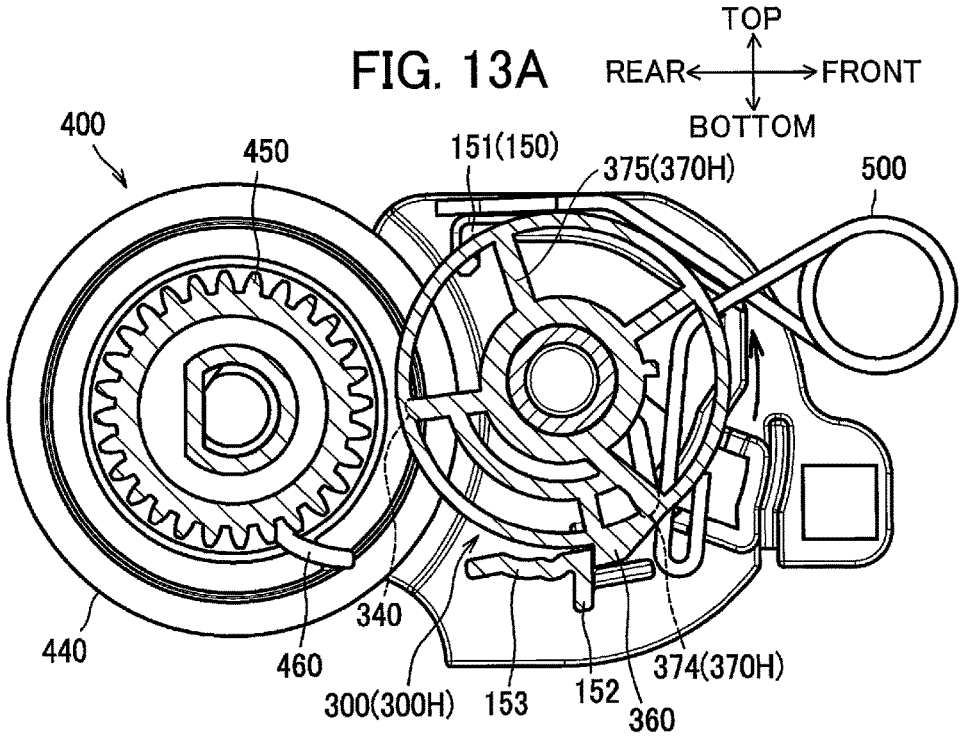
FIG. 13A is an explanatory diagram illustrating an initial position of the high-capacity-type detection gear 300H in relation to the cross section of the developing cartridge 8 taken along the line DD in FIG. 1.

After inspecting the high-capacity type developing cartridge 8H, the operator rotates the high-capacity-type detection gear 300H counterclockwise until the first restriction portion 360 is moved to the restricting portion 152, as illustrated in FIG. 13A. Hence, the high-capacity-type detection gear 300H is moved to its initial position in which the first restriction portion 360 is in contact with the restricting portion 152.

Figure 13B:
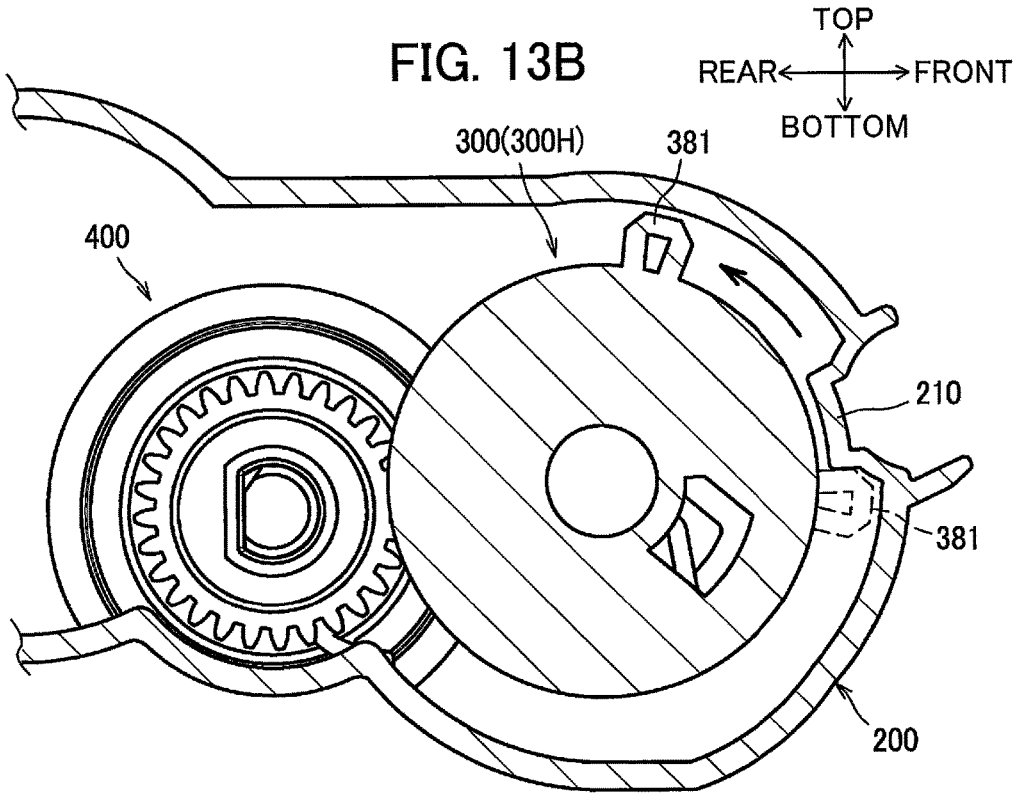
FIG. 13B is an explanatory diagram illustrating the initial position of the high-capacity-type detection gear 300H in relation to the cross section of the developing cartridge 8 taken along the line BB in FIG. 1.

Note that when the high-capacity-type detection gear 300H is rotated to its final position, the first protrusion 381 indicated by dashed lines in FIG. 13B is in contact with the movement restricting portion 210. This contact holds the high-capacity-type detection gear 300H at the final position.

[Operations of High-Capacity-Type Detection Gear 300H]

Next, operations of the high-capacity-type detection gear 300H will be described with reference to FIGS. 20A through 25C. Note that only operations differing from those for the standard-type detection gear 300S will be described with reference to FIGS. 20A through 25C.

Figure 21A:
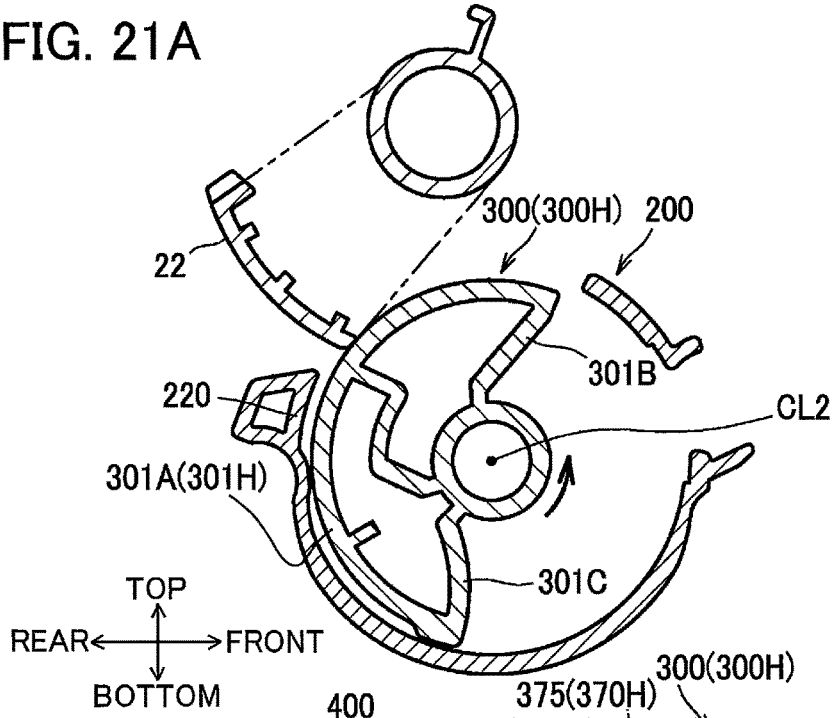
Figure 21B:
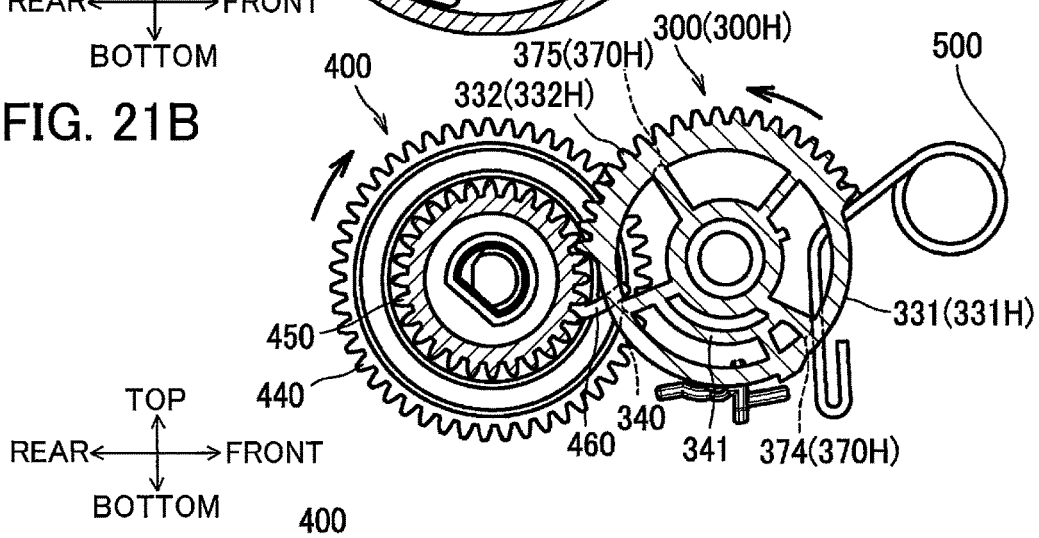
Figure 21C:
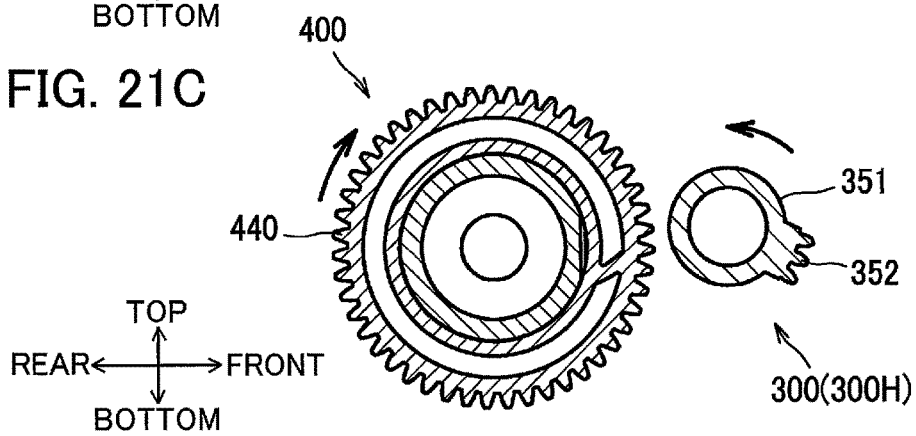

When the high-capacity-type detection gear 300H is at the initial position illustrated in FIG. 20B, the torsion spring 500 is engaged with the third rib 374. Specifically, the torsion spring 500 is in contact with the third rib 374. The torsion spring 500 urges the third rib 374 to rotate clockwise. When the high-capacity-type detection gear 300H is subsequently rotated in the counterclockwise direction, the third rib 374 rotates against the urging force of the torsion spring 500, as illustrated in FIG. 21B.

Figure 22A:
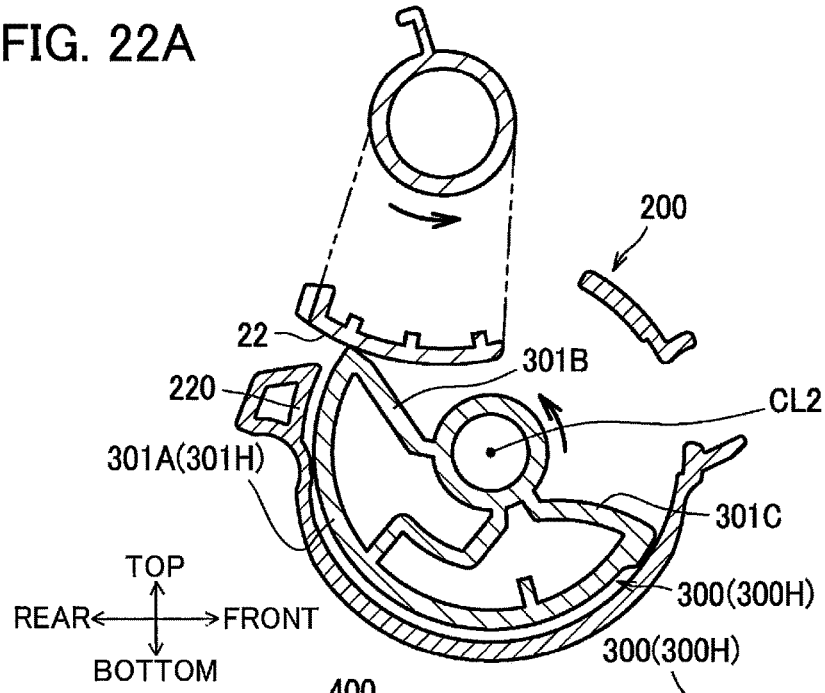
Figure 22B:
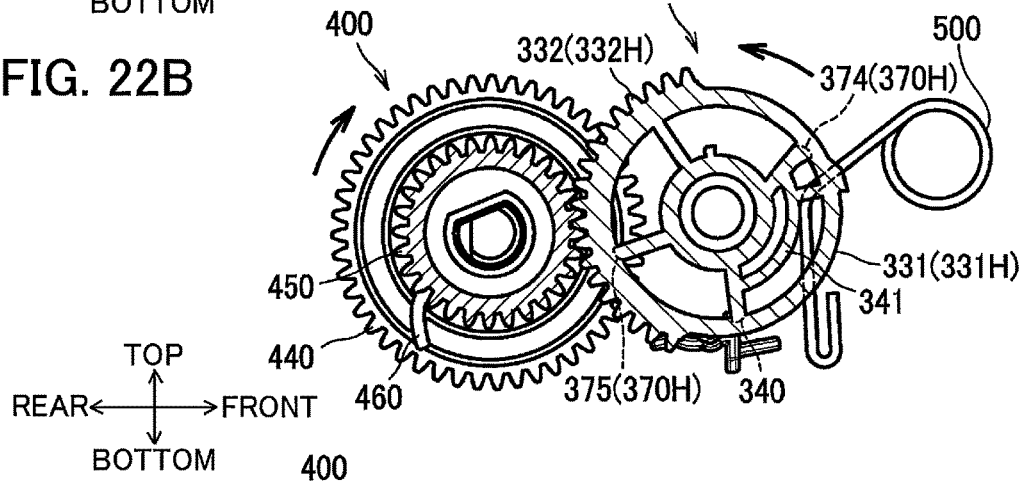
Figure 22C:
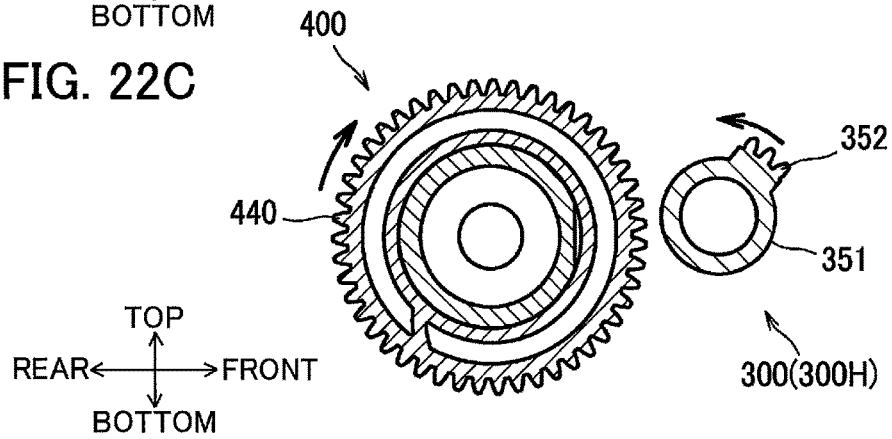
Figure 23A:
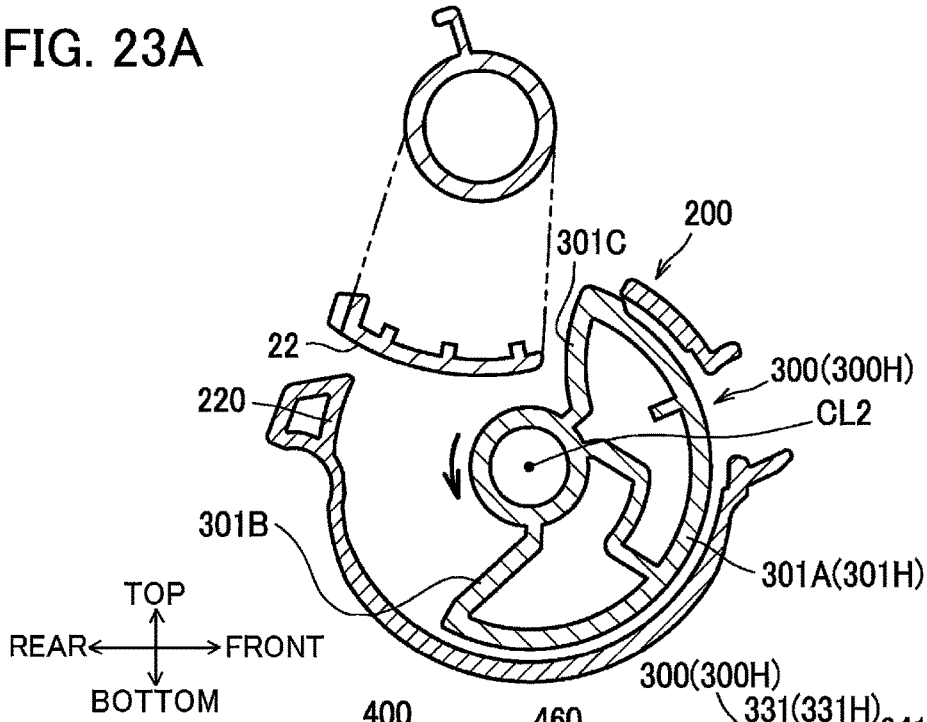
Figure 23B:
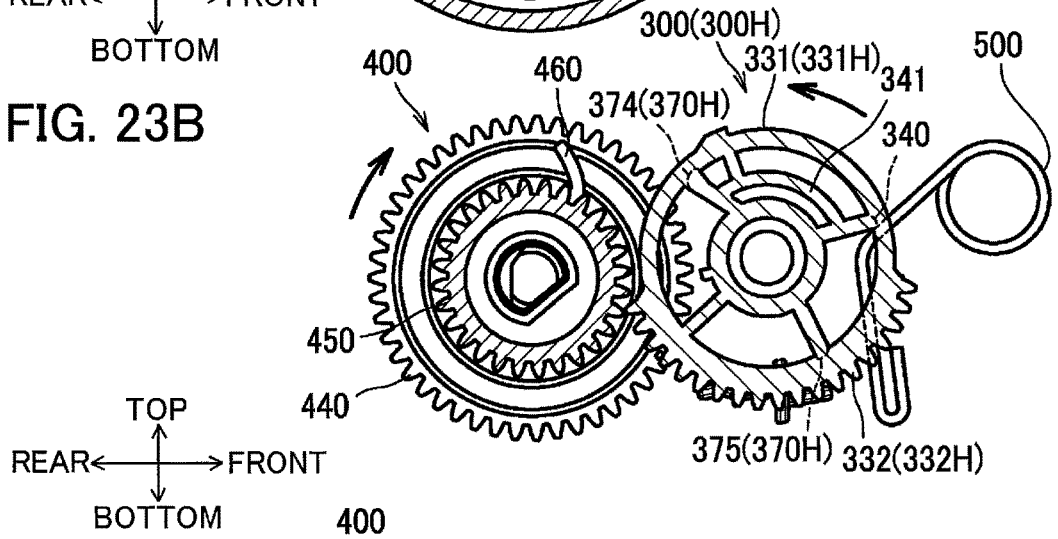
Figure 23C:
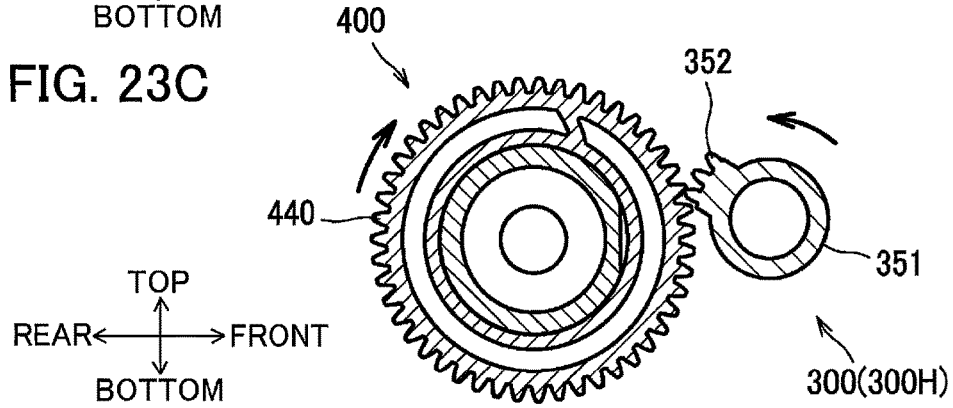

When the third rib 374 subsequently disengages from the torsion spring 500, the torsion spring 500 becomes engaged with an arcuate wall 341 connecting the third rib 374 to the second rib 340, as illustrated in FIG. 22B. Specifically, when the third rib 374 and the torsion spring 500 is no longer in contact with each other, the torsion spring 500 comes into contact with the arcuate wall 341 connecting the third rib 374 to the second rib 340. When the torsion spring 500 is in contact with the arcuate wall 341, the urging force of the torsion spring 500 is directed toward the center of the high-capacity-type detection gear 300H. Next, after the small-diameter gear portion 450 and the first gear portion 332H become unmeshed, the large-diameter gear portion 440 becomes meshed with the second gear portion 352, as illustrated in FIG. 23B. The torsion spring 500 is in contact with the second rib 340 while the meshed state of the transmission gear 400 and the high-capacity-type detection gear 300H shifts from the small-diameter gear portion 450 being meshed with the first gear portion 332H to the large-diameter gear part 440 being meshed with the second gear portion 352. Since the torsion spring 500 urges the second rib 340, the second gear portion 352 is urged toward the large-diameter gear portion 440, thereby reliably meshing the second gear part 352 with the large-diameter gear portion 440.

Figure 24A:
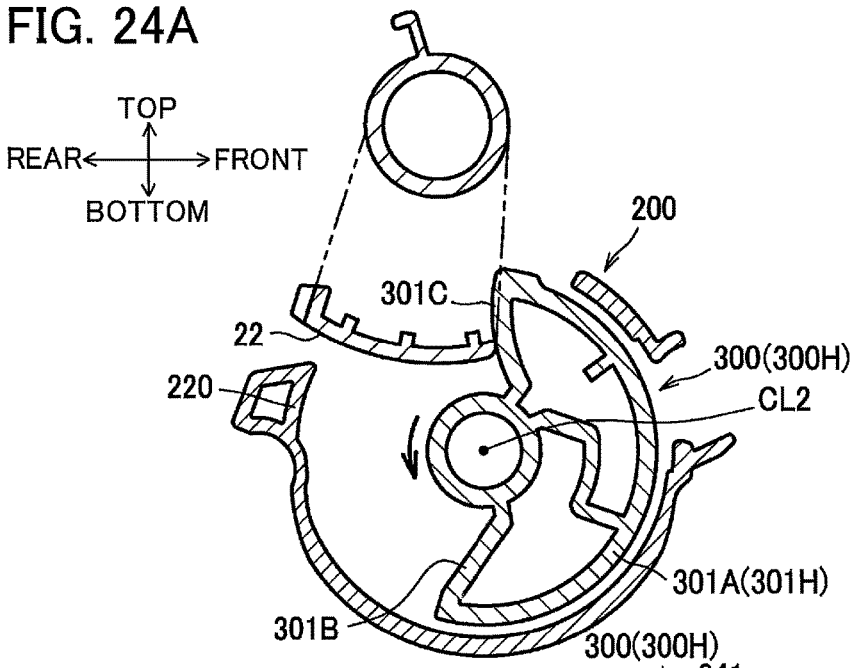
Figure 24B:
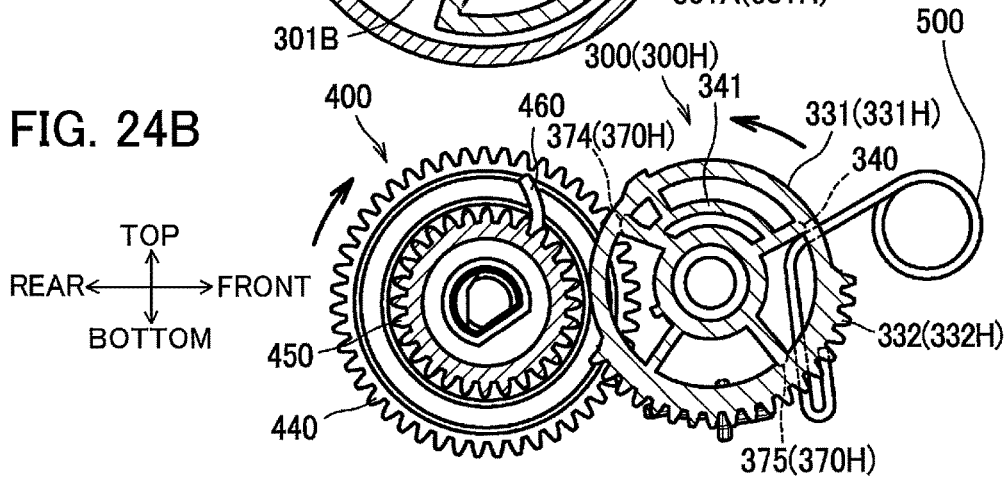
Figure 24C:
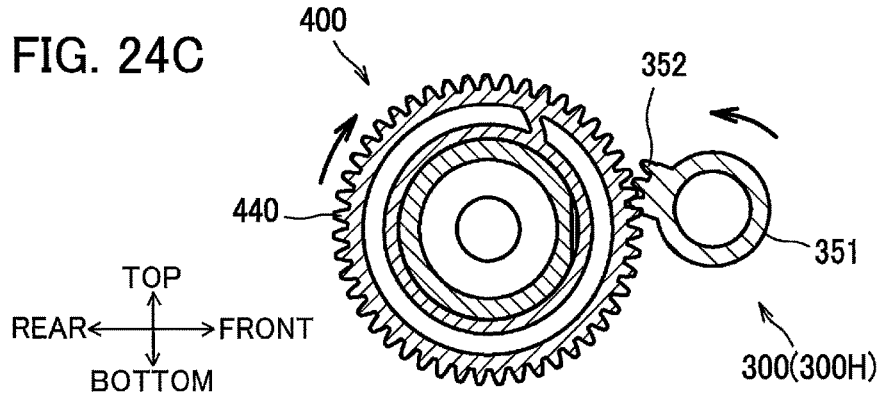

Thereafter, the high-capacity-type detection gear 300H rotates while the torsion spring 500 is in contact with the fourth rib 375 of the high-capacity-type detection gear 300H, as illustrated in FIG. 24B.

Figure 25A:
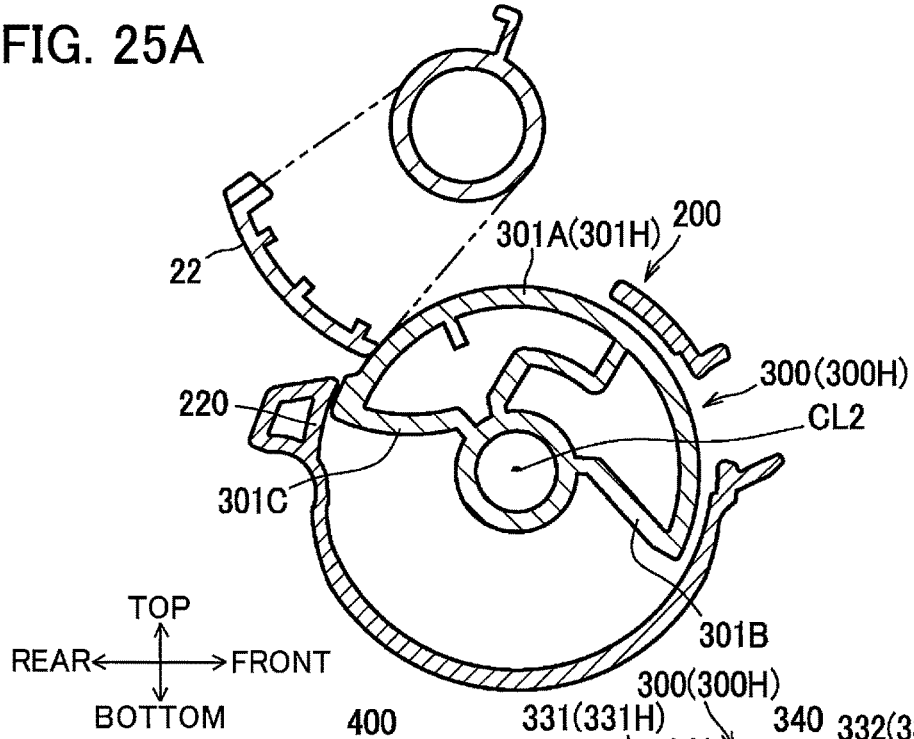
Figure 25B:
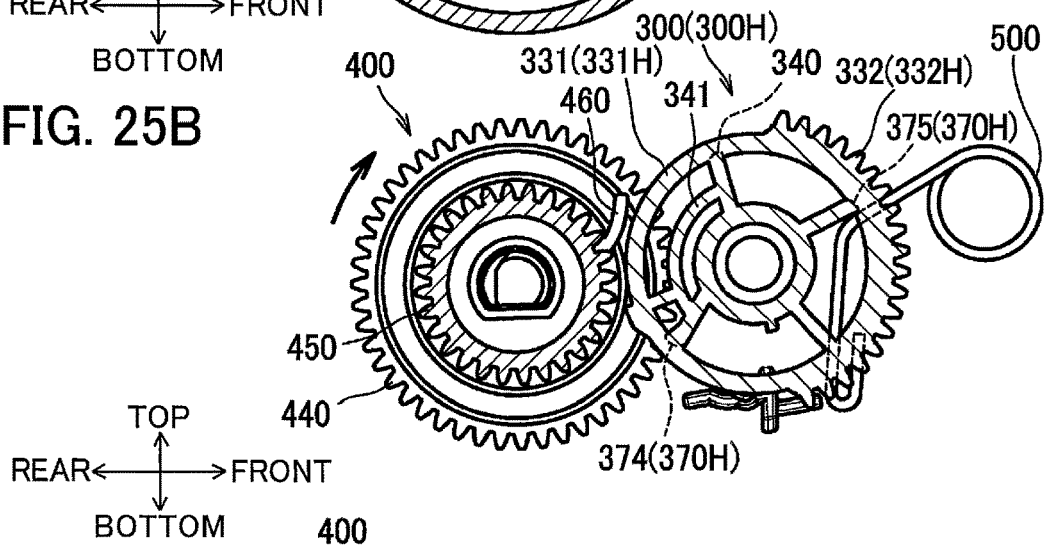
Figure 25C:
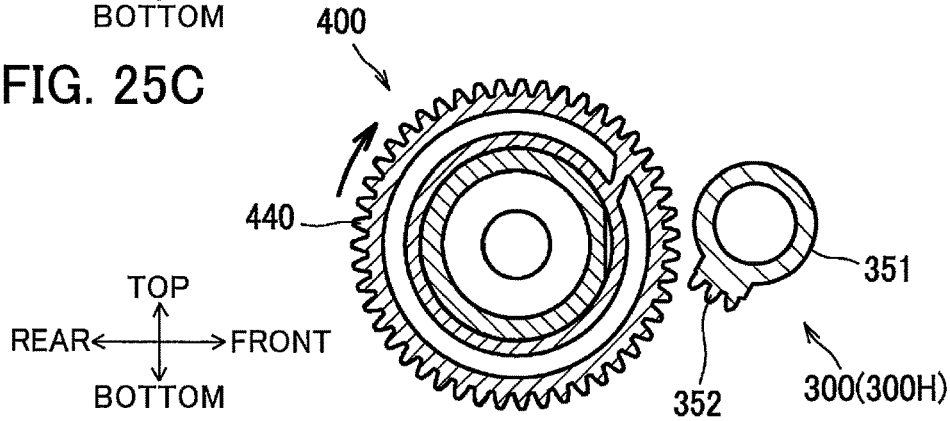

As illustrated in FIG. 25B, the rotation of the high-capacity-type detection gear 300H halts at the final position with the torsion spring 500 contacting the fourth rib 375, urging the high-capacity-type detection gear 300H toward the downstream side in the rotating direction of the high-capacity-type detection gear 300H. Consequently, the first protrusion 381 of the high-capacity-type detection gear 300H is pressed against the movement restricting portion 210 so that the high-capacity-type detection gear 300H is held at the final position, as illustrated in FIG. 13B.

[New Cartridge Determination Process and Specification Identification Process Using Detection Gear 300]

A control device (not illustrated) provided in an image forming apparatus (not illustrated) uses the protrusion 301 to determine whether the developing cartridge 8 is a new cartridge (i.e. a cartridge that is a brand-new and has never been used). The control device of the image forming apparatus also uses the protrusion 301 for identifying specifications of the developing cartridge 8. Hereinafter, new cartridge determination process and specification identification process according to the present embodiment will be described.

When the developing cartridge 8 is a new cartridge, the protrusion 301 is at the initial position illustrated in FIG. 14A (for standard-type developing cartridge 8S) and 20A (for high-capacity type developing cartridge 8H). When a new developing cartridge 8 is attached to an image forming apparatus, the outer circumferential surface 301A of the protrusion 301 can be in contact with the actuator 22 in the image forming apparatus. The actuator 22 is pivotally movably provided in the image forming apparatus. For example, when the detection gear 300 is at the initial position, a first portion 301D of the outer circumferential surface 301A is in contact with the actuator 22 in the image forming apparatus. When the outer circumferential surface 301A of the protrusion 301 is in contact with the actuator 22, the actuator 22 pivotally moves, as illustrated in FIG. 3A. A photosensor (not illustrated) provided in the image forming apparatus detects the pivotal movement of the actuator 22. The control device of the image forming apparatus determines that a developing cartridge 8 has been attached to the image forming apparatus based on a signal detected by the photosensor.

Note that when a developing cartridge 8 is not attached to the image forming apparatus, the actuator 22 is at its normal position between a light-emitting element and a light-receiving element of the photosensor. When a developing cartridge 8 is attached to the image forming apparatus, the protrusion 301 is in contact with the actuator 22, causing the actuator 22 to pivotally move from the normal position to a contact position. While at the contact position, the actuator 22 is not positioned between the light-emitting element and the light-receiving element of the photosensor. Accordingly, the light-receiving element receives light from the light-emitting element, enabling the photosensor to detect an ON signal. When the photosensor detects an ON signal, the control device determines that a developing cartridge 8 has been attached to the image forming apparatus.

When a drive force is subsequently inputted into the developing cartridge 8, the detection gear 300 rotates counterclockwise, as illustrated in FIG. 15A (for standard-type developing cartridge 8S) and 21A (for high-capacity type developing cartridge 8H). The protrusion 301 rotates counterclockwise together with the detection gear 300. When the detection gear 300 further rotates, the protrusion 301 separates from the actuator 22, as illustrated in FIGS. 16A and 17A (for standard-type developing cartridge 8S) and FIGS. 22A and 23A (for high-capacity type developing cartridge 8H). Next, the actuator 22 returns to its normal position illustrated in FIG. 17A (for standard-type developing cartridge 8S) and 22A (for high-capacity type developing cartridge 8H), causing the photosensor to detect an OFF signal.

Subsequently, the second extension wall 301C of the protrusion 301 comes into contact with the actuator 22 again, as illustrated in FIG. 18A (for standard-type developing cartridge 8S) and 24A (for high-capacity type developing cartridge 8H). Thereafter, the outer circumferential surface 301A of the protrusion 301 is in contact with the actuator 22, as illustrated in FIG. 19A (for standard-type developing cartridge 8S) and 25A (for high-capacity type developing cartridge 8H), and the photosensor once again detects an ON signal.

Specifically, as the detection gear 300 moves from the position illustrated in FIG. 17A (for standard-type developing cartridge 8S) and 23A (for high-capacity type developing cartridge 8H) to the position illustrated in FIG. 18A (for standard-type developing cartridge 8S) and 24A (for high-capacity type developing cartridge 8H), the first gear portion 332 disengages from the small-diameter gear portion 450 and the second gear portion 352 becomes engaged with the large-diameter gear portion 440. More specifically, as the detection gear 300 moves from the position illustrated in FIG. 17A (for standard-type developing cartridge 8S) and 23A (for high-capacity type developing cartridge 8H) to the position illustrated in FIG. 18A (for standard-type developing cartridge 8S) and 24A (for high-capacity type developing cartridge 8H), the small-diameter gear portion 450 and the first gear portion 332 become unmeshed from each other and the large-diameter gear portion 440 and the second gear portion 352 become meshed with each other. Then, the second gear portion 352 rotates in accordance with the rotation of the large-diameter gear portion 440 and the detection gear 300 rotates together with the second gear portion 352. The second gear portion 352 is positioned closer than the first gear portion 332 to the second axis CL2.

Accordingly, the rotational speed of the detection gear 300 when the second gear portion 352 is meshed with the large-diameter gear portion 440 is faster than the rotational speed of the detection gear 300 when the first gear portion 332 is meshed with the small-diameter gear portion 450. Thus, the rotational speed of the detection gear 300 increases when the meshed state of the transmission gear 400 and the detection gear 300 shifts from the small-diameter gear portion 450 being meshed with the first gear portion 332 to the large-diameter gear portion 440 being meshed with the second gear portion 352. Hence, the detection gear 300 can supply a new signal to the image forming apparatus. In this way, the detection gear 300 having a new configuration can be provided. In addition, the developing cartridge 8 that includes the detection gear 300 having a new configuration can be provided.

Specifically, the detection gear 300 is capable of supplying a new signal to the image forming apparatus by changing its rotational speed. More specifically, since the change in rotational speed of the detection gear 300 can alter the timing at which the protrusion 301 is in contact with the actuator 22, the image forming apparatus can perform new cartridge determination process and specification identification process using the new signal of the detection gear 300. That is, when the detection gear 300 is at the final position, a second portion 301E of the outer circumferential surface 301A is in contact with the actuator 22 in the image forming apparatus, as illustrated in FIG. 19A (for standard-type developing cartridge 8S) and 25A (for high-capacity type developing cartridge 8H). In this way, when the photosensor detects the sequence of signals, an ON signal, an OFF signal, and an ON signal in this order, after a drive force is inputted into the developing cartridge 8, the control device determines that the attached developing cartridge 8 is a new cartridge.

Further, when the protrusion 301 is at the final position, the detection gear 300 is disengaged from the transmission gear 400, thereby maintaining the protrusion 301 at the final position. Accordingly, when a developing cartridge 8 having its protrusion 301 at the final position is attached to an image forming apparatus, the outer circumferential surface 301A of the protrusion 301 is in contact with the actuator 22, and the photosensor detects an ON signal. Since the protrusion 301 does not move out of the final position thereafter, even when the developing cartridge 8 receives a drive force, the photosensor only detects an ON signal. In this case, the control device in the image forming apparatus determines that the developing cartridge 8 attached to the image forming apparatus is an old cartridge (a cartridge that has been used at least once).

Further, a length from the first extension wall 301B to the second extension wall 301C in the rotating direction of the detection gear 300 is determined according to the specification of the developing cartridge 8. In other words, a length of the outer circumferential surface 301A in the rotating direction of the detection gear 300 is determined according to the specification of the developing cartridge 8. Thus, when the photosensor detects an OFF signal for a first time duration, the control device determines that the attached developing cartridge 8 is a standard-type developing cartridge 8S, for example. The casing 100 of the standard-type developing cartridge 8S accommodates a standard amount of developer. Alternatively, when an OFF signal is detected for a second time duration longer than the first time duration, the control device determines that the mounted developing cartridge 8 is a high-capacity-type developing cartridge 8H. The casing 100 of the high-capacity-type developing cartridge 8H accommodates a greater amount of developer than the standard amount.

Specifically, the length of the outer circumferential surface 301A in the rotating direction of the standard-type detection gear 300S is a first length illustrated in FIG. 4A, for example. In other words, an angle between a line segment L1 connecting the first end portion A1 of the outer circumferential surface 301A of the standard-type detection gear 300S and the second axis CL2 and a line segment L2 connecting the second end portion A2 of the outer circumferential surface 301A of the standard-type detection gear 300S and the second axis CL2 is a first angle θ1. The first angle θ1 may be in the range from 97° to 99°, for example. In other words, the angle θ1 may be not smaller than 97° and not greater than 99°. In the present embodiment, θ1 is 98°.

Figure 5A:
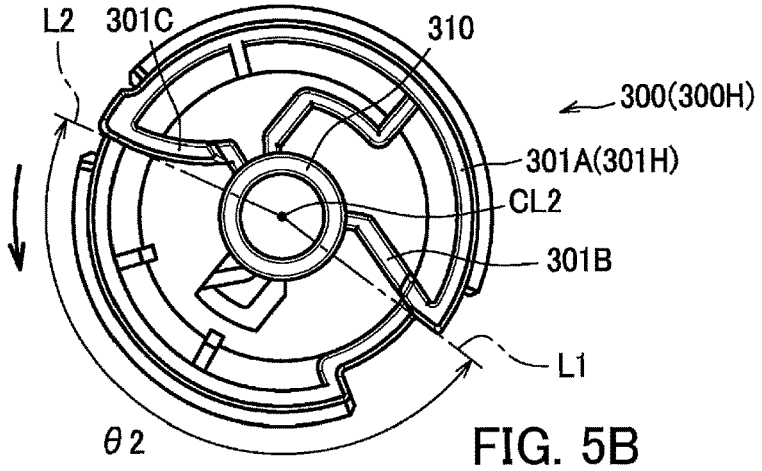
FIG. 5A is a left side view of a high-capacity-type detection gear 300H.
Figure 5B:
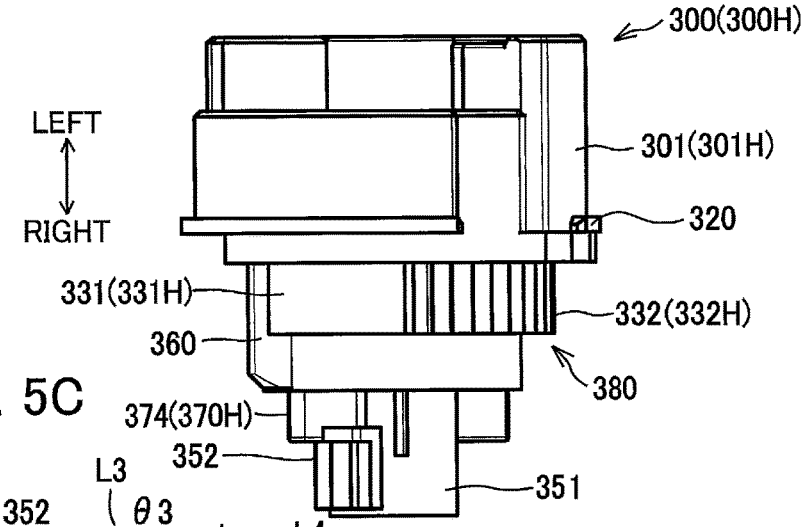
FIG. 5B is a top plan view of the high-capacity-type detection gear 300H.
Figure 5C:
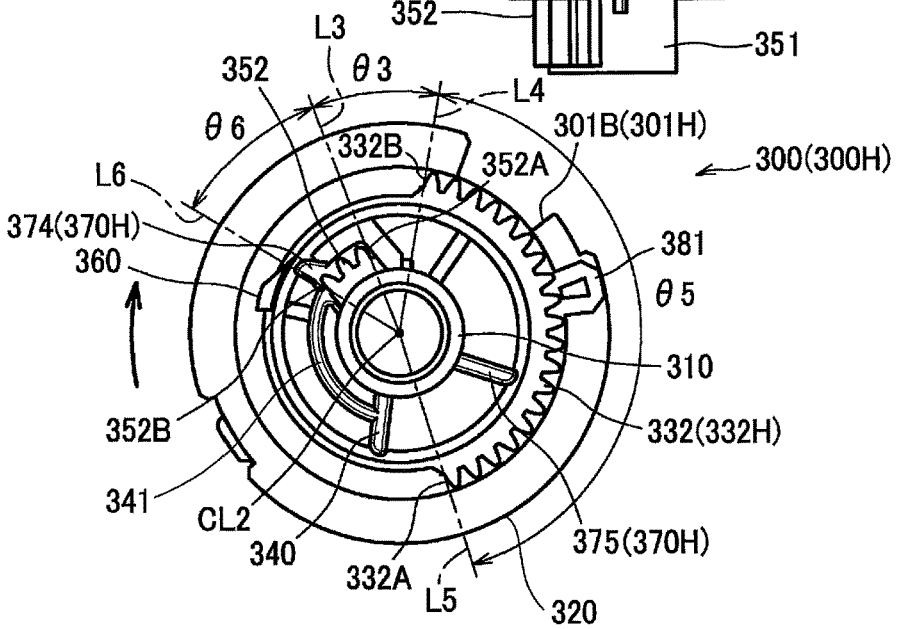
FIG. 5C is a right side view of the high-capacity-type detection gear 300H.

In contrast, the length of the outer circumferential surface 301A in the rotating direction of the high-capacity-type detection gear 300H illustrated in FIG. 5A is a second length longer than the first length. In other words, a second angle θ2 between the line segment L1 and the line segment L2 of the high-capacity-type detection gear 300H is greater than the first angle θ1. The second angle θ2 may be in the range from 188° to 190°, for example. In other words, the angle θ2 may be not smaller than 188° and not greater than 190°. In the present embodiment, θ2 is 189°.

Note that the length of the outer circumferential surface 301A in the rotating direction of the high-capacity-type detection gear 300H may have the first length. In this case, the length of the outer circumferential surface 301A in the rotating direction of the standard-type detection gear 300S has the second length.

[Modifications]

Various modifications and variations are conceivable as described below.

In the above embodiment, the developing cartridge 8 including the developing roller 81 is provided with the detection gear 300. However, a toner cartridge that does not include a developing roller may be provided in a laser printer. The toner cartridge includes a toner-accommodating portion for accommodating toner.

Figure 27:
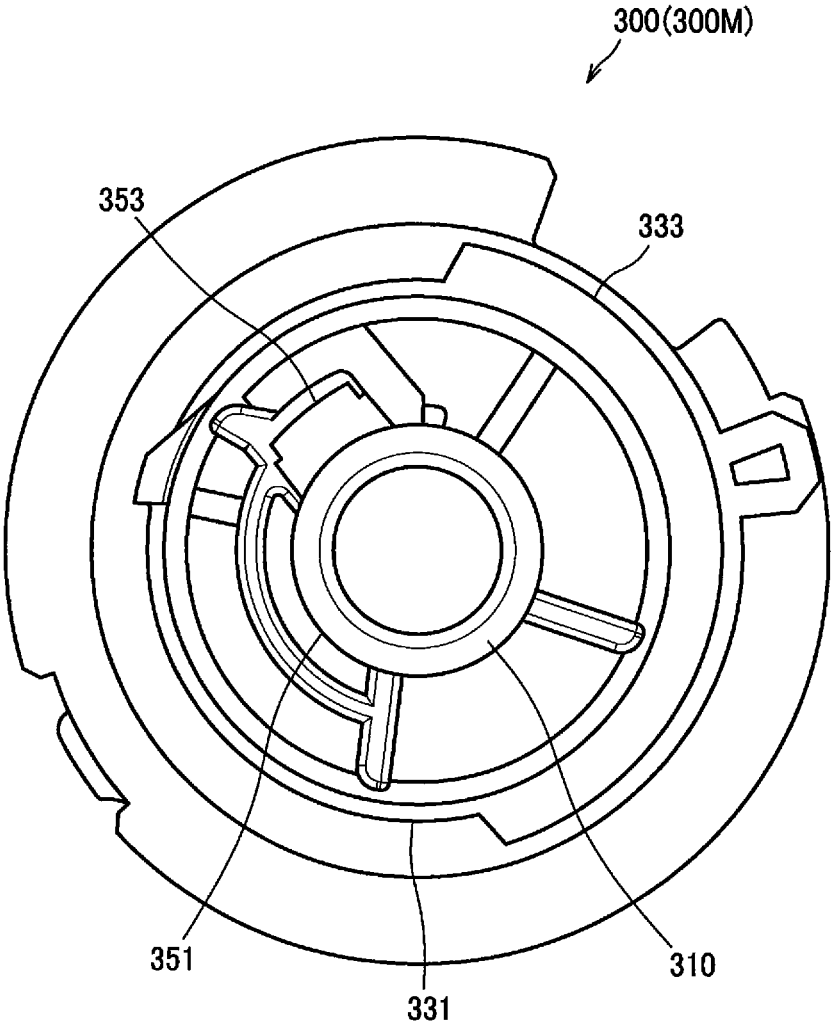
FIG. 27 is a view illustrating a detection gear 300M according to a modification of the embodiment.

In the above embodiment, the first gear portion 332 includes a plurality of gear teeth, and the second gear portion 352 also includes a plurality of gear teeth. However, a friction member formed of a rubber or a sponge may be provided in place of the plurality of gear teeth. Specifically, as illustrated in FIG. 27, a first friction member 333 provided at a detection gear 300M may be a rubber or a sponge in place of the first gear portion 332, for example. The first friction member 333 may engage with the small-diameter gear portion 450 through friction. The first friction member 333 may be provided along a portion of the circumferential surface of the cylindrical portion 380.

The first friction member 333 may engage with the small-diameter gear portion 450 through friction. Further, the detection gear 300M may rotate by friction between the first friction member 333 and the small-diameter gear portion 450.

Further, a second friction member 353 provided at the detection gear 300M may be a rubber or a sponge in place of the second gear portion 352. The second friction member 353 may engage with the large-diameter gear portion 440 through friction. The second friction member 353 may be provided along a portion of the circumferential surface of the rotational shaft portion 310.

The second friction member 353 may engage with the large-diameter gear portion 440 through friction. Further, the detection gear 300M may rotate by friction between the second friction member 353 and the large-diameter gear portion 440.

Further, the friction members described above may be provided at the transmission gear 400 in place of the plurality of gear teeth of the large-diameter gear portion 440 and the plurality of gear teeth of the small-diameter gear portion 450.

Note that the first gear portion 332 and the first friction member 333 are one example of a first engaging portion. Further, the second gear portion 352 and the second friction member 353 are one example of a second engaging portion.

In the above embodiment, the protrusion 301 is integrally formed in the detection gear 300. However, the protrusion 301 may be a separate component from the detection gear 300. The protrusion 301 may rotate together with the detection gear 300. The protrusion 301 may be a resinous film or a rubber plate, for example.

In the above embodiment, the detection gear 300 includes a single protrusion 301. However, the protrusion 301 may be configured of a plurality of protrusions spaced apart from each other in the rotating direction of the detection gear 300.

In the above embodiment, the cap 150 includes the boss 155, and the detection gear 300 is rotatably supported at the boss 155. However, the boss 155 may be provided at a separate component from the cap 150. In this case, the separate component may be attached to the first outer surface 100A, and the detection gear 300 may be rotatably supported at the boss 155. In this case, the fill hole 84A may be formed in the second outer surface of the casing 100.

In the above embodiment, the boss 155 protrudes from the cap 150. However, the boss 155 may protrude from the first outer surface 100A.

While the torsion spring 500 is used in the above embodiment. However, a coil spring, a leaf spring, an elastic resin, or other member may be used in place of the torsion spring 500.

In the above embodiment, a through-hole is formed in the rotational shaft portion 310. However, any hole into which the boss 155 may be inserted may be formed in the rotational shaft portion 310, and the boss 155 need not penetrate the rotational shaft portion 310 entirely. Further, one or more gear teeth may be provided in place of the first toothless portion 331. However, the one or more gear teeth need not engage with the small-diameter gear portion 450 in this case. One or more gear teeth may also be provided in place of the second toothless portion 351, but the one or more gear teeth need not engage with the large-diameter gear portion 440.

Further, the detection gear 300 meshes with the transmission gear 400 mounted to the shaft 85A of the agitator 85. However, the detection gear 300 may mesh with a gear other than the transmission gear 400 mounted to the shaft 85A of the agitator 85.

Further, the second extension wall 301C need not be connected with the rotational shaft portion 310. Further, the second extension wall 301C may be configured of a plurality of bosses.

While the description has been made in detail with reference to the embodiments thereof, it would be apparent to those skilled in the art that many modifications and variations may be made therein without departing from the scope of the disclosure.

What is claimed is:

1. A developing cartridge comprising:

a casing configured to accommodate a developer therein;

a first gear rotatable about a first axis extending in an axial direction, the first gear comprising:

a small-diameter gear portion; and a large-diameter gear portion having a diameter greater than a diameter of the small-diameter gear portion; and a second gear rotatable about a second axis extending in the axial direction, the second gear comprising:

a first columnar portion extending in the axial direction, the first columnar portion being centered on the second axis;

a second columnar portion centered on the second axis, the second columnar portion extending in the axial direction, the second columnar portion having a diameter smaller than a diameter of the first columnar portion;

a first engaging portion provided along a portion of a circumferential surface of the first columnar portion, the first engaging portion being engageable with the small-diameter gear portion;

a second engaging portion provided along a portion of a circumferential surface of the second columnar portion, the second engaging portion being positioned closer to the casing than the first engaging portion to the casing in the axial direction, the second engaging portion being engageable with the large-diameter gear portion; and a protrusion protruding in the axial direction, the protrusion being rotatable together with the first engaging portion and the second engaging portion, wherein the second engaging portion is engageable with the large-diameter gear portion after the first engaging portion has engaged with the small-diameter gear portion.

2. The developing cartridge according to claim 1, wherein the first engaging portion comprises a plurality of gear teeth provided on the portion of the circumferential surface of the first columnar portion, the plurality of gear teeth of the first engaging portion being meshable with the small-diameter gear portion, and wherein the second engaging portion comprises a plurality of gear teeth provided on the portion of the circumferential surface of the second columnar portion, the plurality of gear teeth of the second engaging portion being meshable with the large-diameter gear portion.

3. The developing cartridge according to claim 1, wherein the first engaging portion comprises a friction member provided along the portion of the circumferential surface of the first columnar portion.

4. The developing cartridge according to claim 3, wherein the friction member of the first engaging portion is a rubber.

5. The developing cartridge according to claim 3, wherein the second engaging portion comprises a friction member provided along the portion of the circumferential surface of the second columnar portion.

6. The developing cartridge according to claim 5, wherein the friction member of the second engaging portion is a rubber.

7. The developing cartridge according to claim 1, further comprising an agitator configured to agitate the developer accommodated in the casing, wherein the first gear is supported by a shaft of the agitator.

8. The developing cartridge according to claim 1, wherein the small-diameter gear portion and the large-diameter gear portion are rotatable about the first axis.

9. The developing cartridge according to claim 1, wherein the second gear further comprises a flange positioned separated farther from the casing than the first engaging portion from the casing, the flange being rotatable about the second axis, the flange having a first surface facing the casing and a second surface opposite to the first surface, and wherein the protrusion protrudes from the second surface of the flange.

10. The developing cartridge according to claim 1, wherein the first columnar portion has a cylindrical shape extending in the axial direction.

11. The developing cartridge according to claim 1, wherein a distance in the axial direction between an outer surface of the casing and the large-diameter gear portion is smaller than a distance in the axial direction between the outer surface of the casing and the small-diameter gear portion.

12. The developing cartridge according to claim 1, wherein the second columnar portion of the second gear is rotatably supported by a boss positioned at an outer surface of the casing and extending in the axial direction.

13. The developing cartridge according to claim 12, wherein the boss is a separate member from the casing.

14. The developing cartridge according to claim 13, wherein the casing has a fill hole for filling the casing with developer, the developing cartridge further comprising a cap for closing the fill hole, and wherein the boss is provided at the cap.

15. The developing cartridge according to claim 12, wherein the boss protrudes from the outer surface of the casing.

16. The developing cartridge according to claim 1, further comprising a spring configured to be in contact with the second gear to urge the second gear in a rotating direction of the second gear until the second engaging portion becomes engaged with the large-diameter gear portion after the first engaging portion is engaged with the small-diameter gear portion.

17. The developing cartridge according to claim 16, wherein the spring is in contact with the second gear at a position between the first engaging portion and the second engaging portion in the axial direction.

18. The developing cartridge according to claim 7, wherein the spring is a torsion coil spring.

19. The developing cartridge according to claim 18, wherein the casing has a fill hole through which developer is accommodated in the casing, the developing cartridge further comprising a cap for closing the fill hole, and wherein the spring includes one end portion which is, in contact with the cap and another end portion which is in contact with the second gear.

20. The developing cartridge according to claim 19, wherein the spring comprises a first arm including the one end portion and a second arm including the another end portion, and wherein the first arm and the second arm extend so as to cross each other.

21. The developing cartridge according to claim 1, wherein the protrusion of the second gear has an arcuate shape extending in a rotating direction of the second gear, the protrusion including:

a first end at one end in the rotating direction;

a second end at an opposite end from the first end in the rotating direction; and an extension portion extending from the second end toward the second axis.

22. The developing cartridge according to claim 21, wherein the extension portion is curved.

23. The developing cartridge according to claim 22, wherein the extension portion is connected to the second columnar portion.

24. The developing cartridge according to claim 21, wherein an angle between a line segment connecting the first end and the second axis and a line segment connecting the second end and the second axis is not smaller than 188 degrees and not greater than 190 degrees.

25. The developing cartridge according to claim 21, wherein an angle between a line segment connecting the first end and the second axis and a line segment connecting the second end and the second axis is not smaller than 97 degrees and not greater than 99 degrees.

26. The developing cartridge according to claim 16, wherein the first gear further comprises a first rib extending in a radial direction of the first gear, the first rib being rotatable together with the first gear, wherein the second gear comprises a second rib extending in a radial direction of the second gear, the second rib being rotatable together with the second gear, and wherein, in a state where the second rib is positioned inside a locus of the first rib, the second gear moves from a first position where the first engaging portion is positioned outside a locus of the small-diameter gear portion to a second position where the first engaging portion is engaged with the small-diameter gear portion after the first rib has engaged with the second rib in accordance with rotation of the first gear.

27. The developing cartridge according to claim 26, wherein the second gear moves from the second position to a third position where the second engaging portion is engaged with the large-diameter gear portion, and further moves from the third position to a fourth position where the second engaging portion is positioned outside a locus of the large-diameter gear portion.

28. The developing cartridge according to claim 27, wherein the second gear further comprises a third rib protruding outward in the radial direction of the second gear from a circumferential surface of the second gear, and wherein the spring urges the third rib in a direction opposite to the rotating direction in a state where the second gear is at the first position.

29. The developing cartridge according to claim 28, wherein the casing includes a restricting portion extending in the axial direction, the restricting portion being configured to be in contact with the second gear to restrict movement of the second gear in the direction opposite to the rotating direction in a state where the third rib is urged by the spring.

30. The developing cartridge according to claim 28, wherein the third rib is provided at the circumferential surface of the second columnar portion.

31. The developing cartridge according to claim 27, wherein the second gear further comprises a fourth rib protruding outward in the radial direction of the second gear from a circumferential surface of the second gear, and wherein the spring urges the fourth rib in the rotating direction in a state where the second gear is at a prescribed position between the second position and the third position.

32. The developing cartridge according to claim 31, wherein the fourth rib is provided at the circumferential surface of the second columnar portion.

33. The developing cartridge according to claim 31, wherein the third rib and the fourth rib are positioned between the first engaging portion and the second engaging portion in the axial direction.

34. The developing cartridge according to claim 27, wherein the second rib is provided at the circumferential surface of the second columnar portion.

35. The developing cartridge according to claim 27, wherein the protrusion includes:

a first portion configured to be in contact with a portion of an image forming apparatus when the second gear is at the first position; and a second portion configured to be in contact with a portion of the image forming apparatus when the second gear is at the fourth position.

36. The developing cartridge according to claim 1, wherein the first engaging portion includes a third end at one end in a rotating direction of the second gear and a fourth end at an opposite end from the third end in the rotating direction, wherein the second engaging portion includes a fifth end at one end in the rotating direction and a sixth end at an opposite end from the fifth end in the rotating direction, wherein the fifth end is positioned closer to the fourth end than the sixth end to the fourth end in the rotating direction, and wherein an angle between a line segment connecting the fourth end and the second axis and a line segment connecting the fifth end and the second axis is not smaller than 35 degrees and not greater than 41 degrees.

37. The developing cartridge according to claim 36, wherein an angle between the line segment connecting the fifth end and the second axis and a line segment connecting the sixth end and the second axis is not smaller than 28 degrees and not greater than 32 degrees.

38. The developing cartridge according to claim 36, wherein an angle between a line segment connecting the third end and the second axis and the line segment connecting the fourth end and the second axis is not smaller than 146 degrees and not greater than 150 degrees.

39. The developing cartridge according to claim 36, wherein an angle between a line segment connecting the third end and the second axis and the line segment connecting the fourth end and the second axis is not smaller than 73 degrees and not greater than 78 degrees.

40. The developing cartridge according to claim 1, further comprising a developing roller extending in the axial direction.

41. A developing cartridge comprising:

a casing configured to accommodate a developer therein;

a first gear rotatable about a first axis extending in an axial direction, the first gear comprising:

a small-diameter gear portion; and a large-diameter gear portion having a diameter greater than a diameter of the small-diameter gear portion; and a second gear rotatable about a second axis extending in the axial direction, the second gear comprising:

a first engaging portion provided along a first portion of a circumferential surface of the second gear, the first engaging portion being engageable with the small-diameter gear portion;

a second engaging portion positioned closer to the casing than the first engaging portion to the casing in the axial direction, the second engaging portion being provided along a second portion of the circumferential surface of the second gear, the second engaging portion being provided at a position different from the first engaging portion in a rotating direction of the second gear, the second engaging portion being engageable with the large-diameter gear portion after the first engaging portion has engaged with the small-diameter gear portion; and a protrusion protruding in the axial direction, the protrusion being rotatable together with the first engaging portion and the second engaging portion, wherein a locus defined by rotation of the second engaging portion is smaller than a locus defined by rotation of the first engaging portion.

42. The developing cartridge according to claim 41, wherein the first engaging portion comprises a plurality of gear teeth provided on the first portion of the circumferential surface of the second gear, the plurality of gear teeth of the first engaging portion being engageable with the small-diameter gear portion, and wherein the second engaging portion comprises a plurality of gear teeth provided on the second portion of the circumferential surface of the second gear, the plurality of gear teeth of the second engaging portion being engageable with the large-diameter gear portion.

43. The developing cartridge according to claim 41, wherein the first engaging portion comprises a friction member engageable with the small-diameter gear portion through friction.

44. The developing cartridge according to claim 43, wherein the friction member of the first engaging portion is a rubber.

45. The developing cartridge according to claim 43, wherein the second engaging portion comprises a friction member engageable with the large-diameter gear portion through friction.

46. The developing cartridge according to claim 45, wherein the friction member of the second engaging portion is a rubber.

47. The developing cartridge according to claim 41, further comprising an agitator configured to agitate the developer accommodated in the casing, wherein the first gear is supported by a shaft of the agitator.

48. The developing cartridge according to claim 41, wherein the small-diameter gear portion and the large-diameter gear portion are rotatable about the first axis.

49. The developing cartridge according to claim 41, wherein the second gear further comprises a flange positioned separated farther from the casing than the first engaging portion from the casing, the flange being rotatable about the second axis, the flange having a first surface facing the casing an a second surface opposite to the first surface, and wherein the protrusion protrudes from the second surface of the flange.

50. The developing cartridge according to claim 41, wherein the second gear further comprises a first columnar portion having a cylindrical shape extending in the axial direction and centered on the second axis, and wherein the first engaging portion extends along a portion of a circumferential surface of the first columnar portion.

51. The developing cartridge according to claim 41, wherein a distance in the axial direction between an outer surface of the casing and the large-diameter gear portion is smaller than a distance in the axial direction between the outer surface of the casing and the small-diameter gear portion.

52. The developing cartridge according to claim 50, wherein the second gear further comprises a second columnar portion centered on the second axis and extending in the axial direction, the second columnar portion having a diameter smaller than a diameter of the first columnar portion, and wherein the second columnar portion is rotatably supported by a boss positioned at an outer surface of the casing and extending in the axial direction.

53. The developing cartridge according to claim 52, wherein the boss is a separate member from the casing.

54. The developing cartridge, according to claim 53, wherein the casing has a fill hole for filling the casing with developer, the developing cartridge further comprising a cap for closing the fill hole, and wherein the cap includes the boss.

55. The developing cartridge according to claim 52, wherein the boss protrudes from the outer surface of the casing.

56. The developing cartridge according to claim 52, further comprising a spring configured to be in contact with the second gear to urge the second gear in the rotating direction until the second engaging portion becomes engaged with the large-diameter gear portion after the first engaging portion is engaged with the small-diameter gear portion.

57. The developing cartridge according to claim 56, wherein the spring is in contact with the second gear at a position between the first engaging portion and the second engaging portion in the axial direction.

58. The developing cartridge according to claim 57, wherein the spring is a torsion coil spring.

59. The developing cartridge according to claim 58, wherein the casing has a fill hole through which developer is accommodated in the casing, the developing cartridge further comprising a cap for closing the fill hole, and wherein the spring includes one end portion which is in contact with the cap and another end portion which is in contact with the second gear.

60. The developing cartridge according to claim 59, wherein the spring comprises a first arm including the one end portion and a second arm including the another end portion, and wherein the first arm and the second arm extend so as to cross each other.

61. The developing cartridge according to claim 52, wherein the protrusion of the second gear has an arcuate shape extending in the rotating direction, the protrusion including:

a first end at one end in the rotating direction;

a second end at an opposite end from the first end in the rotating direction; and an extension portion extending from the second end toward the second axis.

62. The developing cartridge according to claim 61, wherein the extension portion is curved.

63. The developing cartridge according to claim 61, wherein the extension portion is connected to the second columnar portion.

64. The developing cartridge according to claim 61, wherein an angle between a line segment connecting the first end and the second axis and a line segment connecting the second end and the second axis is not smaller than 188 degrees and not greater than 190 degrees.

65. The developing cartridge according to claim 61, wherein an angle between a line segment connecting the first end and the second axis and a line segment connecting the second end and the second axis is not smaller than 97 degrees and not greater than 99 degrees.

66. The developing cartridge according to claim 52, wherein the first gear further comprises a first rib extending in a radial direction of the first gear, the first rib being rotatable together with the first gear, wherein the second gear comprises a second rib extending in a radial direction of the second gear, the second rib being rotatable together with the second gear, and wherein, in a state where the second rib is positioned on a locus of the first rib, the second gear moves from a first position where the first engaging portion being positioned outside a locus of the small-diameter gear portion to a second position where the first engaging portion is engaged with the small-diameter gear portion after the first rib has engaged with the second rib in accordance with rotation of the first gear.

67. The developing cartridge according to claim 66, wherein the second gear moves from the second position to a third position where the second engaging portion is engaged with the large-diameter gear portion, and further moves from the third position to a fourth position where the second engaging portion is positioned outside a locus of the large-diameter gear portion.

68. The developing cartridge according to claim 67, wherein the second gear further comprises a third rib protruding outward in the radial direction of the second gear from a circumferential surface of the second gear, and wherein the spring urges the third rib in a direction opposite to the rotating direction in a state where the second gear is at the first position.

69. The developing cartridge according to claim 68, wherein the casing includes a restricting portion extending in the axial direction, the restricting portion being configured to be in contact with the second gear to restrict movement of the second gear in the direction opposite to the rotating direction in a state where the third rib is urged by the spring.

70. The developing cartridge according to claim 68, wherein the third rib is provided at a circumferential surface of the second columnar portion.

71. The developing cartridge according to claim 68, wherein the second gear further comprises a fourth rib protruding outward in the radial direction of the second gear from a circumferential surface of the second gear, and wherein the spring urges the fourth rib in the rotating direction in a state where the second gear is prescribed position between the second position and the third position.

72. The developing cartridge according to claim 71, wherein the fourth rib is provided at a circumferential surface of the second columnar portion.

73. The developing cartridge according to claim 71, wherein the third rib and the fourth rib are positioned between the first engaging portion and the second engaging portion in the axial direction.

74. The developing cartridge according to claim 67, wherein the second rib is provided at a circumferential surface of the second columnar portion.

75. The developing cartridge according to claim 67, wherein the protrusion includes:

a first portion configured to be in contact with a portion of an image forming apparatus when the second gear is at the first position; and a second portion configured to be in contact with a portion of the image forming apparatus when the second gear is at the fourth position.

76. The developing cartridge according to claim 41, wherein the first engaging portion includes a third end at one end in the rotating direction and a fourth end at an apposite end from the third end in the rotating direction, wherein the second engaging portion includes a fifth end at one end in the rotating direction and a sixth end at an opposite end from the fifth end in the rotating direction, wherein the fifth end is positioned closer to the fourth end in the rotating direction than the sixth end to the fourth end in the rotating direction, and wherein an angle between a line segment connecting the fourth end and the second axis and a line segment connecting the fifth end and the second axis is not smaller than 35 degrees and not greater than 41 degrees.

77. The developing cartridge according to claim 76, wherein an angle between the line segment connecting the fifth end and the second axis and a line segment connecting the sixth end and the second axis is not smaller than 28 degrees and not greater than 32 degrees.

78. The developing cartridge according to claim 76, wherein an angle between a line segment connecting the third end and the second axis and the line segment connecting the fourth end and the second axis is not smaller than 146 degrees and not greater than 150 degrees.

79. The developing cartridge according to claim 76, wherein an angle between a line segment connecting the third end and the second axis and the line segment connecting the fourth end and the second axis is not smaller than 73 degrees and not greater than 78 degrees.

80. The developing cartridge according to claim 41, further comprising a developing roller extending in the axial direction.

81. A detection gear rotatable about an axis extending in an axial direction, the detection gear comprising:

a protrusion extending in the axial direction and having an outer surface extending along a portion of a circumference of the detection gear;

a first engaging portion extending along a first portion of the circumference of the detection gear, the first engaging portion being positioned closer to the axis than the outer surface to the axis in a radial direction of the detection gear; and a second engaging portion extending along a second portion of the circumference of the detection gear, the second portion being different from the first portion, the second engaging portion being positioned closer to the axis than the first engaging portion to the axis in the radial direction.

82. The detection gear according to claim 81, wherein the second engaging portion is positioned at an opposite side of the outer surface with respect to the first engaging portion in the axial direction.

83. The detection gear according to claim 82, further comprising:

a first cylindrical portion having a first diameter; and a second cylindrical portion having a second diameter smaller than the first diameter, wherein the first engaging portion extends along a portion of a circumferential surface of the first cylindrical portion in a rotating direction of the detection gear, and wherein the second engaging portion extends along a portion of a circumferential surface of the second cylindrical portion in the rotating direction.

84. The detection gear according to claim 83, wherein the second cylindrical portion is positioned at an opposite side of the outer surface with respect to the first cylindrical portion in the axial direction.

85. The detection gear according to claim 84, wherein the protrusion protrudes from the first cylindrical portion in the axial direction.

86. The detection gear according to claim 81, wherein a length of the first engaging portion in a rotating direction of the detection gear is greater than a length of the second engaging portion in the rotating direction.

87. The detection gear according to claim 81, wherein the second engaging portion is spaced apart from the first engaging portion in a rotating direction of the detection gear.

88. The detection gear according to claim 87, wherein the first engaging portion includes a first end at one end in the rotating direction and a second end separated from the first end in the rotating direction, wherein the second end is positioned closer to the second engaging portion than the first end to the second engaging portion in the rotating direction, wherein the second engaging portion includes a third end at one end in the rotating direction and a fourth end separated from the third end in the rotating direction, wherein the third end is positioned closer to the first engaging portion than the fourth end to the first engaging portion in the rotating direction, and wherein the second end and the third end are spaced apart from each other in the rotating direction.

89. The detection gear according to claim 81, wherein the first engaging portion comprises a plurality of gear teeth provided along the first portion.

90. The detection gear according to claim 81, wherein the second engaging portion comprises a plurality of gear teeth provided along the second portion.

91. The detection gear according to claim 81, wherein the first engaging portion comprises a plurality of gear teeth provided along the first portion, wherein the second engaging portion comprises a plurality of gear teeth provided along the second portion, and wherein numbers of the plurality of gear teeth of the first engaging portion are greater than numbers of the plurality of gear teeth of the second engaging portion.

92. The detection gear according to claim 81, wherein the first engaging portion comprise a friction member provided along the first portion.

93. The detection gear according to claim 92, wherein the friction member of the first engaging portion is a rubber.

94. The detection gear according to claim 81, wherein the second engaging portion comprises a friction member provided along the second portion.

95. The detection gear according to claim 94, wherein the friction member of the second engaging portion is a rubber.

96. A developing cartridge comprising: a detection gear rotatable about a first axis extending in an axial direction, the detection gear comprising:

a protrusion extending in the axial direction and having an outer surface extending along a portion of a circumference of the detection gear;

a first engaging portion extending along a first portion of the circumference of the detection gear, the first engaging portion being positioned closer to the first axis than the outer surface to the first axis in a radial direction of the detection gear; and a second engaging portion extending along a second portion of the circumference of the detection gear, the second portion being different from the first portion, the second engaging portion being positioned closer to the first axis than the first engaging portion to the axis in the radial direction.

97. The developing cartridge according to claim 96, wherein the second engaging portion is positioned at an opposite side of the outer surface with respect to the first engaging portion in the axial direction.

98. The developing cartridge according to claim 97, wherein the detection gear further comprises:

a first cylindrical portion having a first diameter; and a second cylindrical portion having a second diameter smaller than the first diameter, wherein the first engaging portion extends along a portion of a circumferential surface of the first cylindrical portion in a rotating direction of the detection gear, and wherein the second engaging portion extends along a portion of a circumferential surface of the second cylindrical portion in the rotating direction.

99. The developing cartridge according to claim 98, wherein the second cylindrical portion is positioned at an opposite side of the outer surface with respect to the first cylindrical portion in the axial direction.

100. The developing cartridge according to claim 99, wherein the protrusion protrudes from the first cylindrical portion in the axial direction.

101. The developing cartridge according to claim 96, wherein a length of the first engaging portion in a rotating direction of the detection gear is greater than a length of the second engaging portion in the rotating direction.

102. The developing cartridge according to claim 96, wherein the second engaging portion is spaced apart from the first engaging portion in a rotating direction of the detection gear.

103. The developing cartridge according to claim 102, wherein the first engaging portion includes a first end at one end in the rotating direction and a second end separated from the first end in the rotating direction, wherein the second end is positioned closer to the second engaging portion than the first end portion to the second engaging portion in the rotating direction, wherein the second engaging portion includes a third end at one end in the rotating direction and a fourth end separated from the third end in the rotating direction, wherein the third end is positioned closer to the first engaging portion than the fourth end to the first engaging portion in the rotating direction, and wherein the second end and the third end are spaced apart from each other in the rotating direction.

104. The developing cartridge according to claim 96, wherein the first engaging portion comprises a plurality of gear teeth provided along the first portion.

105. The developing cartridge according to claim 96, wherein the second engaging portion comprises a plurality of gear teeth provided along the second portion.

106. The developing cartridge according to claim 96, wherein the first engaging portion comprises a plurality of gear teeth provided along the first portion, wherein the second engaging portion comprises a plurality of gear teeth provided along the second portion, and wherein numbers of the plurality of gear teeth of the first engaging portion are greater than numbers of the plurality of gear teeth of the second engaging portion.

107. The developing cartridge according to claim 96, wherein the first engaging portion comprises a friction member provided along the first portion.

108. The developing cartridge according to claim 107, wherein the friction member of the first engaging portion is a rubber.

109. The developing cartridge according to claim 96, wherein the second engaging portion comprises a friction member provided along the second portion.

110. The developing cartridge according to claim 109, wherein the friction member of the second engaging portion is a rubber.

111. The developing cartridge according to claim 96, further comprising:

a small-diameter gear rotatable about a second axis extending in the axial direction, the small-diameter gear having a first diameter; and a large-diameter gear rotatable about the second axis and having a second diameter greater than the first diameter, the large-diameter gear being rotatable together with the small-diameter gear, wherein the second engaging portion engages with the large-diameter gear after the first engaging portion is engaged with the small-diameter gear.

112. The developing cartridge according to claim 111, further comprising an agitator extending in the axial direction, the agitator including a shaft extending in the axial direction, wherein the large-diameter gear and the small-diameter gear are mounted to the shaft, the large-diameter gear and the small-diameter gear being rotatable together with rotation of the shaft.

113. The developing cartridge according to claim 96, further comprising:

a small-diameter gear rotatable about a second axis extending in the axial direction, the small-diameter gear having a first diameter; and a large-diameter gear rotatable about the second axis and having a second diameter greater than the first diameter, the large-diameter gear being rotatable together with the small-diameter gear, wherein the first engaging portion comprises a plurality of gear teeth formed along the first portion, wherein the second engaging portion comprises a plurality of gear teeth formed along the second portion, and wherein the plurality of gear teeth of the second engaging portion meshes with the large-diameter gear after the plurality of gear teeth of the first engaging portion is meshed with the small-diameter gear.

114. The developing cartridge according to claim 113, further comprising an agitator extending in the axial direction, the agitator including a shaft extending in the axial direction, wherein the large-diameter gear and the small-diameter gear are mounted to the shaft, the large-diameter gear and the small-diameter gear being rotatable together with rotation of the shaft.

115. The developing cartridge according to claim 96, wherein the outer surface is configured to be in contact with a portion of an image forming apparatus when the developing cartridge is mounted in the image forming apparatus.

116. The developing cartridge according to claim 96, further comprising:

a small-diameter gear rotatable about a second axis extending in the axial direction, the small-diameter gear having a first diameter; and a large-diameter gear rotatable about the second axis and having a second diameter greater than the first diameter, the large-diameter gear being rotatable together with the small-diameter gear, wherein the second engaging portion engages with the large-diameter gear after the first engaging portion is engaged with the small-diameter gear, wherein the detection gear is rotatable from a first position in which the outer surface is in contact with a portion of an image forming apparatus to a second position in which the outer surface is not in contact with the portion of the image forming apparatus, and wherein, when the detection gear is at the second position, the first engaging portion engages with the small-diameter gear and the second engaging portion does not engage with the large-diameter gear.

117. The developing cartridge according to claim 116, wherein the detection gear is further rotatable from the second position to a third position in which the outer surface is in contact with a portion of the image forming apparatus, and wherein, when the detection gear is at the third position, the first engaging portion does not engage with the small-diameter gear and the second engaging portion engages with the large-diameter gear.

118. The developing cartridge according to claim 117, wherein the first engaging portion comprises a plurality of gear teeth provided along the first portion, wherein the second engaging portion comprises a plurality of gear teeth provided along the second portion, wherein the plurality of gear teeth of the second engaging portion meshes with the large-diameter gear after the plurality of gear teeth of the first engaging portion is meshed with the small-diameter gear, and wherein, when the detection gear is at the second position, the plurality of gear teeth of the first engaging portion meshes with the small-diameter gear and the plurality of gear teeth of the second engaging portion does not mesh with the large-diameter gear.

119. The developing cartridge according to claim 118, wherein, when the detection gear is at the third position, the plurality of gear teeth of the first engaging portion does not mesh with the small-diameter gear and the plurality of gear teeth of the second engaging portion meshes with the large-diameter gear.

120. The developing cartridge according to claim 96, further comprising a developing roller extending in the axial direction.

* * * * *